US008918922B2

(12) United States Patent
Kido et al.

(10) Patent No.: US 8,918,922 B2
(45) Date of Patent: Dec. 30, 2014

(54) WATER DISCHARGE VALVE DEVICE AND FLUSH WATER TANK DEVICE WITH SAME

(75) Inventors: Tsutomu Kido, Kitakyushu (JP); Yukinori Kubozono, Kitakyushu (JP); Haruki Matsuda, Fukuoka (JP); Hisashi Koga, Kitakyushu (JP)

(73) Assignee: Toto Ltd. (JP)

( * ) Notice: Subject to any disclaimer, the term of this patent is extended or adjusted under 35 U.S.C. 154(b) by 100 days.

(21) Appl. No.: 13/876,143

(22) PCT Filed: Sep. 26, 2011

(86) PCT No.: PCT/JP2011/071855
§ 371 (c)(1),
(2), (4) Date: Mar. 26, 2013

(87) PCT Pub. No.: WO2012/043460
PCT Pub. Date: Apr. 5, 2012

(65) Prior Publication Data

US 2013/0180039 A1 Jul. 18, 2013

(30) Foreign Application Priority Data

| | | |
|---|---|---|
| Sep. 28, 2010 | (JP) | 2010-217396 |
| Sep. 28, 2010 | (JP) | 2010-217397 |
| Sep. 28, 2010 | (JP) | 2010-217398 |
| Apr. 8, 2011 | (JP) | 2011-086414 |

(51) Int. Cl.
*E03D 1/14* (2006.01)

(52) U.S. Cl.
USPC ..... 4/324; 4/378

(58) Field of Classification Search
CPC ..... E03D 1/14; E03D 1/142; E03D 1/144; E03D 1/34
USPC ..... 4/324, 325, 378, 415
See application file for complete search history.

(56) References Cited

U.S. PATENT DOCUMENTS

| | | | | |
|---|---|---|---|---|
| 5,926,861 | A | 7/1999 | Frost | |
| 6,874,172 | B2 * | 4/2005 | Frost | 4/378 |
| 7,219,375 | B2 * | 5/2007 | Steadman | 4/325 |

FOREIGN PATENT DOCUMENTS

| | | |
|---|---|---|
| GB | 2336605 | 10/1999 |
| JP | 59145844 | 8/1984 |

OTHER PUBLICATIONS

International Search Report for PCT/JP2011/071855, English translation attached to original, Both completed by the Japanese Patent Office on Oct. 7, 2011, All together 5 Pages.

*Primary Examiner* — Huyen Le
(74) *Attorney, Agent, or Firm* — Brooks Kushman P.C.

(57) ABSTRACT

A water discharge valve device includes: a water discharge valve unit which has a valve element for opening and closing a discharge port and a control casing for controlling an up-down movement of the valve element; a casing module which includes a peripheral wall extending upwardly from a bottom wall of a water storage tank while surrounding peripheries of the discharge port and the control casing of the water discharge valve unit, to define an upwardly open space therebetween, an opening formed to penetrate through the peripheral wall, and a switching valve attached to the peripheral wall and adapted to open and close the opening; and a communication port formed in a peripheral plane extending from the control casing of the water discharge valve unit to the discharge port, to provide fluid communication between the casing module and the discharge port.

13 Claims, 26 Drawing Sheets

28
58a
44a
46
46a
46b
48
50
86
40
52a
52b
52
(52c)
62
(90)
58
22a
84
60

WATER DISCHARGE VALVE DEVICE AND FLUSH WATER TANK DEVICE WITH SAME

CROSS-REFERENCE TO RELATED APPLICATION

This application is the U.S. national phase of PCT Appln. No. PCT/JP2011/071855 filed on Sep. 26, 2011, which claims priority to JP Patent Application No. 2010-217396 filed on Sep. 28, 2010, JP Patent Application No. 2010-217397 filed on Sep. 28, 2010, JP Patent Application No. 2010-217398 filed on Sep. 28, 2010, and JP Patent Application No. 2011-086414 filed on Apr. 8, 2011, the disclosures of which are incorporated in their entirety by reference herein.

TECHNICAL FIELD

The present invention relates to a water discharge valve device, and a flush water tank assembly equipped with the water discharge valve device, and, more particularly, to a water discharge valve device for a flush water tank configured to store therein flush water for flushing a toilet bowl, and a flush water tank assembly equipped with the water discharge valve device.

BACKGROUND ART

Heretofore, as a water discharge valve device for a flush water tank configured to store therein flush water for flushing a toilet bowl, and a flush water tank assembly equipped with the water discharge valve device, there has been known a type which comprises: a casing provided to surround a discharge port formed in a bottom of a flush water tank and a water discharge valve for opening and closing the discharge port; an opening formed in a peripheral wall of the casing; and a valve element for opening and closing the opening of the casing, as described, for example, in the following Patent Document 1.

In this conventional type of water discharge valve device and a flush water tank assembly equipped therewith, when full toilet bowl flushing (full flushing mode) is performed, the water discharge valve is moved upwardly (lifted) to open the discharge port, while maintaining the opening of the casing in its open state, to thereby cause flush water in the flush water tank to pass through the opening of the casing, so that an amount of flush water to be discharged from the discharge port to the toilet bowl is increased. On the other hand, when partial toilet bowl flushing (partial flushing mode) is performed, after closing the opening of the casing by the valve element, the water discharge valve is moved upwardly to open the discharge port, so that the amount of flush water to be discharged from an inside of the flush water tank to the toilet bowl via the discharge port is reduced. In this way, it is possible to switch to either one of the full flushing mode and the partial flushing mode.

LIST OF PRIOR ART DOCUMENTS

Patent Documents

Patent Document 1: JP 61-072144A

SUMMARY OF THE INVENTION

Technical Problem

However, in the above conventional type of water discharge valve device, a position of the opening of the casing is located above a lifted position of the valve element of the water discharge valve at a timing of opening the discharge port. Thus, in full toilet bowl flushing, when the water discharge valve is moved upwardly (lifted) while maintaining the opening of the casing in the open state, flush water flowing from the inside of the flush water tank into the casing via the opening of the casing will powerfully hit against the valve element of the water discharge valve during a valve opening event, from thereabove.

Therefore, due to such flush water, a water pressure acts on the valve element of the water discharge valve during the valve opening event, to push the valve element downwardly, which gives rise to a problem that the water discharge valve is liable to be prematurely closed along with the flow of flush water, causing fluctuation in level of flush water to be left in the flush water tank after the water discharge valve closes the discharge port (dead water level).

Moreover, in order to suppress the premature closing of the water discharge valve, it is necessary to take measures, for example, to enlarge a float for the water discharge valve so as to allow a larger buoyancy to act on the water discharge valve, which gives rise to another problem that the water discharge valve device is increased in size as a whole.

The present invention has been made to solve the above conventional problems, and an object thereof is to provide a water discharge valve device capable of preventing premature closing of a water discharge valve due to a flow of flush water to stabilize a dead water level of flush water to be left in a flush water tank after closing of the water discharge valve, thereby making it possible to perform stable toilet bowl flushing, and a flush water tank assembly equipped with the water discharge valve device.

Solution to the Technical Problem

In order to achieve the above object, according to a first aspect of the present invention, there is provided a water discharge valve device for a flush water tank configured to store therein flush water for flushing a toilet bowl. The water discharge valve device comprises: a water discharge valve which includes a valve element for opening and closing a discharge port provided in a bottom wall of the flush water tank, and a control casing for controlling an up-down movement of the valve element; a casing module which includes a peripheral wall extending upwardly from the bottom wall of the flush water tank while surrounding peripheries of the discharge port and the control casing of the water discharge valve, to define an upwardly open space therebetween, an opening formed to penetrate through the peripheral wall, and a switching valve attached to the peripheral wall and adapted to open and close the opening; and a communication port formed in a peripheral plane extending from the control casing of the water discharge valve to the discharge port, to provide fluid communication between the casing module and the discharge port, wherein the opening of the casing module is provided at a height position equal to or lower than that of an upper end of the communication port.

In the water discharge valve device according to the first aspect of the present invention, when the water discharge valve is moved upwardly to a valve open state for supplying flush water in the flush water tank to the toilet bowl through the discharge port to flush the toilet bowl, flush water in the flush water tank flows into an inside of the casing module through the opening of the casing module, and flows toward the discharge port after passing through the communication port formed in ther peripheral plane extending from the control casing of the water discharge valve to the discharge port.

In this case, the opening of the casing module is provided at a height position equal to or lower than that of an upper end of the communication port formed in ther peripheral plane extending from the control casing to the discharge port, so that, even when flush water in the water storage tank flows into the inside of the casing module through the opening of the casing module, it inflows after a force of a flow of flush water is effectively weakened. Thus, the flow force of flush water is weakened in the above manner, so that a force which pushes down the valve element of the water discharge valve in the open state toward a closing direction can be weakened, thereby preventing premature closing of the valve element of the water discharge valve due to a flow of flush water. This makes it possible to stabilize a dead water level of flush water to be left in the flush water tank after closing of the water discharge valve, and perform stable toilet bowl flushing.

Preferably, in the water discharge valve device according to the first aspect of the present invention, the valve element of the water discharge valve is adapted to be moved upwardly to its given uppermost height position when flush water in the flush water tank is supplied from the discharge port to the toilet bowl, wherein the given uppermost height position of the valve element is set to be equal to or higher than a height position of an upper end of the opening of the casing module.

In the water discharge valve device having the above feature, when flush water in the flush water tank is supplied to the toilet bowl through the discharge port to flush the toilet bowl, the given uppermost height position of the valve element of the water discharge valve after being moved upwardly is set to be equal to or higher than the height position of the upper end of the opening of the casing module. This makes it possible to effectively prevent an undesirable situation where the valve element of the water discharge valve in the open state is pushed down in a closing direction by flush water flowing into the inside of the casing module through the opening of the casing module, thereby more effectively preventing the premature closing of the valve element of the water discharge valve due to a flow of flush water.

Preferably, in the water discharge valve device according to the first aspect of the present invention, the control casing of the water discharge valve includes a water compartment adapted to store therein flush water and formed with a small hole for draining the stored flush water at a given small flow rate, and a float provided in the water compartment in such a manner that it is gradually moved downwardly along with a lowering in water level within the water compartment; and the valve element of the water discharge valve is adapted to be moved downwardly in interlocking relation to the downward movement of the float, to close the discharge port, wherein the small hole of the water compartment of the control casing is provided at a height position equal to or higher than that of an upper end of the opening of the casing module.

In the water discharge valve device having the above feature, the small hole of the water compartment of the control casing of the water discharge valve is provided at a height position equal to or higher than that of the upper end of the opening of the casing module. Thus, when flush water in the flush water tank is supplied to the toilet bowl through the discharge port to flush the toilet bowl, flush water drained from the small hole of the water compartment of the control casing is not affected by flush water flowing into the inside of the casing module through the opening of the casing module. Thus, the water level within the water compartment of the control module can be stably lowered, thereby ensuring a stable downward movement of the float and a stable downward movement of the valve element of the water discharge valve.

Preferably, in the water discharge valve device according to the first aspect of the present invention, the valve element of the water discharge valve has a lower end located above and in opposed relation to the discharge port and formed to have a curved surface which is gradually reduced in diameter, in such a manner as to be tapered in a downward direction.

In the water discharge valve device having the above feature, the lower end of the valve element of the water discharge valve is formed in a curved surface which is gradually reduced in diameter, in such a manner as to be tapered in a downward direction, so that, when the valve element of the water discharge valve is opened, and flush water in the flush water tank passes around the lower end of the valve element of the water discharge valve, the flush water is discharged from the discharge port while smoothly flowing along the curved surface of the lower end of the valve element. Thus, it becomes possible to reduce a pressure loss of flush water passing around the lower end of the valve element, and enhance a capability of flushing the toilet bowl.

Preferably, in the water discharge valve device according to the first aspect of the present invention, the discharge port has an inner peripheral surface which is opposed to the lower end of the valve element of the water discharge valve and formed as a flow passage surface gradually reduced in diameter in a downward direction.

In the water discharge valve device having the above feature, an inner peripheral surface of the discharge port opposed to the lower end of the valve element of the water discharge valve and formed as the flow passage surface gradually reduced in diameter in a downward direction, so that, when the valve element of the water discharge valve is opened to discharge flush water in the flush water tank to the toilet bowl through the discharge port, the flush water is discharged while smoothly flowing along the inner peripheral surface of the discharger port formed as the flow passage surface gradually reduced in diameter in a downward direction. Thus, it becomes possible to reduce a pressure loss of flush water passing through the discharge port, and enhance the capability of flushing the toilet bowl.

According to a second aspect of the present invention, there is provided a flush water tank assembly which comprises the above water discharge valve device.

In the flush water tank assembly according to the second aspect of the present invention, it becomes possible to stabilize a dead water level of flush water to be left in the flush water tank after closing of the water discharge valve, and perform stable toilet bowl flushing.

According to a third aspect of the present invention, there is provided a water discharge valve device for a flush water tank configured to store therein flush water for flushing a toilet bowl. The water discharge valve device comprises: a water discharge valve adapted to be moved in an up-down direction to open and close a discharge port provided in a bottom wall of a flush water tank; an operating unit including a rotary shaft, wherein the operating unit is adapted to allow a user to rotationally operate the rotary shaft about its axis so as to manipulate an opening-closing movement of the water discharge valve to switch an amount of flush water suppliable from the discharge port to the toilet bowl, to either one of a full-flushing flush water amount for performing full flushing of the toilet bowl, and a partial-flushing flush water amount for performing partial flushing of the toilet bowl; and coupling means coupling the operating unit and the water discharge valve together. The coupling means includes: a full-flushing coupling member having one end attached to a first mounting position of the operating unit and the other end attached to a first mounting position of the water discharge valve, wherein the full-flushing coupling member is adapted, when the rotary shaft of the operating unit is rotationally operated in a given rotation direction, to move the water discharge valve upwardly so as to perform the full flushing of the toilet bowl; and a partial-flushing coupling member having one end attached to a second mounting position of the operating unit and the other end attached to a second mounting position of the water discharge valve, wherein the partial-flushing coupling member is adapted, when the rotary shaft of the operating unit is rotationally operated in a direction opposite to the given rotation direction, to move the water discharge valve upwardly so as to perform the partial flushing of the toilet bowl. The first mounting position of the operating unit to which the full-flushing coupling member is attached is set on one side with respect to the axis of the rotary shaft of the operating unit, and the second mounting position of the operating unit to which the partial-flushing coupling member is attached is set on the other side with respect to the axis of the rotary shaft of the operating unit.

In the above water discharge valve device according to the third aspect of the present invention, when the rotary shaft of the operating unit is rotationally operated in a given rotation direction so as to flush a toilet, the full-flushing coupling member of the coupling means moves the water discharge valve upwardly to allow the full toilet bowl flushing to be performed. On the other hand, when the rotary shaft of the operating unit is rotationally operated in a direction opposite to the given direction, the partial-flushing coupling member of the coupling means moves the water discharge valve upwardly to allow the partial toilet bowl flushing to be performed. In this manner, the full toilet bowl flushing or partial toilet bowl flushing can be selected based on the rotational operation of the rotary shaft of the operating unit. In this case, the first mounting position of the operating unit to which the full-flushing coupling member is attached is set on one side with respect to the axis of the rotary shaft of the operating unit, and the second mounting position of the operating unit to which the partial-flushing coupling member is attached is set on the other side with respect to the axis of the rotary shaft of the operating unit. Thus, for example, even if a misalignment in relative position between the operating unit and the water discharge valve occurs due to manufacturing errors of the flush water tank made of porcelain, it becomes possible to suppress a difference between respective strokes of the up-down movements of the water discharge valve between the full and partial flushing. In addition, during the up-down movement of the water discharge valve, it becomes possible to reduce a rotation about an axis of the water discharge valve, and suppress an in-plane displacement of a position where the valve element is seated on the discharge port, thereby preventing an undesirable situation where a distortion occurs in a seating surface (e.g., sheet packing) of the water discharge valve, resulting in failing to adequately stop the discharge water.

Preferably, in the water discharge valve device according to the third aspect of the present invention, the axis of the rotary shaft of the operating unit passes across an axis of the water discharge valve, and a distance between the first mounting position of the operating unit and the second mounting position of the operating unit is approximately equal to a distance between the first mounting position of the water discharge valve to which the other end of the full-flushing coupling member is attached, and the second mounting position of the water discharge valve to which the other end of the partial-flushing coupling member is attached.

In the water discharge valve device having the above feature, the axis of the rotary shaft of the operating unit passes across an axis of the water discharge valve, and a distance between the first mounting position of the operating unit and the second mounting position of the operating unit is approximately equal to a distance between the first mounting position of the water discharge valve to which the other end of the full-flushing coupling member is attached, and the second mounting position of the water discharge valve to which the other end of the partial-flushing coupling member is attached. Thus, for example, even if a misalignment in relative position between the operating unit and the water discharge valve occurs due to manufacturing errors of the flush water tank made of porcelain, it becomes possible to suppress a difference between respective strokes of the up-down movements of the water discharge valve between the full and partial flushing. In addition, during the up-down movement of the water discharge valve, it becomes possible to reduce a rotation about an axis of the water discharge valve, and suppress an in-plane displacement of a position where the valve element is seated on the discharge port, thereby preventing an undesirable situation where a distortion occurs in a seating surface (e.g., sheet packing) of the water discharge valve, resulting in failing to adequately stop the discharge water.

According to a fourth aspect of the present invention, there is provided a flush water tank assembly which comprises the above water discharge valve device.

In the flush water tank assembly according to the fourth aspect of the present invention, for example, even if a misalignment in relative position between the operating unit and the water discharge valve occurs due to manufacturing errors of the flush water tank made of porcelain, it becomes possible to suppress a difference between respective strokes of the up-down movements of the water discharge valve between the full and partial flushing. In addition, during the up-down movement of the water discharge valve, it becomes possible to reduce a rotation about an axis of the water discharge valve, and suppress an in-plane displacement of a position where the valve element is seated on the discharge port, thereby preventing an undesirable situation where a distortion occurs in a seating surface (e.g., sheet packing) of the water discharge valve, resulting in failing to adequately stop the discharge water.

According to a fifth aspect of the present invention, there is provided a water discharge valve device for a flush water tank configured to store therein flush water for flushing a toilet bowl. The water discharge valve device comprises: a discharge port unit attached to a flush water tank to form the discharge port; a water discharge valve for opening and closing a discharge port of the discharge port unit; a casing module which includes a peripheral wall extending upwardly from a bottom wall of the flush water tank while surrounding the discharge port to define an upwardly open space therebetween, an opening formed to penetrate through the peripheral wall, and a switching valve attached to the peripheral wall and adapted to open and close the opening, wherein the casing module is detachably attached to the discharge port unit from thereabove.

In the water discharge valve device according to the fifth aspect of the present invention, the casing module is detachably attached to the discharge port unit from thereabove, so that even after the flushing water tank is installed in a toilet, the casing module can be readily detached and attached with respect to the discharge port unit from thereabove. More specifically, depending on types of flushing flush water tanks: a full and partial flushing flush water tank for selecting one of full toilet bowl flushing and partial toilet bowl flushing, and a full flushing flush water tank for limitedly perform only full toilet bowl flushing, the water discharge valve device can be readily reassembled in a suitably state for each flushing type of the flush water tank, with a simple structure allowing the casing module to be attached and detached with respect to the discharge port unit. That is, based on a simple structure which allows the casing module to be attached and detached with respect to the discharge port unit, it becomes possible to readily set to perform partial toilet bowl flushing in addition to full toilet bowl flushing, and readily omit the partial flushing to limitedly perform only the full flushing. Thus, the water discharge valve device can be readily reassembled in a suitably state for each flushing type of the flush water tank, and components other than the casing module of the water discharge valve device (e.g., the discharge port unit and the water discharge valve unit) can be standardized or commonized, irrespective of toilet bowl flushing types.

Preferably, the water discharge valve device according to the fifth aspect of the present invention is configured to: in a state in which the casing module is attached to the discharge port unit, in response to operating the switching valve to open the opening, increase an amount of flush water flowing into an inside of the casing module, to allow an amount of flush water suppliable to the toilet bowl when the water discharge valve opens the discharge port, to be set to a given value for full flushing, and, in response to operating the switching valve to close the opening, reduce the amount of flush water flowing into the inside of the casing module, to allow the amount of flush water suppliable to the toilet bowl when the water discharge valve opens the discharge port, to be set to a given value for partial flushing; and, in a state in which the casing module is detached from the discharge port unit, allow the amount of flush water suppliable to the toilet bowl when the water discharge valve opens the discharge port, to be set to the given value for full flushing.

In the water discharge device having the above feature, in the state in which the casing module is attached to the discharge port unit, in response to operating the switching valve to open the opening, the water discharge valve device is configured to increase an amount of flush water flowing into the inside of the casing module, to allow an amount of flush water suppliable to the toilet bowl when the water discharge valve opens the discharge port, to be set to a given value for full flushing, and, in response to operating the switching valve to close the opening, reduce the amount of flush water flowing into the inside of the casing module, to allow the amount of flush water suppliable to the toilet bowl when the water discharge valve opens the discharge port, to be set to a given value for partial flushing. On the other hand, in the state in which the casing module is detached from the discharge port unit, the water discharge valve device is configured to allow the amount of flush water suppliable to the toilet bowl when the water discharge valve opens the discharge port, to be set to the given value for full flushing. Thus, for example, when the water discharge valve device is used in a flush water tank assembly of a type capable of allowing a user to select either one of full toilet bowl flushing and the partial toilet bowl flushing, it is used under a condition that the casing module is attached to the discharge port unit from thereabove, whereas, when the water discharge valve device is used in a flush water tank assembly of a type capable of limitedly performing only full toilet bowl flushing, it is used under a condition that the casing module is detached from the discharge port unit from thereabove. In this way, the water discharge valve device can be readily reassembled in a suitably state for each flushing type of the flush water tank assembly. That is, based on a simple structure which allows the casing module to be attached and detached with respect to the discharge port unit, it becomes possible to readily set to perform partial toilet bowl flushing in addition to full toilet bowl flushing, and readily omit the partial flushing to limitedly perform only the full flushing. Thus, the water discharge valve device can be readily reassembled in a suitably state for each flushing type of the flush water tank, and components other than the casing module of the water discharge valve device (e.g., the discharge port unit and the water discharge valve unit) can be standardized or commonized, irrespective of toilet bowl flushing types.

Preferably, in the water discharge valve device according to the fifth aspect of the present invention, the water discharge valve includes a valve element for opening and closing the discharge port of the discharge port unit, and a control casing for controlling an up-down movement of the valve element, wherein the control casing of the water discharge valve includes a water compartment adapted to store therein flush water and formed with a small hole for draining the stored flush water at a given small flow rate, and a float provided in the water compartment in such a manner that it is gradually moved downwardly along with a lowering in water level within the water compartment, and the valve element of the water discharge valve is adapted to be moved downwardly in interlocking relation to the downward movement of the float, to close the discharge port.

In the water discharge valve device having the above feature, when flush water in the water compartment of the control casing is drained through the small hole to cause a lowering in water level within the water compartment, the float is moved downwardly, and the valve element of the water discharge valve is moved downwardly in interlocking relation to the downward movement of the float, to close the discharge port, so that the water discharge valve can be effectively operated, irrespective of whether or not the casing module is attached to the discharge port unit. Thus, when the water discharge valve device is used in a flush water tank assembly of a type capable of allowing a user to select either one of full toilet bowl flushing and partial toilet bowl flushing, it is used under a condition that the casing module is attached to the discharge port unit from thereabove, whereas, when the water discharge valve device is used in a flush water tank assembly of a type capable of limitedly performing only full toilet bowl flushing, it is used under a condition that the casing module is detached from the discharge port unit from thereabove. In this way, the water discharge valve device can be readily reassembled in a suitably state for each flushing type of the flush water tank assembly. Further, based on a simple structure which allows the casing module to be attached and detached with respect to the discharge port unit, the water discharge valve device can be readily reassembled in a suitably state for each flushing type of the flush water tank, so that components other than the casing module of the water discharge valve device (e.g., the discharge port unit and the water discharge valve unit) can be standardized or commonized, irrespective of toilet bowl flushing types.

Preferably, in the water discharge valve device according to the fifth aspect of the present invention, the discharge port unit includes: a casing-module mounting portion which forms the discharge port and to which the casing module is detachably attached from thereabove; and a control-casing mounting portion which is disposed between the casing-module mounting portion and the control casing of the water discharge valve, and formed with the communication port for allowing flush water on an outside of the control casing to flow into the discharge port, and to which the control casing of the water discharge valve is detachably attached from thereabove.

In the water discharge valve device having the above feature, when the water discharge valve device is used in a flush water tank assembly of a type capable of allowing a user to select either one of full toilet bowl flushing and partial toilet bowl flushing, it is used under a condition that the casing module is attached to the casing-module mounting portion of the discharge port unit from thereabove and the control casing is attached to the control-casing mounting portion of the discharge port unit, whereas, when the water discharge valve device is used in a flush water tank assembly of a type capable of limitedly performing only full toilet bowl flushing, it is used under a condition that the casing module is detached from the casing-module mounting portion of the discharge port unit, and then the control casing is attached to the control-casing mounting portion of the discharge port unit. In this way, the water discharge valve device can be readily reassembled in a suitably state for each flushing type of the flush water tank assembly. Further, based on a simple structure which allows the casing module to be attached and detached with respect to the casing-module mounting portion of the discharge port unit, the water discharge valve device can be readily reassembled in a suitably state for each flushing type of the flush water tank, so that components other than the casing module of the water discharge valve device (e.g., the discharge port unit and the water discharge valve unit) can be standardized or commonized, irrespective of toilet bowl flushing types.

Preferably, in the water discharge valve device according to the fifth aspect of the present invention, the casing module includes: a casing body capable of receiving therein flush water; and engagement means formed at an end of the casing body on the side of the discharge port and adapted to be engageable and disengageable with respect to the casing-module mounting portion by rotating the casing body about its axis.

In the water discharge valve device having the above feature, when the casing module is attached and detached with respect to the discharge port unit, the engagement means formed at the end of the casing body on the side of the discharge port is engaged and disengaged with respect to the casing-module mounting portion by rotating the casing body about its axis. This makes it possible to prevent an undesirable situation where, when the water level within the flush water tank is raised or lowered, the casing module is moved upwardly or downwardly along with the rising or lowering of the water level, and unexpectedly disengaged from the discharge port unit.

According to a sixth aspect of the present invention, there is provided a flush water tank assembly which comprises the above water discharge valve device.

In the flush water tank assembly according to the sixth aspect of the present invention, when the water discharge valve device is used in a flush water tank assembly of a type capable of allowing a user to select either one of full toilet bowl flushing and the partial toilet bowl flushing, it is used under a condition that the casing module is attached to the discharge port unit from thereabove, whereas, when the water discharge valve device is used in a flush water tank assembly of a type capable of limitedly performing only full toilet bowl flushing, it is used under a condition that the casing module is detached from the discharge port unit from thereabove. In this way, the water discharge valve device can be readily reassembled in a suitably state for each flushing type of the flush water tank assembly.

According to a seventh aspect of the present invention, there is provided a water discharge valve device for a flush water tank configured to store therein flush water for flushing a toilet bowl. The water discharge valve device comprises: a water discharge valve for opening and closing a discharge port provided in a bottom wall of a flush water tank; an inner control casing member for controlling an up-down movement of the water discharge valve; an outer control casing member provided to surround peripheries of the discharge port, the water discharge valve and the inner control casing member, wherein the outer control casing member includes a peripheral wall extending upwardly from the bottom wall of the flush water tank to define an upwardly open space therebetween, and a switching valve installed to open and close an opening formed to penetrate through the peripheral wall. The outer control casing member is configured to control a flow rate of flush water flowing out of the discharge port of the flush water tank, according to opening and closing of the opening by the switching valve. The switching valve of the outer control casing member includes: a switching valve body swingably attached to a peripheral wall of the outer control casing member, and adapted to be swingingly moved outwardly with respect to the outer control casing member, from a given upper position where it closes the opening of the outer control casing member, to a given lower position where it opens the opening of the outer control casing member; a plate-shaped weight member; and a weight member mounting section provided in the switching valve body and adapted to allow the weight member to be detachably attached thereto. The weight member mounting section has: a support portion for supporting an upper edge and a lower edge of the weight member; and a fixing portion provided on a one side of the support portion to fix a lateral portion of the weight member. The fixing portion has elastic contact means adapted to, when the weight member is attached or detached with respect to the support portion, provide elastic contact between the weight member and the fixing portion so as to allow the weight member to pass against the fixing member.

In the water discharge valve device according to the seventh aspect of the present invention, in a state in which the weight member is attached to the weight member mounting section of the switching valve of the outer control casing member, according to a load of the weight member in an up-down direction, the switching valve body can be swingingly moved between the given upper position where it closes the opening of the outer control casing member, and the given lower position where it opens the opening of the outer control casing member. During the swinging movement, the up-down directional load is applied from the weight member to the support portion of the weight member mounting section of the switching member, whereas the up-down directional load of the weight member is not applied to the fixing portion and the relatively low-strength elastic contact means of the weight member mounting section of the switching valve, so that it becomes possible to prevent the fixing portion and the elastic contact means from being damaged by the load of the weight member. Thus, it becomes possible to prevent an undesirable situation where, when the switching valve of the outer control casing member is being moved to open or close the opening of the outer control casing member, the fixing portion and the elastic contact means of the weight member mounting section of the switching valve is broken, causing the weight member to drop off from the weight member mounting section. This makes it possible to prevent an inadequate movement of the switching valve, thereby enhancing reliability of the water discharge valve device.

Preferably, in the water discharge valve device according to the seventh aspect of the present invention, the weight member of the switching valve of the outer control casing member is adapted, when the weight member is attached to the weight member mounting section, to be movable in a horizontal direction while elastically contacting the fixing portion by utilizing the elastic contact means, and, after the weight member is inserted between the switching member body and the support portion, and released from the elastic contact, to be fixed to the switching member body by the support portion and a lateral surface of the fixing portion.

In the water discharge valve device having the above feature, when the weight member is attached to the weight member mounting section of the switching valve of the outer control casing member, the weight member is moved in a horizontal direction while elastically contacting the fixing portion by utilizing the elastic contact means. Then, the weight member is inserted between the switching member body and the support portion, and released from the elastic contact. In this manner, the weight member can be reliably fixed to the switching member body by the support portion and the fixing portion. Further, even when the switching valve body is swingingly moved between the given upper position where it closes the opening of the outer control casing member, and the given lower position where it opens the opening of the outer control casing member, the up-down directional load of the weight member is not applied to the fixing portion and the relatively low-strength elastic contact means of the weight member mounting section of the switching valve, which fixes a lateral portion of the weight member, so that it becomes possible to prevent the fixing portion and the elastic contact means from being damaged by the load of the weight member. Further, it becomes possible to prevent an undesirable situation where, when the switching valve of the outer control casing member is being moved to open or close the opening of the outer control casing member, the fixing portion and the elastic contact means of the weight member mounting section of the switching valve is broken, causing the weight member to drop off from the weight member mounting section. This makes it possible to prevent inadequate opening and closing movements of the switching valve, thereby enhancing reliability of the water discharge valve device.

Preferably, in the water discharge valve device according to the seventh aspect of the present invention, the elastic contact means of the fixing portion is an elastic fastener which has: a base end protruding outwardly from an outer surface of the switching member body by a given length; a distal end extending upwardly from the base end by a given length while maintaining a spaced-apart relation to the outer surface of the switching member body by a given distance; and an elastically deformable portion extending from the base end to the distal end, wherein the elastically deformable portion is adapted, when the weight member is attached to the weight member mounting section, to be elastically deformed outwardly with respect to the outer surface of the switching member body, in such a manner that the base end and the distal end serve as a fixed end and a free end, respectively, so as to allow the weight member to pass between the switching member body and the elastic fastener, and, after completion of the attachment of the weight member to the weight member mounting section, to be restored from the elastically deformed state so as to cause a lateral surface of the weight member and a lateral surface of the elastic fastener on the side the weight member to contact each other, thereby allowing the weight member to be fixed in the horizontal direction.

In the water discharge valve device having the above feature, after completion of the attachment of the weight member to the weight member mounting section, a lateral surface of the weight member and a lateral surface of the elastic fastener on the side the weight member are brought into contact with each other, thereby allowing the weight member to be fixed in the horizontal direction. Thus, even when the switching valve body is swingingly moved between the given upper position where it closes the opening of the outer control casing member, and the given lower position where it opens the opening of the outer control casing member, the up-down directional load of the weight member is not applied to the base end of the elastic fastener having relatively low strength, so that it becomes possible to prevent the elastic fastener from being damaged by the load of the weight member. Further, it becomes possible to prevent an undesirable situation where, when the switching valve of the outer control casing member is being moved to open or close the opening of the outer control casing member, the elastic fastener of the weight member mounting section of the switching valve is broken, causing the weight member to drop off from the weight member mounting section. This also makes it possible to prevent inadequate opening and closing movements of the switching valve, thereby enhancing reliability of the water discharge valve device.

According to an eighth aspect of the present invention, there is provided a flush water tank assembly which comprises the above water discharge valve device.

The flush water tank assembly according to the eighth aspect of the present invention can have enhanced flush water supply capability and reliability.

Effect of the Invention

The water discharge valve device and the flush water tank assembly of the present invention is capable of preventing the premature closing of the water discharge valve due to a flow of flush water to stabilize the dead water level of flush water to be left in the flush water tank after closing of the water discharge valve, thereby making it possible to perform stable toilet bowl flushing.

BRIEF DESCRIPTION OF THE DRAWINGS

FIG. 7(*b*) is a sectional view taken along the line VII-VII in FIG. 3, which illustrates the water discharge valve device of the flush water tank assembly according to the first embodiment, in a state at a timing of starting water discharge in a full flushing mode.

FIG. 7(*c*) is a sectional view taken along the line VII-VII in FIG. 3, which illustrates the water discharge valve device of the flush water tank assembly according to the first embodiment, in a state at a timing of starting water discharge in a partial flushing mode.

FIG. 8(*b*) is a sectional view illustrating the water discharge valve device of the flush water tank assembly according to the first embodiment, in a state just after starting the water discharge in the full flushing mode.

FIG. 8(*c*) is a sectional view illustrating the water discharge valve device of the flush water tank assembly according to the first embodiment, in a state during the course of the water discharge in the full flushing mode.

FIG. 8(*d*) is a sectional view illustrating the water discharge valve device of the flush water tank assembly according to the first embodiment, in a state after completion of the water discharge in the full flushing mode.

FIG. 9(*b*) is a sectional view illustrating the water discharge valve device of the flush water tank assembly according to the first embodiment, in a state just after starting the water discharge in the partial flushing mode.

FIG. 9(*c*) is a sectional view illustrating the water discharge valve device of the flush water tank assembly according to the first embodiment, in a state during the course of the water discharge in the partial flushing mode.

FIG. 9(*d*) is a sectional view illustrating the water discharge valve device of the flush water tank assembly according to the first embodiment, in a state after completion of the water discharge in the partial flushing mode.

FIG. 10(*b*) is a sectional view illustrating the water discharge valve device of the flush water tank assembly according to the second embodiment, in a state at a timing of starting water discharge in the full flushing mode.

FIG. 10(*c*) is a sectional view illustrating the water discharge valve device of the flush water tank assembly according to the second embodiment, in a state at a timing of starting water discharge in the partial flushing mode.

FIGS. 11(*d*) to 1(*f*) are process diagrams illustrating the process of reassembling the water discharge valve device according to the third embodiment from the state in which the casing module is installed therein to the state in which the casing module is detached therefrom.

FIGS. 11(*g*) to 1(*i*) are process diagrams illustrating the process of reassembling the water discharge valve device according to the third embodiment from the state in which the casing module is installed therein to the state in which the casing module is removed therefrom.

FIG. 26(*b*) is a perspective view illustrating the switching valve in a state during the attachment of the weight member, in the water discharge valve device of the flush water tank assembly according to the fourth embodiment.

FIG. 26(*c*) is a perspective view illustrating the switching valve in a state after completion of the attachment of the weight member, in the water discharge valve device of the flush water tank assembly according to the fourth embodiment.

FIG. 28(*b*) is a front sectional view illustrating the water discharge valve device of the flush water tank assembly according to the fourth embodiment, in a state just after starting the water discharge in the full flushing mode.

FIG. 28(*c*) is a front sectional view illustrating the water discharge valve device of the flush water tank assembly according to the fourth embodiment, in a state during the course of the water discharge in the full flushing mode.

FIG. 28(*d*) is a front sectional view illustrating the water discharge valve device of the flush water tank assembly according to the fourth embodiment, in a state after completion of the water discharge in the full flushing mode.

FIG. 29(*b*) is a front sectional view illustrating the water discharge valve device of the flush water tank assembly according to the fourth embodiment, in a state just after starting the water discharge in the partial flushing mode.

FIG. 29(*c*) is a front sectional view illustrating the water discharge valve device of the flush water tank assembly according to the fourth embodiment, in a state during the course of the water discharge in the partial flushing mode.

FIG. 29(*d*) is a front sectional view illustrating the water discharge valve device of the flush water tank assembly according to the fourth embodiment, in a state after completion of the water discharge in the partial flushing mode.

FIG. 30(*b*) is a side view illustrating the switching valve in a state during the attachment of the weight member, in the water discharge valve device of the flush water tank assembly according to the fifth embodiment.

FIG. 30(*c*) is a side view illustrating the switching valve in a state after completion of the attachment of the weight member, in the water discharge valve device of the flush water tank assembly according to the fifth embodiment.

DESCRIPTION OF EMBODIMENTS

With reference to the accompanying drawings, a water discharge valve device and a flush water tank assembly equipped therewith, according to a first embodiment of the present invention, will now be described.

First of all, based on FIG. 1, a flush toilet using the flush water tank assembly according to the first embodiment will be described.

Figure 1:
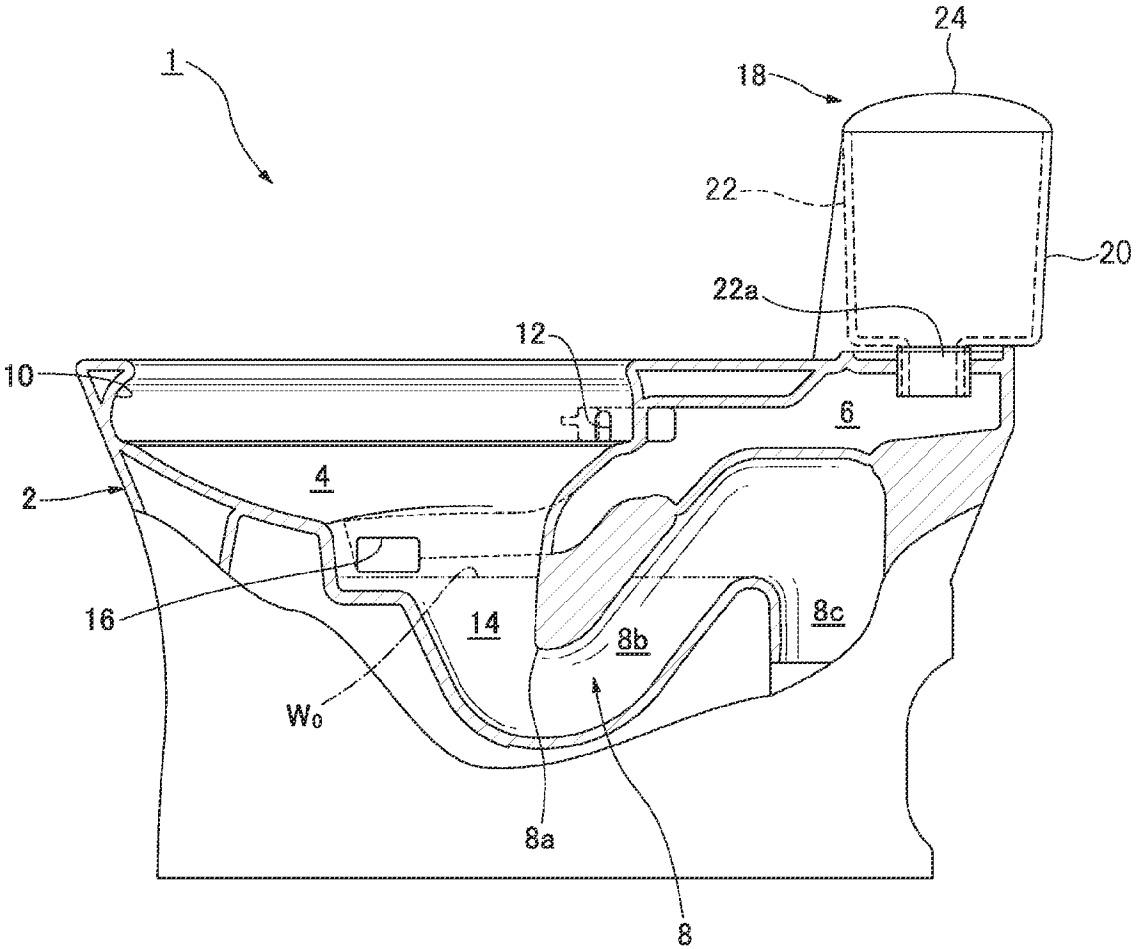
FIG. 1 is a sectional view of a flush toilet using a flush water tank assembly according to a first embodiment of the present invention.

FIG. 1 is a sectional view of the flush toilet using the flush water tank assembly according to the first embodiment.

As illustrated in FIG. 1, the reference numeral 1 indicates a so-called wash-down type flush toilet which comprises a toilet main unit 2 formed with a bowl portion 4, a water conduit 6, and a trap passage 8 communicated with a bottom of the bowl portion 4.

The bowl portion 4 of the toilet main unit 2 has an upper edge formed with an inwardly overhanging rim 10, and a first spout port 12 for spouting flush water supplied from the water conduit 6. The first spout port 12 is configured such that flush water spouted therefrom falls while spirally whirling, to thereby flush the bowl portion.

The bowl portion 4 has a lower region formed as a water pooling region 14 in which a pooled-water level W0 is indicated by the one-dot chain line. The drainage trap passage 8 has an inlet 8*a* opened at a bottom of the water pooling region 14, and an upward sub-passage 8*b* extending rearwardly from the inlet 8*a*. The upward sub-passage 8*b* is continuous with a downward sub-passage 8*c*, and a lower end of the downward sub-passage 8*c* is connected to a drain pipe (not illustrated) arranged under a floor, via a drain socket (not illustrated). The bowl portion 4 further has a second spout port 16 formed at a position above the pooled-water level W0 in the bowl portion 4 to spout flush water supplied from the water conduit 6. The second spout port 16 is configured such that flush water spouted therefrom causes water pooled in the water pooling region 14 to have a flow whirling in an up-down direction.

A flush water tank assembly 18 (details thereof will be described later) is provided above the water conduit 6 of the toilet main unit 2 to store therein flush water to be supplied to the toilet main unit 2.

The flush water tank assembly 18 comprises a porcelain outer tank 20, a water storage tank 22 disposed inside the outer tank 20 and adapted to store therein flush water for flushing the toilet main unit 2 of the flush toilet 1, and a cover 24 placed on the outer tank 20.

The water storage tank 22 has a bottom formed with a discharge port 22*a* communicated with the water conduit 6 of the toilet main unit 2 to allow flush water in the water storage tank 22 to be discharged to the water conduit 6 therethrough. The amount of flush water to be stored in the water storage tank 22 varies depending on types of toilet bowls.

It is to be understood that the flush water tank assembly 18 according to the first embodiment is also usable in any suitable type of flush toilet (such as a siphon type flush toilet) other than the above wash-down type.

Secondly, based on FIG. 2, the flush water tank assembly 18 will be described in detail.

Figure 2:
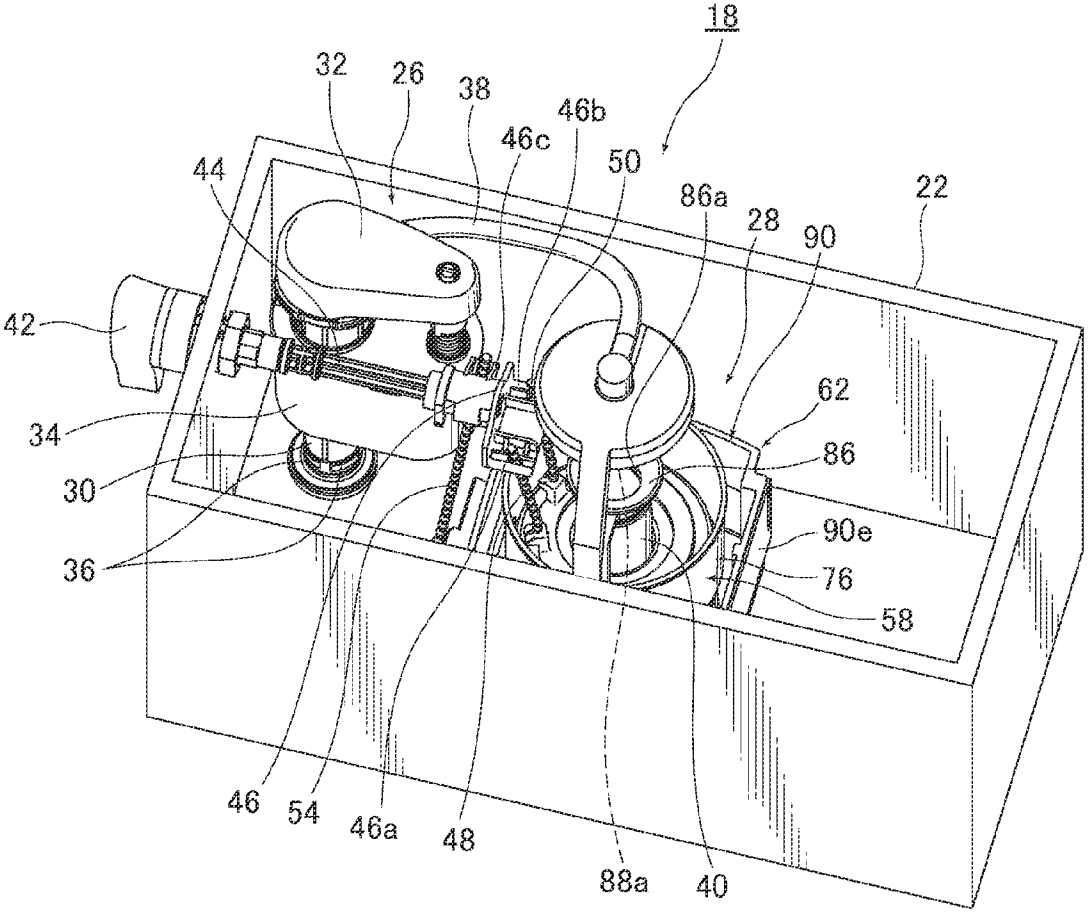
FIG. 2 is a perspective view of a structure inside a water storage tank in the flush water tank assembly according to the first embodiment, when viewed from a frontward and oblique upward position, wherein a cover is removed therefrom.
Figure 3:
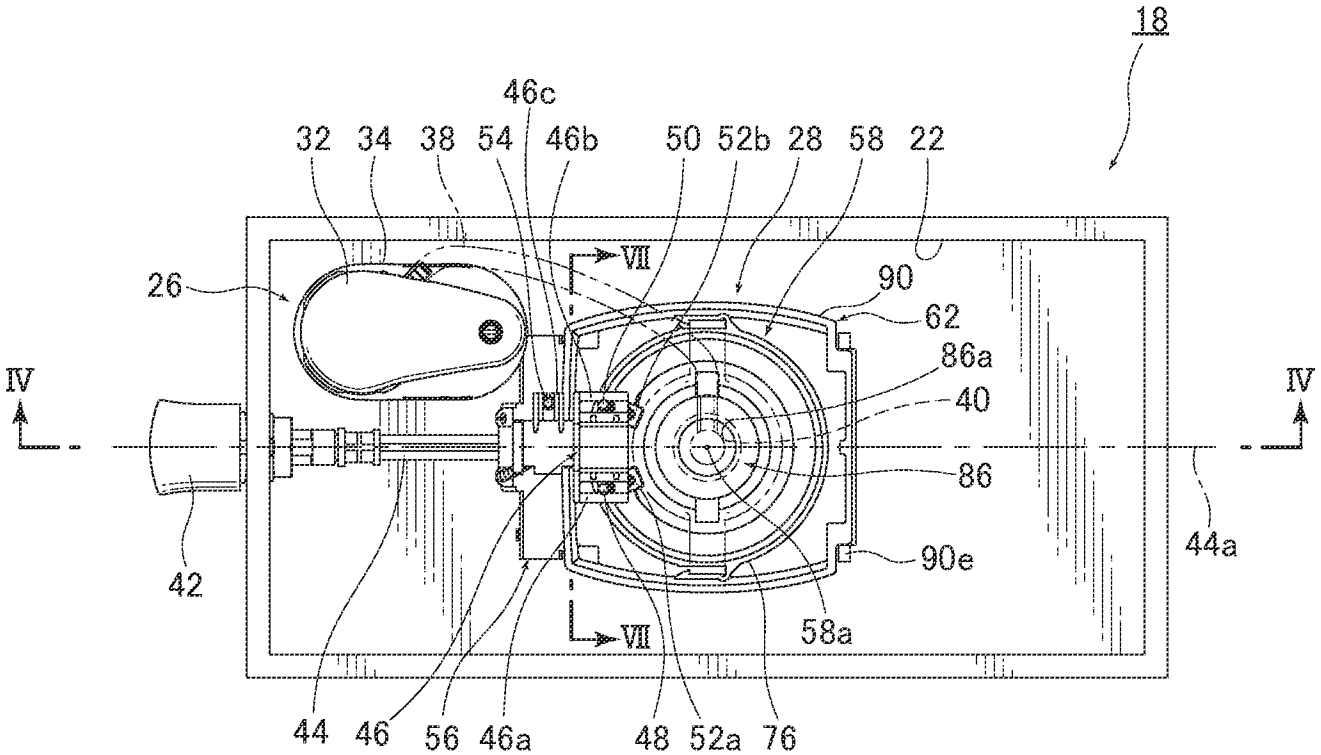
FIG. 3 is a top plan view illustrating the structure inside the water storage tank in the flush water tank assembly according to the first embodiment.

FIG. 2 is a perspective view of a structure inside the water storage tank in the flush water tank assembly according to the first embodiment, when viewed from a frontward and oblique upward position, wherein the cover is removed therefrom. FIG. 3 is a top plan view illustrating the structure inside the water storage tank in the flush water tank assembly according to the first embodiment.

Figure 4:
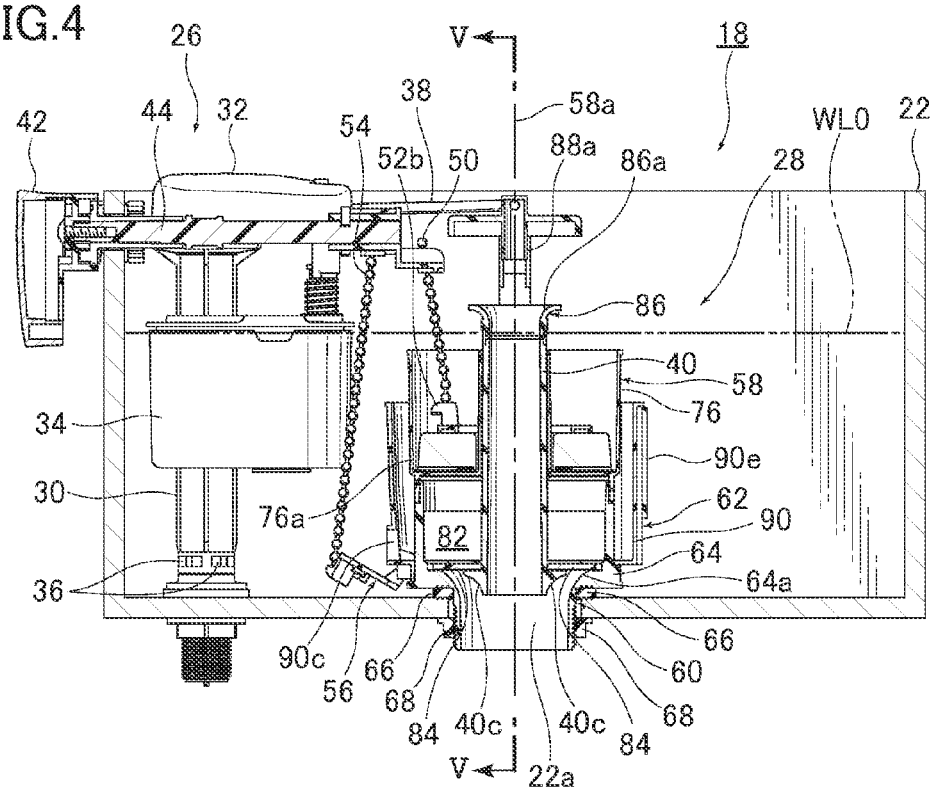
FIG. 4 is a sectional view taken along the line IV-IV in FIG. 3.
Figure 5:
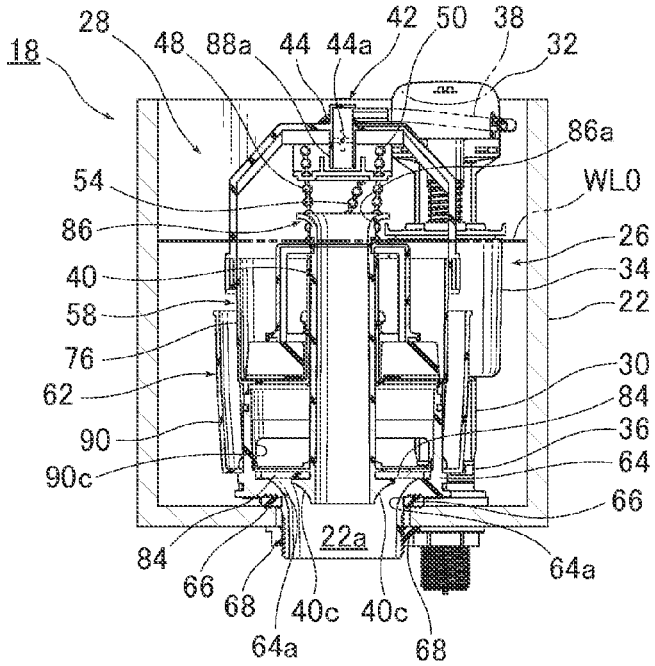
FIG. 5 is a sectional view taken along the line V-V in FIG. 4.

FIG. 4 is a sectional view taken along the line IV-IV in FIG. 3, and FIG. 5 is a sectional view taken along the line V-V in FIG. 4. In FIGS. 4 and 5, a maximum water level within the water storage tank 22 is designated by WL0.

As illustrated in FIGS. 2 to 5, the water storage tank 22 of the flush water tank assembly 18 is internally provided with a water supply device 26 for supplying flush water into the water storage tank 22, and a water discharge valve device 28 for selectively opening the discharge port 22*a* to discharge flush water stored in the water storage tank 22 to the water conduit 6 of the toilet main unit 2.

The water supply device 26 comprises: a water supply pipe 30 connected to an external water supply source and installed to extend upwardly from a bottom of the water storage tank 22; a water supply valve 32 attached to an upper end of the water supply pipe 30 and adapted to switch between a water spouting state and a water stopping state with respect to an inside of the water storage tank 22, in terms of flush water supplied from the water supply pipe 30; and a float 34 adapted to be moved up and down according to a change in water level within the water storage tank 22 to cause the water supply valve 32 to switch between the water spouting state and the water stopping state.

The water supply pipe 30 has a spout port 36 opened at an outer periphery of a lower end of the water supply pipe 30. The spout port 36 is configured such that flush water from the water supply valve 32 is spouted into the water storage tank 22 therethrough.

The water supply device 26 further comprises a refill pipe 38 connected to the water supply valve 32. The refill pipe 38 has a downstream end located just above an opening at an upper end of an aftermentioned overflow pipe 40 of the water discharge valve device 28.

In the water supply device 26, when flush water in the water storage tank 22 is discharged to the toilet main unit by the water discharge valve device 28, the flush water level is lowered, and the float 34 is moved downwardly, so that the water supply valve 32 is opened to start the water spouting state with respect to the inside of the water storage tank 22, i.e., start water spouting from the spout port 36. Then, when the water level is raised along with continuation of the water spouting, float 34 also rises, causing water supply valve 32 to close and water spout port 36 to be turned off. The level of flush water in the water storage tank 22 can thus be maintained at a predetermined full water level.

Thirdly, with reference to FIGS. 2 to 9(*d*), the water discharge valve device 28 will be described in detail.

Figure 6:
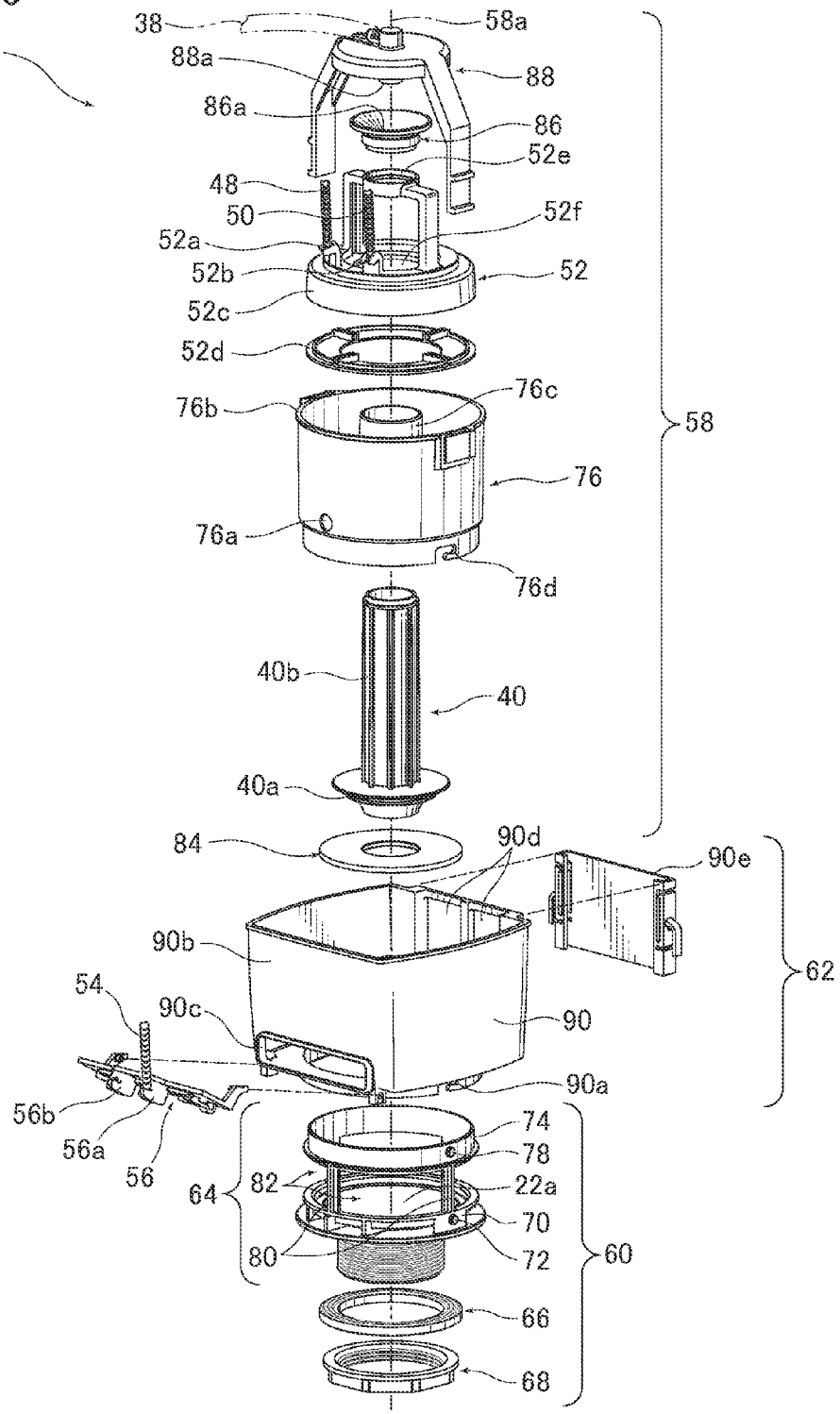
FIG. 6 is an exploded perspective view of a water discharge valve device of the flush water tank assembly according to the first embodiment.

FIG. 6 is an exploded perspective view of the water discharge valve device of the flush water tank assembly according to the first embodiment.

Figures 7A, 7B, 7C:
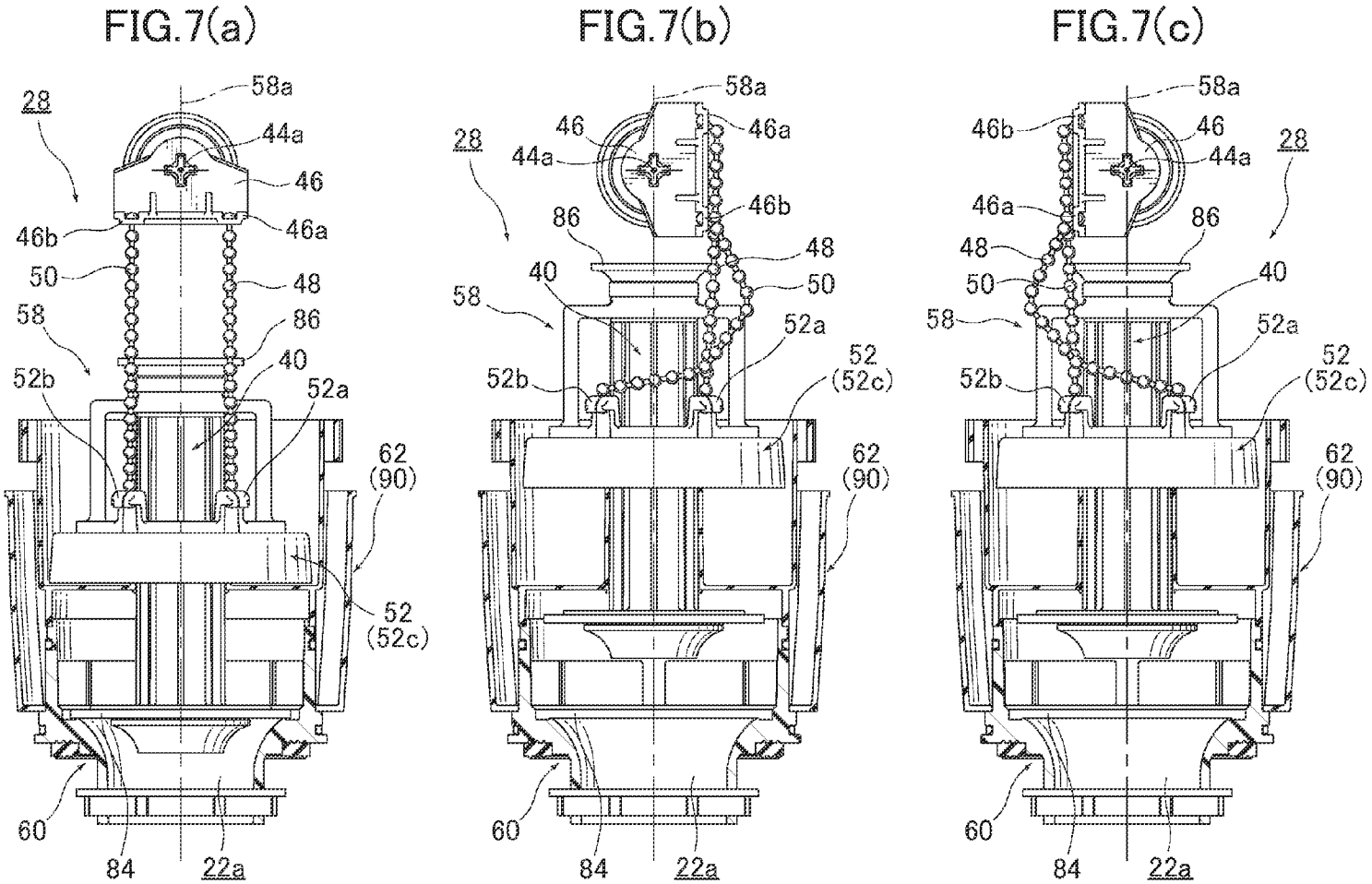
FIG. 7(*a*) is a sectional view taken along the line VII-VII in FIG. 3, which illustrates the water discharge valve device of the flush water tank assembly according to the first embodiment, in a valve closed state.
Figure 8A:
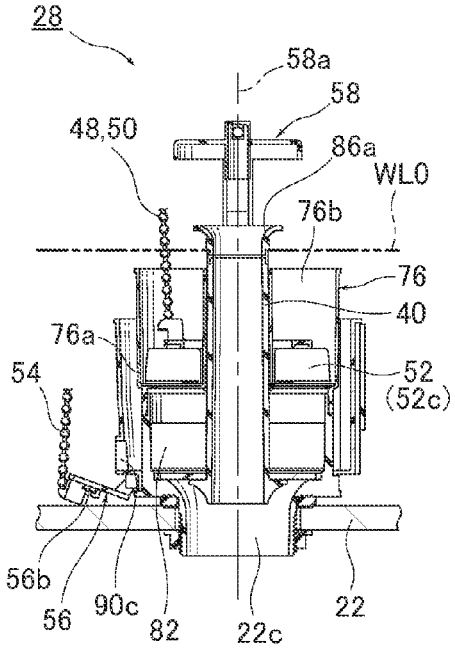
FIG. 8(*a*) is a sectional view illustrating the water discharge valve device of the flush water tank assembly according to the first embodiment, in a state before starting the water discharge in the full flushing mode.
Figure 8B:
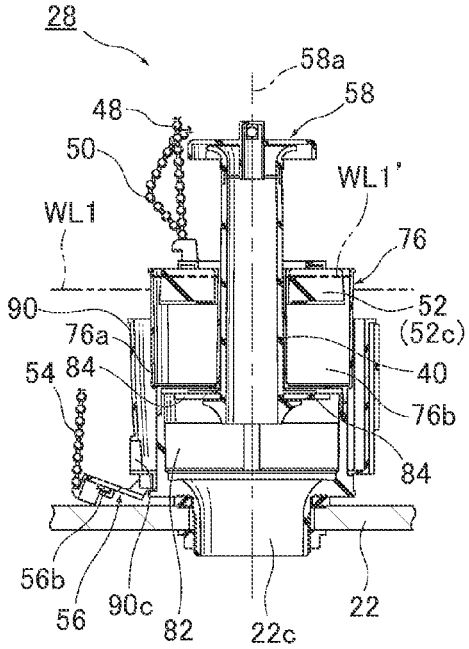
Figure 8C:
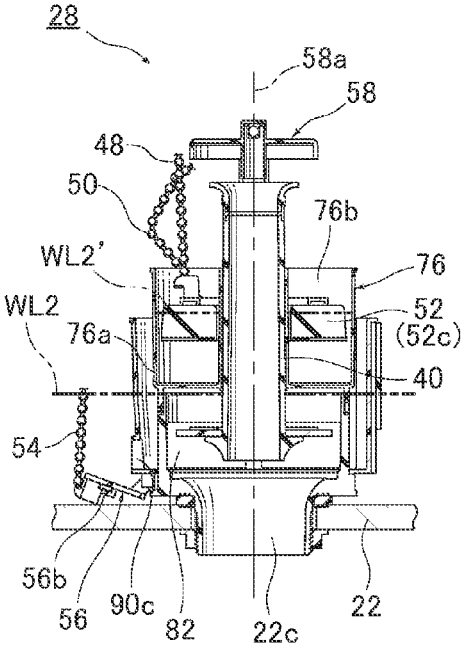
Figure 8D:
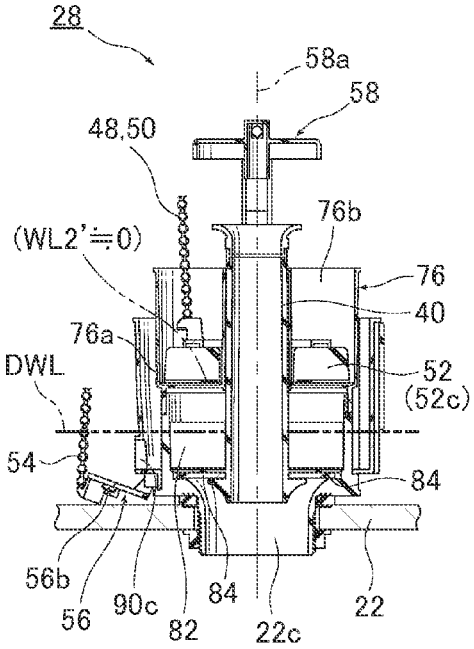
Figure 9A:
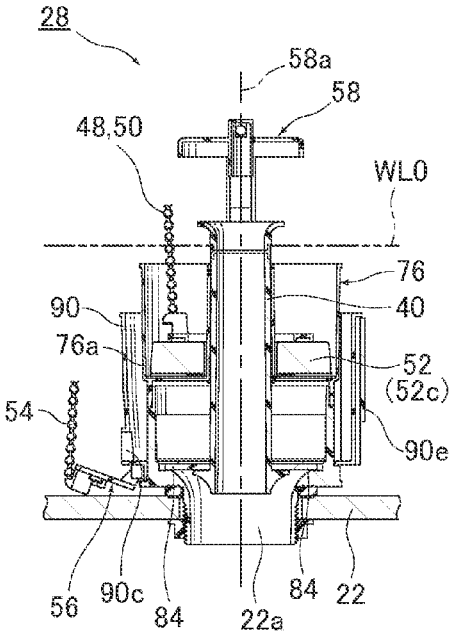
FIG. 9(*a*) is a sectional view illustrating the water discharge valve device of the flush water tank assembly according to the first embodiment, in a state before starting the water discharge in the partial flushing mode.
Figure 9B:
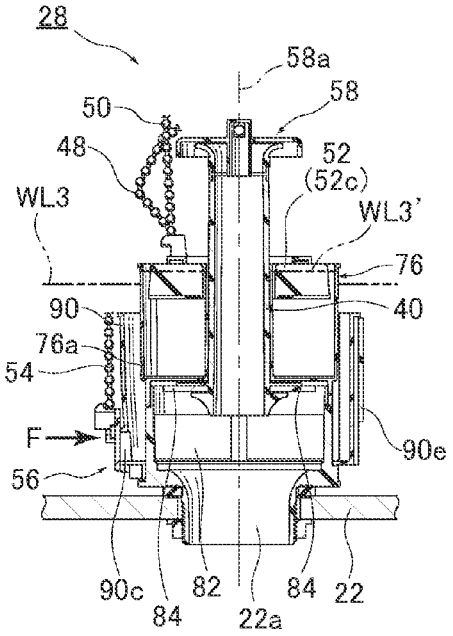
Figure 9C:
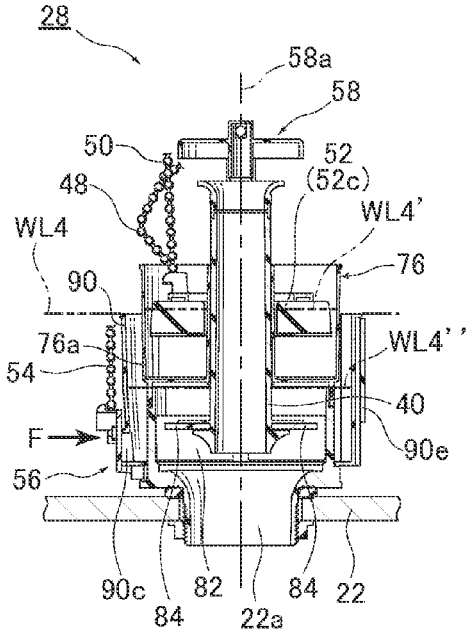
Figure 9D:
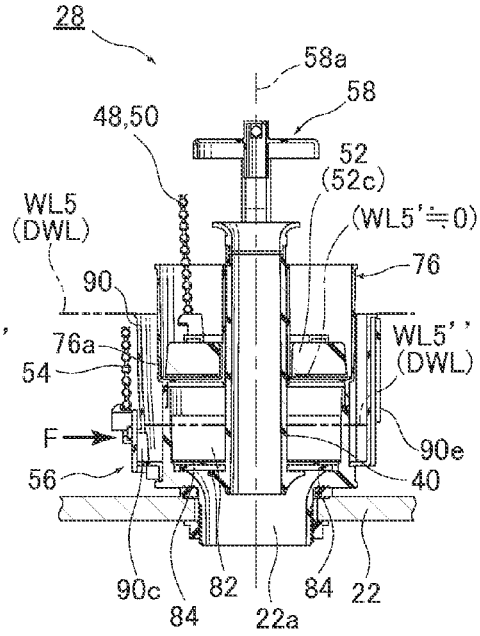

FIG. 7(*a*) is a sectional view taken along the line VII-VII in FIG. 3, which illustrates the water discharge valve device of the flush water tank assembly according to the first embodiment, in a valve closed state. FIG. 7(*b*) is a sectional view taken along the line VII-VII in FIG. 3, which illustrates the water discharge valve device of the flush water tank assembly according to the first embodiment, in a state at a timing of starting water discharge in a full flushing mode. FIG. 7(*c*) is a sectional view taken along the line VII-VII in FIG. 3, which illustrates the water discharge valve device of the flush water tank assembly according to the first embodiment, in a state at a timing of starting water discharge in a partial flushing mode.

FIG. 8(*a*) is a sectional view illustrating the water discharge valve device of the flush water tank assembly according to the first embodiment, in a state before starting the water discharge in the full flushing mode, and FIG. 8(*b*) is a sectional view illustrating the water discharge valve device of the flush water tank assembly according to the first embodiment, in a state just after starting the water discharge in the full flushing mode. FIG. 8(*c*) is a sectional view illustrating the water discharge valve device of the flush water tank assembly according to the first embodiment, in a state during the course of the water discharge in the full flushing mode, and FIG. 8(*d*) is a sectional view illustrating the water discharge valve device of the flush water tank assembly according to the first embodiment, in a state after completion of the water discharge in the full flushing mode.

FIG. 9(*a*) is a sectional view illustrating the water discharge valve device of the flush water tank assembly according to the first embodiment, in a state before starting the water discharge in the partial flushing mode, and FIG. 9(*b*) is a sectional view illustrating the water discharge valve device of the flush water tank assembly according to the first embodiment, in a state just after starting the water discharge in the partial flushing mode. FIG. 9(*c*) is a sectional view illustrating the water discharge valve device of the flush water tank assembly according to the first embodiment, in a state during the course of the water discharge in the partial flushing mode, and FIG. 9(*d*) is a sectional view illustrating the water discharge valve device of the flush water tank assembly according to the first embodiment, in a state after completion of the water discharge in the partial flushing mode.

As illustrated in FIGS. 2 to 6, the water discharge valve device 28 comprises an operating lever 42 attached to an outer side of the water storage tank 22, and a rotary shaft 44 having one end attached to the operating lever 42 and extending to the other end located inside the water storage tank 22. The rotary shaft 44 is adapted to be rotated according to operation of the operating lever 42.

In the first embodiment, the operating lever 42 and the rotary shaft 44 will be described based on a manual type operation system in which a user directly turns the operating lever 42 to rotate the rotary shaft 44, as one example. However, the operation system is not limited to such a type but may be an operation system of a type in which drive means such as a motor is provided to rotate the operating lever 42 and rotary shaft 44, and actuation of the drive means is automatically controlled by an instruction signal from an externally installed manual operation button (not illustrated) or presence sensor (not illustrated).

Further, a bead chain pulling-up member 46 is attached to the other end of the rotary shaft 44 integrally with the rotary shaft 44, in such a manner that it is rotated about an axis 44*a* of the rotary shaft 44, along with rotation of the rotary shaft 44.

The bead chain pulling-up member 46 has a first bead chain mounting portion 46*a* which is provided on one side with respect to the axis 44*a* of the rotary shaft 44 and to which an upper end of a first bead chain 48 is attached in such a manner as to be moved up and down according to rotation of the rotary shaft 44, and a second bead chain mounting portion 46*b* which is provided on the other side with respect to the axis 44*a* of the rotary shaft 44 and to which an upper end of a second bead chain 50 is attached in such a manner as to be moved up and down according to rotation of the rotary shaft 44.

On the other hand, lower ends of the first bead chain 48 and the second bead chain 50 are attached, respectively, to a first bead chain mounting portion 52*a* and a second bead chain mounting portion 52*b* of an aftermentioned float member 52.

The bead chain pulling-up member 46 further has a third bead chain mounting portion 46*c* which is provided at a given position offset closer to the operating lever 42 with respect to the second bead chain mounting portion 46*b* and to which an upper end of a third bead chain 54 is attached in such a manner as to be moved up and down according to rotation of the rotary shaft 44, and a lower end of the third bead chain 54 is attached to a third bead chain mounting portion 56*a* of an aftermentioned switching valve 56.

As illustrated in FIGS. 7(*b*) and 8(*b*), when the operating lever 42 is turned in one direction, the bead chain pulling-up member 46 is rotated in a given direction together with the rotary shaft 44, and only the first bead chain 48 is pulled upwardly by the bead chain pulling-up member 46, while allowing the second bead chain 50 and the third bead chain 54 to be in a slackened state, so that an aftermentioned valve element 84 is moved upwardly together with the aftermentioned float member 52 while maintaining the aftermentioned switching valve 56 in its valve open state, to start water discharge in an aftermentioned full flushing mode.

On the other hand, as illustrated in FIGS. 7(*c*) and 9(*c*), when the operating lever 42 is turned in the opposite direction, the second bead chain 50 and the third bead chain 54 are pulled upwardly by the bead chain pulling-up member 46, while allowing the first bead chain 48 to be in a slackened state, so that the aftermentioned float member 52 and valve element 84 are moved upwardly and the aftermentioned switching valve 56 is closed, to start water discharge in an aftermentioned partial flushing mode.

As illustrated in FIGS. 3 and 7(*a*) to 7(*c*), the axis 44*a* of the rotary shaft 44 is set to pass through an axis 58*a* of an aftermentioned water discharge valve unit 58, and a distance between the first and second bead chain mounting portions 46*a*, 46*b* of the bead chain pulling-up member 46 is set to be approximately equal to a distance between the first and second bead chain mounting portions 52*a*, 52*b* of the aftermentioned float member 52.

As illustrated in FIG. 6, the water discharge valve device 28 comprises: a discharge port unit 60 attached to a bottom wall of the water storage tank 22 and configured to form the discharge port 22*a* communicated with the water conduit 6 of the toilet main unit 2; a water discharge valve unit 58 attached to an upper end of the discharge port unit 60; and a casing module 62 detachably attached to the discharge port unit 60 from thereabove.

As illustrated in FIG. 6, the discharge port unit 60 of the water discharge valve device 28 comprises a discharge port-defining member 64 attached to a given position of the bottom wall of the water storage tank 22 and configured to define a discharge port 22*a*.

The discharge port-defining member 64 is fixed to the bottom wall of the water storage tank 22 in such a manner that a lower end of the discharge port-defining member 64 is positioned to penetrate through the bottom wall of the water storage tank 22 and then fastened by a fastening member 68 through a sealing member 66.

The discharge port-defining member 64 has a discharge port upper edge-defining portion 70 which defines an upper edge of the discharge port 22*a*, and a plurality of casing module-mounting retention protrusions 72 which are formed at given diagonal positions on an outer periphery of the discharge port upper edge-defining portion 70 and to which the casing module 62 is detachably attached from thereabove.

The discharge port-defining member 64 further has an upper end opening-defining portion 74 which defines an upper end opening thereof, and a plurality of control casing-mounting retention protrusions 78 which are formed at given diagonal positions on an outer periphery of the upper end opening-defining portion 74 and to which an aftermentioned control casing 76 of the discharge port unit 60 is detachably attached from thereabove.

The discharge port-defining member 64 further has a plurality of ribs 80 extending between the discharge port upper edge-defining portion 70 and the upper end opening-defining portion 74 in an up-down direction and at given intervals along a circumferential direction thereof, so that a plurality of communication ports 82 are formed by the ribs 80, to allow flush water outside the control casing 76 to flow into the discharge port 22*a*.

As illustrated in FIG. 6, the water discharge valve unit 58 of the water discharge valve device 28 comprises: a valve element 84; an overflow pipe 40; a control casing 76; a float member 52; an overflow pipe mounting member 86; and a refill pipe mounting member 88.

The valve element 84 is composed of a sealing member such as sheet packing. As illustrated in FIG. 6, it is fitted in and fixed to a valve element holding portion 40*a* formed in a lower end of the overflow pipe 40 along a circumferential direction thereof and formed in a groove shape concaved in a radially inward direction thereof, to function as a water discharge valve adapted to be moved up and down together with the overflow pipe 40 to thereby open and close the discharge port 22*a*.

The control casing 76 is adapted to function as means to control the up-down movement of the valve element 84, and comprises: a hollow and generally circular cylindrical water compartment 76*b* adapted to store therein flush water, and formed with a small hole 76*a* for draining the stored flush water at a given small flow rate; a generally circular tubular guide portion 76*c* extending upwardly from a central region of a bottom of the water compartment 76*b*; and one or more engagement slots 76*d* each formed at a lower end of the water compartment 76*b* and adapted to be engaged with one of the control casing-mounting retention protrusions 78 of the discharge port-defining member 64 of the discharge port unit 60. Each of the engagement slots 76*d* is formed as a generally L-shaped keyhole-like slot, so that it can be engaged with one of the control casing-mounting retention protrusions 78 through an operation of positioning the engagement slot 76*d* to allow the control casing-mounting retention protrusion 78 to be inserted thereinto from therebelow, and then displacing the engagement slot 76*d* in a horizontal direction.

The float member 52 has: a float portion 52*c* formed in a thin-walled and generally annular shape, and received between an inner peripheral surface of the water compartment 76*b* of the control casing 76 and an outer peripheral surface of the guide portion 76*c*; and a bottom portion 52*d* attached to a lower end of the float portion 52*c*, so that an internal space is defined between an inner surface of the float member 52*c* and the bottom portion 52*d*. In a situation where flush water is stored in the water compartment 76*b* of the control casing 76, the float portion 52*c* and the bottom portion 52*d* are received within the water compartment 76*b* of the control casing 76 in a floating state by an action of buoyancy. Then, along with a lowering in flush water level within the water compartment 76*b* of the control casing 76, they are moved downwardly while being guided by the guide portion 76*c* of the control casing 76.

The float member 52 further has an overflow pipe mounting portion 52*e* which is fixed to an upper end of the float portion 52*c* and formed to extend upwardly by a given distance then extend radially inwardly in an arch-like shape, and to which an upper end of a tubular portion 40*b* of the overflow pipe 40 is attached.

The tubular portion 40*b* of the overflow pipe 40 having a circular tubular shape and extending in an up-down direction is inserted along an inner peripheral surface of the guide portion 76*c* of the control casing 76, and slidably guided in the up-down direction.

Then, an upper end of the tubular portion 40*b* of the overflow pipe 40 is attached to the overflow pipe mounting portion 52*e* of the float member 52, and fixed by the overflow pipe mounting member 86.

The overflow pipe mounting member 86 substantially forms an inlet port 86*a* provided at the upper end of the overflow pipe 40 to allow flush water exceeding a predetermined water level within the water storage tank 22 (maximum water level) to flow into the overflow pipe therethrough.

The inlet port 86*a* at the upper end of the overflow pipe 40 is formed in a horn shape where a diameter of the overflow pipe 40 smoothly increases in an upward and outward direction, which allows flush water exceeding the predetermined water level (maximum water level) within the water storage tank 22 to be more reliably drained out of the water storage tank 22 through the overflow pipe 40.

The refill pipe mounting member 88 has a nozzle portion 88*a* to which the downstream end of the refill pipe 38 is connected. The nozzle portion 88*a* has a lower end opening located just above the inlet port 86*a* of the overflow pipe 40.

As illustrated in FIG. 6, the casing module 62 comprises a casing body 90 formed in a generally rectangular shape in cross-section and opened upwardly. The casing body 90 has a lower end which defines an opening for allowing the discharge port-defining member 64 of the discharge port unit 60 to be inserted thereinto in the up-down direction. The lower end of the casing body 90 has a peripheral edge portion provided with one or more engagement slots 90*a* each disengageably engageable with one of the casing module-mounting retention protrusions 72 of the discharge port-defining member 64 of the discharge port unit 60 by rotating the casing body 90 about the axis thereof (corresponding to the axis 58*a* of the water discharge valve unit 58).

Each of the engagement slots 90*a* forms a generally L-shaped keyhole-like slot, so that it can be engaged with one of the casing module-mounting retention protrusions 72 through an operation of positioning the engagement slot 90*a* to allow the casing module-mounting retention protrusion 72 to be inserted thereinto from therebelow, and then displacing the engagement slot 90*a* in a horizontal direction.

In a state in which the engagement slot 90*a* of the casing body 90 is engaged with the retention protrusion 72 of the discharge port-defining member 64 of the discharge port unit 60, a peripheral wall of the casing body 90 extends upwardly from the bottom wall of the water storage tank 22 while surrounding respective parts of the discharge port unit 60 and the control casing 76, and one side 90*b* of the peripheral wall on the side of the operating lever 42 is formed with a flushing mode-switching opening 90*c* penetrating through the sidewall 90*b*.

Further, a switching valve 56 is attached to the sidewall 90*b* on the side of the operating lever 42 to open and close the opening 90*c*, and a weight member 56*b* is attached to the switching valve 56. When the switching valve 56 is operated to open the opening 90*c*, water discharge is performed in the full flushing mode. On the other hand, when the switching valve 56 is operated to close the opening 90*c*, water discharge is performed in the partial flushing mode.

Further, a flow rate adjusting opening 90*d* is formed in one of the remaining sidewalls 90*b* of the casing body 90 opposed to the sidewall formed with the opening 90*c*, and a flow rate-adjusting slide member 90*e* is slidably attached with respect to the opening 90*d*. The slide member 90*e* is adapted to be slidingly moved in the up-down direction to adjust an effective opening area of the opening 90*d*, thereby making it possible to adjust a flow rate of flush water to be permitted to flow into the casing body 90 in the partial flushing mode, and adjust a flow rate of flush water to be permitted to flow out of the water storage tank 22.

Although the first embodiment has been described based on one example where the slide member 90*e* is slidably attached with respect to the opening 90*d*, and slidingly moved to adjust the effective opening area of the opening 90*d*, the present invention is not limited to such a mechanism. For example, the effective opening area of the opening 90*d* may be adjusted by replaceably attaching one of a plurality of types of detachable members to the sidewall with respect to the opening 90*d*, depending on a desired effective opening area of the opening 90*d*.

Then, as illustrated in FIG. 4, in a state in which the engagement slot 76*d* of the control casing 76 is engaged with the control casing-mounting retention protrusion 78 of the discharge port-defining member 64 of the discharge port unit 60, and the engagement slot 90*a* on the casing body 90 is engaged with the casing module-mounting retention protrusion 72 of the discharge port-defining member 64 of the discharge port unit 60, the plurality of communication ports 82 formed in a peripheral surface of the discharge port-defining member 64 extending from the bottom of the control casing 76 to the discharge port 22*a* serve as communication ports for providing fluid communication between an inside of the casing body 90 and the discharge port 22*a*, and the flushing mode-switching opening 90*c* of the casing body 90 is provided at a height position equal to or lower than an upper end of each of the communication ports 82.

As illustrated in FIGS. 8(*b*) and 9(*b*), the valve element 84 of the water discharge valve unit 58 immediately after start of water discharge in the full flushing mode and the partial flushing mode is moved upwardly to a given uppermost height position where it is in contact with the bottom of the control casing 76. The uppermost height position of the valve element 84 is set to be equal to or higher than a height position of an upper end of the flushing mode-switching opening 90*c* of the casing body 90.

Further, as illustrated in FIG. 4, the small hole 76*a* of the water compartment 76*b* of the control casing 76 is set to a height position equal to or higher than that of the upper end of the flushing mode-switching opening 90*c* of the casing body 90.

As illustrated in FIGS. 4 and 5, the valve element holding portion 40*a* of the overflow pipe 40 has a lower end having the valve element 84*e* fixedly attached thereto. The lower end of the valve element holding portion 40*a* is located above and in opposed relation to the discharge port 22*a*, and formed to have a curved surface 40*c* which is gradually reduced in diameter, in such a manner as to be tapered in a downward direction. That is, in the vertical section illustrated in FIGS. 4 and 5, a contour of the valve element holding portion 40*a* in a region forming the curved surface 40*c* has a generally arc shape extending obliquely downwardly while being concaved inwardly.

Correspondingly, the discharge port 22*a* defined by the discharge port-defining member 64 has an inner peripheral surface which is opposed to the curved surface 40*c* of the lower end of the valve element holding portion 40*a* and formed as a flow passage surface 64*a* gradually reduced in diameter in a downward direction. That is, in the vertical section illustrated in FIGS. 4 and 5, a contour of the discharge port-defining member 64 in a region forming the flow passage surface 64*a* has a generally arc shape extending obliquely downwardly while being convexed inwardly.

Next, operations (functions) of the water discharge valve device and the flush water tank assembly equipped therewith, according to the first embodiment, will be described.

Based on FIGS. 7(*a*) and 7(*b*) and FIGS. 8(*a*) to 8(*d*), the full flushing mode in the two types of flushing modes to be performed by the flush water tank assembly according to the first embodiment will first be described below.

The following description will be made based on one example of each of the full and partial flushing modes is performed under a condition that the flow rate adjusting opening 90*d* of the casing body 90 is closed by the flow rate-adjusting slide member 90*e*.

As illustrated in FIGS. 7(*a*) and 8(*a*), in the water discharge valve device 28 in the state before start of water discharge in the full flushing mode, each of the first and second bead chain mounting portions 46*a*, 46*b* of the bead chain pulling-up member 46 is located in opposed relation to a respective one of the first and second bead chain mounting portions 52*a*, 52*b* of the float member 52 in the up-down direction, and each of the first bead chain 48 and the second bead chain 50 is stretched approximately linearly in the up-down direction.

Further, as illustrated in FIG. 8(*a*), the switching valve 56 is in its valve open state in which it is moved to open the flushing mode-switching opening 90*c* of the casing body 90, by a self-weight of the switching valve 56 with the weight member 56*b*.

In this state, the water level within the water storage tank 22 reaches the maximum water level WL0 which is located above an upper end of the control casing 76 and below the inlet port 86*a* of the overflow pipe 40, so that the inside of the casing body 90 and an inside of the water compartment 76*b* of the control casing 76 are filled with flush water.

Then, as illustrated in FIGS. 7(*b*) and 8(*b*), in the water discharge valve device 28 in the state just after start of water discharge in the full flushing mode, when a user turns the operating lever 42 toward a near side (front side) by a given angle (e.g., 90 degrees), the bead chain pulling-up member 46 is rotated together with the rotary shaft 44 to cause the second bead chain mounting portion 46*b* of the bead chain pulling-up member 46 to be located below the first bead chain mounting portion 46*a* of the bead chain pulling-up member 46, so that a relative distance between the second bead chain mounting portion 46*b* of the bead chain pulling-up member 46 and the second bead chain mounting portion 52*b* of the float member 52 is reduced as compared to the pre-discharge state illustrated in FIG. 7(*a*), and thereby the second bead chain 50 is slackened.

Similarly, as illustrated in FIG. 8(*b*), a relative distance between the third bead chain mounting portion 46*c* of the bead chain pulling-up member 46 and the third bead chain mounting portion 56*b* of the switching valve 56 is reduced as compared to the pre-discharge state illustrated in FIG. 7(*a*), and thereby the third bead chain 55 is also slackened. Thus, the switching valve 56 is maintained in the valve open state in which it opens the opening 90*c* of the casing body 90.

On the other hand, as illustrated in FIG. 7(*b*), the first bead chain mounting portion 46*a* of the bead chain pulling-up member 46 is moved to a height position higher than that in the pre-discharge state illustrated in FIG. 7(*a*), so that only the first bead chain 48 is pulled upwardly by the first bead chain mounting portion 46*a* of the bead chain pulling-up member 46, thereby causing the float member 52 to be moved upwardly. Then, along with the upward movement of the float member 52, the overflow pipe 40 and the valve element 84 are integrally moved upwardly.

As a result, the valve element 84 is set to a pulling-up completion state in which it is in contact with the bottom of the control casing 76, and located at the uppermost height position equal to or higher than the height position of the upper end of the opening 90*c* of the casing body 90. Thus, the discharge port 22*a* is opened to start water discharge, while allowing the switching valve 56 to continue to open the opening 90*c* of the casing body 90.

In this situation, flush water in a region of the water storage tank 22 outside the casing body 90 flows into an inside of the casing body 90 through the opening 90*c* being opened by the switching valve 56, and flush water in the water compartment 76*b* of the control casing 76 flows into the inside of the casing body 90 through the small hole 76*a*. Subsequently, flush water in the inside of the casing body 90 passes through the communication ports 82 of the discharge port unit 60, and is discharged to the water conduit 6 of the toilet main unit 2 through the discharge port 22*a*. Thus, as illustrated in FIG. 8(*b*), due to the water discharge, a water level WL1 within the water storage tank 22 is lowered with respect to the maximum water level WL0. For example, it is located above an upper end of the casing body 90 and below the upper end of the control casing 76.

However, a water level WL1' within the water compartment 76*b* of the control casing 76 is higher than the water level WL1 within the water storage tank 22 and lower than the maximum water level WL0, because a speed of a stream flowing from the outside of the casing body 90 into the discharge port 22*a* through the communication ports 82 is greater than a speed of a stream flowing from the inside of the water compartment 76*b* of the control casing 76 into the inside of the casing body 90 through the small hole 76*a*.

Then, as illustrated in FIG. 8(*c*), in the water discharge valve device 28 in the state during the course of the water discharge in the full flushing mode, the float member 52 is floating based on buoyancy imparted by flush water in the water compartment 76*b* of the control casing 76, and each of the first bead chain 48 and the second bead chain 50 is in a slackened state, because the operating lever 42 is returned to its initial position just after the pulling-up of the first bead chain 48, the float member 52 and the valve element 84 is completed.

Subsequently, after the water level within the water storage tank 22 is gradually lowered over time from the water level WL1 illustrated in FIG. 8(*b*) to reach the upper end of the casing body 90, the water level within the water storage tank 22 and the water level within the casing body 90 are lowered to have the same water level WL2, because the inside of the water storage tank 22 and the inside of the casing body 90 are communicated with each other through the opening 90*c*. When the water level WL2 is gradually lowered over time to become lower than the upper end of the small hole 76*a* of the water compartment 76*b* of the control casing 76, a water level WL2' within the water compartment 76*b* of the control casing 76 starts being lowered at a given speed corresponding to a flow rate of flush water flowing from the inside of the water compartment 76*b* of the control casing 76 through the small hole 76*a*.

Along with the lowering of the water level WL2' (illustrated in FIG. 8(*c*)) within the water compartment 76*b* of the control casing 76, the float member 52 is moved downwardly, and the overflow pipe 40 and the valve element 84 are moved downwardly in interlocking relation to the downward movement of the float member 52, at the same speed as that of the downward movement of the float member 52.

Then, as illustrated in FIG. 8(*d*), in the water discharge valve device 28 in the state after completion of the water discharge in the full flushing mode, when the water level WL2' (illustrated in FIG. 8(*c*)) within the water compartment 76*b* of the control casing 76 is lowered to a water level imparting no buoyancy to the float member 52 (i.e., the water level WL2' becomes approximately zero), and the bottom portion 52*d* of the float portion 52*c* reaches the bottom of the water compartment 76*b*, the valve element 84 closes the discharge port 22*a* to complete the water discharge.

As a result, the water level within the water storage tank 22 and the water level within the casing body 90 are set to the dead water level DWL which is lower than the water level WL2 illustrated in FIG. 8(*c*).

In this state, each of the first bead chain mounting portion 46*a* and the second bead chain mounting portion 46*b* of the bead chain pulling-up member 46 and a corresponding one of the first bead chain mounting portion 52*a* and the second bead chain mounting portion 52*b* of the float member 52 are returned to the state in which they are located in opposed relation to each other in the up-down direction, and both of the first bead chain 48 and the second bead chain 50 are returned to the state in which they are stretched approximately linearly in the up-down direction, as illustrated in FIG. 7(*a*).

Based on FIGS. 7(*a*) and 7(*c*) and FIGS. 9(*a*) to 9(*d*), the partial flushing mode to be performed by the flush water tank assembly according to the first embodiment will secondly be described below.

An operation of the water discharge valve device 28 in the state before start of water discharge in the partial flushing mode as illustrated in FIGS. 7(*a*) and 9(*a*) is the same as that in the full flushing mode as illustrated in FIG. 8(*a*), and its description will be omitted.

Then, as illustrated in FIGS. 7(*c*) and 9(*b*), in the water discharge valve device 28 in the state just after start of water discharge in the partial flushing mode, when a user turns the operating lever 42 toward a far side (rear side) by a given angle (e.g., 90 degrees), the bead chain pulling-up member 46 is rotated together with the rotary shaft 44 to cause the first bead chain mounting portion 46*a* of the bead chain pulling-up member 46 to be located below the second bead chain mounting portion 46*b* of the bead chain pulling-up member 46, so that a relative distance between the first bead chain mounting portion 46*a* of the bead chain pulling-up member 46 and the first bead chain mounting portion 52*a* of the float member 52 is reduced as compared to the pre-discharge state illustrated in FIG. 7(*a*), and thereby the first bead chain 48 is slackened.

On the other hand, as illustrated in FIG. 7(*c*) and FIG. 9(*b*), the second bead chain mounting portion 46*b* of the bead chain pulling-up member 46 is moved to a height position higher than that in the pre-discharge state illustrated in FIG. 7(*a*), so that the second bead chain 50 is pulled upwardly by the second bead chain mounting portion 46*b* of the bead chain pulling-up member 46, thereby causing the float member 52 to be moved upwardly. Then, along with the upward movement of the float member 52, the overflow pipe 40 and the valve element 84 are integrally moved upwardly.

Concurrently, the third bead chain 54 is pulled upwardly by the third bead chain mounting portion 46*c* of the bead chain pulling-up member 46, and the third bead chain mounting portion 56*b* of the switching valve 56 is also pulled upwardly, so that the opening 90*c* of the casing body 90 is closed by the switching valve 56.

As a result, the valve element 84 is set to the pulling-up completion state in which it is in contact with the bottom of the control casing 76, and located at the uppermost height position equal to or higher than the height position of the upper end of the opening 90*c* of the casing body 90. Thus, the discharge port 22*a* is opened to start water discharge, while allowing the switching valve 56 to close the opening 90*c* of the casing body 90.

As illustrated in FIG. 9(*b*), after start of the water discharge, a speed of flush water flowing inside the casing body 90 becomes relatively high as compared to a speed of flush water flowing outside the casing body 90, because flush water in the inside of the casing body 90 is discharged from the discharge port 22*a*, ahead of flush water of the outside of the casing body 90. Thus, a water pressure outside the switching valve 56 becomes higher than a water pressure inside the switching valve 56, which causes a pressure difference in water pressure between the inside and outside of the switching valve 56. Due to the pressure difference, a force F is applied to the switching valve 56 in a direction causing the switching valve 56 to close the opening 90*c* of the casing body 90, so that the switching valve 56 is maintained in its closed state.

Further, as illustrated in FIG. 9(*b*), flush water in a region of the water storage tank 22 outside the casing body 90 flows from only the upper end of the casing body 90 into the inside of the casing body 90 without flowing into the inside of the casing body 90 through the opening 90*c* being closed by the switching valve 56, and flush water in the water compartment 76*b* of the control casing 76 flows into the inside of the casing body 90 through the small hole 76*a*.

Subsequently, flush water in the inside of the casing body 90 passes through the communication ports 82 of the discharge port unit 60, and is discharged to the water conduit 6 of the toilet main unit 2 through the discharge port 22*a*. Thus, as illustrated in FIG. 9(*b*), due to the water discharge, a water level WL3 within the water storage tank 22 is lowered with respect to the maximum water level WL0. For example, it is located above the upper end of the casing body 90 and below the upper end of the control casing 76.

However, a water level WL3' within the water compartment 76*b* of the control casing 76 is higher than the water level WL3 within the water storage tank 22 and lower than the maximum water level WL0, because a speed of a stream flowing from the outside of the casing body 90 into the discharge port 22*a* through the communication ports 82 is greater than a speed of a stream flowing from the inside of the water compartment 76*b* of the control casing 76 into the inside of the casing body 90 through the small hole 76*a*.

Then, as illustrated in FIG. 9(*c*), in the water discharge valve device 28 in the state during the course of the water discharge in the partial flushing mode, the float member 52 is floating based on buoyancy imparted by flush water in the water compartment 76*b* of the control casing 76, and each of the first bead chain 48, the second bead chain 50 and the third bead chain 54 is in a slackened state, because the operating lever 42 is returned to the initial position just after the pulling-up of the second bead chain 50, the third bead chain 54, the float member 52 and the valve element 84 as illustrated in FIG. 9(*b*) is completed.

Even if the third bead chain 54 is in the slackened state, the switching valve 56 is maintained in the closed state, because, due to the aforementioned pressure difference in water pressure between the inside and outside of the switching valve 56, the force F is continuously applied to the switching valve 56 in the direction causing the switching valve 56 to close the opening 90*c* of the casing body 90.

Subsequently, as illustrated in FIG. 9(*c*), when a water level WL4 within the water storage tank 22 is gradually lowered over time from the water level WL3 illustrated in FIG. 9(*b*) to reach a vicinity of the upper end of the casing body 90, flush water in the inside of the casing body 90 starts being rapidly discharged from the discharge port 22*a* through the communication ports 82.

Further, a water level WL4" within the casing body 90 is gradually lowered over time to become lower than the upper end of the small hole 76*a* of the water compartment 76*b* of the control casing 76, a water level WL4' within the water compartment 76*b* of the control casing 76 starts being lowered at a given speed corresponding to a flow rate of flush water flowing from the inside of the water compartment 76*b* of the control casing 76 through the small hole 76*a*.

Along with the lowering of the water level WL4' (illustrated in FIG. 9(*c*)) within the water compartment 76*b* of the control casing 76, the float member 52 is moved downwardly, and the overflow pipe 40 and the valve element 84 are moved downwardly in interlocking relation to the downward movement of the float member 52, at the same speed as that of the downward movement of the float member 52.

As with the state in FIG. 9(*b*), the switching valve 56 is maintained in the closed state, because, due to the pressure difference in water pressure between the inside and outside of the switching valve 56, the force F is continuously applied to the switching valve 56 in the direction causing the switching valve 56 to close the opening 90*c* of the casing body 90.

Then, as illustrated in FIG. 9(*d*), in the water discharge valve device 28 in the state after completion of the water discharge in the partial flushing mode, when a water level WL5' within the water compartment 76*b* of the control casing 76 is lowered to a water level imparting no buoyancy to the float member 52 (i.e., the water level WL5' becomes approximately zero), and the bottom portion 52*d* of the float portion 52*c* reaches the bottom of the water compartment 76*b*, the valve element 84 closes the discharge port 22*a* to complete the water discharge.

In this state, a water level WL5 within the water storage tank 22 is equal to the water level WL4 illustrated in FIG. 9(*c*), and defined as a substantial dead water level DWL' within the water storage tank 22.

On the other hand, a water level WL5" within the casing body 90 is lowered with respect to the water level WL4" illustrated in FIG. 9(*c*), and defined as a substantial dead water level DWL" within the casing body 90.

Each of the first bead chain mounting portion 46*a* and the second bead chain mounting portion 46*b* of the bead chain pulling-up member 46 and a corresponding one of the first bead chain mounting portion 52*a* and the second bead chain mounting portion 52*b* of the float member 52 are returned to the state in which they are located in opposed relation to each other in the up-down direction, and each of the first bead chain 48, the second bead chain 50 and the third bead chain 54 is returned to the state in which it is stretched approximately linearly in the up-down direction, as illustrated in FIG. 7(*a*).

As with the states in FIGS. 9(*b*) and 9(*c*), the switching valve 56 is maintained in the closed state, because, due to the pressure difference in water pressure between the inside and outside of the switching valve 56, the force F is continuously applied to the switching valve 56 in the direction causing the switching valve 56 to close the opening 90*c* of the casing body 90.

As above, in the partial flushing mode, after start of the water discharge, the switching valve 56 is maintained in the state in which it closes the opening 90*c* of the casing body 90. Thus, a flow rate of flush water to be discharged from the discharge port 22*a* is reduced as compared to the full flushing mode by an amount corresponding to a flow rate of flush water in the water storage tank 22 to be discharged from the discharge port 22*a* after passing through the opening 90*c* from the outside of the casing body 90.

In the water discharge valve device 28 and the flush water tank assembly 18 equipped therewith, according to the first embodiment, when flushing of the bowl portion 4 of the flush toilet 1 is performed in the full flushing mode, in response to a user's operation of turning the operating lever 42 toward the near side (front side) by a given angle (e.g., 90 degrees) to rotationally operate the rotary shaft 44 in a given rotational direction, the first bead chain mounting portion 46*a* of the bead chain pulling-up member 46 is moved upwardly as illustrated in FIG. 7(*b*), with respect to the position in the pre-discharge state illustrated in FIG. 7(*a*). Thus, only the first bead chain 48 is pulled upwardly by the first bead chain mounting portion 46*a* of the bead chain pulling-up member 46, while allowing the second bead chain 50 and the third bead chain 54 to be slackened. Thus, the float member 52 is moved upwardly, and the overflow pipe 40 and the valve element 84 are integrally moved upwardly along with the upward movement of the float member 52, so that the discharge port 22*a* is opened while maintaining the opening 90*c* of the casing body 90 in the open state, whereby water discharge in the full flushing mode is performed.

On the other hand, when flushing of the bowl portion 4 of the flush toilet 1 is performed in the partial flushing mode, in response to a user's operation of turning the operating lever 42 toward the far side (rear side) by a given angle (e.g., 90 degrees) to rotationally operate the rotary shaft 44 in a rotational direction opposite to the given rotational direction, each of the second bead chain mounting portion 46*a* and the third bead chain mounting portion 46*c* of the bead chain pulling-up member 46 is moved upwardly as illustrated in FIG. 7(*c*), with respect to the position in the pre-discharge state illustrated in FIG. 7(*a*). Thus, each of the second bead chain 50 and the third bead chain 54 is pulled upwardly by a corresponding one of the second bead chain mounting portion 46*b* and the third bead chain mounting portion 46*c* of the bead chain pulling-up member 46, while allowing the first bead chain 48 to be slackened. Thus, the float member 52 is moved upwardly, and the overflow pipe 40 and the valve element 84 are integrally moved upwardly along with the upward movement of the float member 52, so that the discharge port 22*a* is opened while maintaining the opening 90*c* of the casing body 90 in the closed state, whereby water discharge in the partial flushing mode is performed.

In the first embodiment, the axis 44*a* of the rotary shaft 44 is set to pass across the axis 58*a* of the water discharge valve unit 58, and the distance between the first and second bead chain mounting portions 46*a*, 46*b* of the bead chain pulling-up member 46 is set to be approximately equal to the distance between the first and second bead chain mounting portions 52*a*, 52*b* of the float member 52, so that respective strokes of the up-down movements of the assembly of the valve element 84 and the overflow pipe 40 between the full and partial flushing modes become equal to each other.

Thus, for example, even if a misalignment in relative position between the rotary shaft 44 and the water discharge valve unit 58 occurs due to manufacturing errors of the outer tank 20 and the water storage tank 22 made of porcelain, it becomes possible to suppress a difference between respective strokes of the up-down movements of the assembly of the valve element 84 and the overflow pipe 40 between the full and partial flushing modes.

In addition, during the up-down movement of the assembly of the valve element 84 and the overflow pipe 40, it becomes possible to reduce a rotation about the axis 58*a* of the assembly of the valve element 84 and the overflow pipe 40, and suppress an in-plane displacement of a position where the valve element 84 is seated on the discharge port 22*a*, in each discharge water stopping operation, thereby preventing an undesirable situation where a distortion occurs in a seating surface of the valve element 84 composed of a sealing member such as sheet packing, resulting in failing to adequately stop the discharge water.

In the water discharge valve device 28 and the flush water tank assembly 18 equipped therewith, according to the first embodiment, when flushing of the bowl portion 4 of the flush toilet 1 is performed in the full flushing mode, the float member 52, the overflow pipe 40 and the valve element 84 are integrally moved upwardly to open the discharge port 22*a*, while allowing the switching valve 56 to continue to open the opening 90*c* of the casing body 90. Thus, flush water in a region of the water storage tank 22 outside of the casing body 90 flows into the inside of the casing body 90 through the opening 90*c* of the casing body 90, and then flows toward the discharge port 22*a* through the communication ports 82 formed in the peripheral surface of the discharge port-defining member 64 of the discharge port unit 60 extending from the control casing 76 of the water discharge valve unit 58 to the discharge port 22*a*.

In the first embodiment, the opening 90*c* of the casing body 90 is provided at a height position equal to or lower than that of the upper end of each of the communication ports 82, so that, when flush water in the region of the water storage tank 22 outside of the casing body 90 flows into the inside of the casing body 90 through the opening 90*c* of the casing body 90, a force of the flow of flush water is effectively weakened as compared to the case where the opening 90*c* of the casing body 90 is provided at a height position higher than that of the upper end of each of the communication ports 82.

Thus, the flow force of flush water is weakened in the above manner, so that a force which pushes down the valve element 84 of the water discharge valve unit 58 in the open state toward a closing direction can be weakened, thereby preventing premature closing of the valve element 84 of the water discharge valve unit 58 due to a flow of flush water. This makes it possible to stabilize the dead water level DWL of flush water to be left in the water storage tank 22 after the valve element 58 of the water discharge valve unit 58 is set in the valve closed state, and perform stable flushing of the bowl portion 4 of the flush toilet 1.

In the water discharge valve device 28 and the flush water tank assembly 18 equipped therewith, according to the first embodiment, the given uppermost height position of the valve element 84 of the water discharge valve device 28 after being moved upwardly is set to be equal to or higher than the height position of the upper end of the opening 90*c* of the casing body 90. Thus, when flushing of the bowl portion 4 of the flush toilet 1 is performed in the full flushing mode, it becomes possible to effectively prevent the undesirable situation where, when the float member 52, the overflow pipe 40 and the valve element 84 are integrally moved upwardly to open the discharge port 22*a*, while allowing the switching valve 56 to continue to open the opening 90*c* of the casing body 90, the valve element 84 of the water discharge valve unit 58 in the open state is pushed down in a closing direction by flush water flowing from a region of the water storage tank 22 outside of the casing body 90 into the inside of the casing body 90 through the opening 90*c* of the casing body 90, thereby more effectively preventing the premature closing of the valve element 84 of the water discharge valve unit 58 due to a flow of flush water.

In the water discharge valve device 28 and the flush water tank assembly 18 equipped therewith, according to the first embodiment, the small hole 76*a* of the water compartment 76*b* of the control casing 76 of the water discharge valve unit 58 is provided at a height position equal to or higher than that of the upper end of the opening 90*c* of the casing body 90. Thus, when flushing of the bowl portion 4 of the flush toilet 1 is performed in the full flushing mode, it becomes possible to prevent an undesirable situation where, when the float member 52, the overflow pipe 40 and the valve element 84 are integrally moved upwardly to open the discharge port 22*a*, while allowing the switching valve 56 to continue to open the opening 90*c* of the casing body 90, flush water drained from the small hole 76*a* of the water compartment 76*b* of the control casing 76 is not affected by flush water flowing from a region of the water storage tank 22 outside of the casing body 90 into the inside of the casing body 90 through the opening 90*c* of the casing body 90. Thus, the water level within the water compartment 76*b* of the control casing 76 can be stably lowered, thereby ensuring a stable downward movement of the float member 52 and the overflow pipe 40 attached thereto downwardly and a stable downward movement of the valve element 84 of the water discharge valve unit 58.

In the water discharge valve device 28 and the flush water tank assembly 18 equipped therewith, according to the first embodiment, the lower end of the valve element holding portion 40*a* of the overflow pipe 40 having the valve element 84*e* of the water discharge valve unit 58 fixedly attached thereto is located above and in opposed relation to the discharge port 22*a*, and formed to have the curved surface 40*c* which is gradually reduced in diameter, in such a manner as to be tapered in a downward direction, so that, when the valve element 84 of the water discharge valve unit 58 is opened, and flush water in the water storage tank 22 passes around the lower end of the valve element holding portion 40*a*, the flush water is discharged from the discharge port 22*a* while smoothly flowing along the curved surface 40*c* of the lower end of the valve element holding portion 40*a*. Thus, it becomes possible to reduce a pressure loss of flush water passing around the lower end of the valve element holding portion 40*a*, and enhance a capability of flushing the bowl portion 4 of the flush toilet 1.

In the water discharge valve device 28 and the flush water tank assembly 18 equipped therewith, according to the first embodiment, an inner peripheral surface of the discharge port 22*a* opposed to the lower end of the valve element holding portion 40*a* of the overflow pipe 40 having the valve element 84*e* of the water discharge valve unit 58 fixedly attached thereto and formed as the flow passage surface 64*a* gradually reduced in diameter in a downward direction, so that, when the valve element 84 of the water discharge valve unit 58 is opened to discharge flush water in the water storage tank 22 to the water conduit 6 of the toilet main unit 2 through the discharge port 22*a*, the flush water is discharged while smoothly flowing along the inner peripheral surface of the discharger port 22*a* formed as the flow passage surface 64*a* gradually reduced in diameter in a downward direction. Thus, it becomes possible to reduce a pressure loss of flush water passing through the discharge port 22*a*, and enhance the capability of flushing the bowl portion 4 of the flush toilet 1.

Next, based on FIGS. 10(*a*) to 10(*c*), a water discharge valve device and a flush water tank assembly equipped therewith, according to a second embodiment of the present invention, will be described below.

Figure 10A:
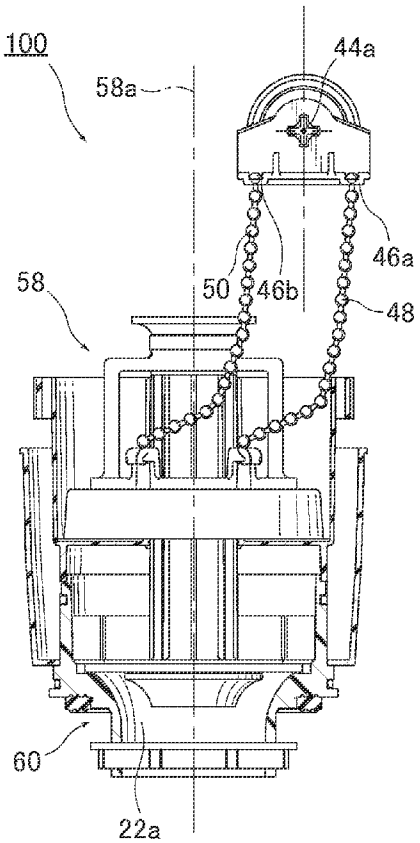
FIG. 10(*a*) is a sectional view illustrating a water discharge valve device of a flush water tank assembly according to a second embodiment of the present invention, in a valve closed state.
Figure 10B:
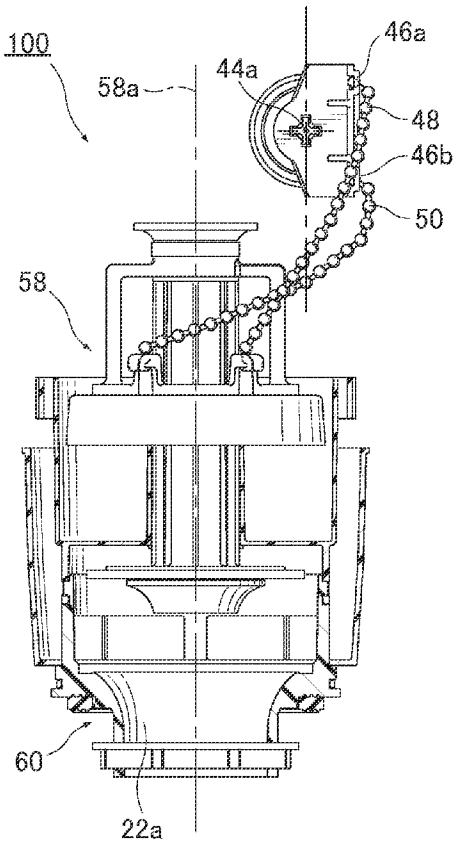
Figure 10C:
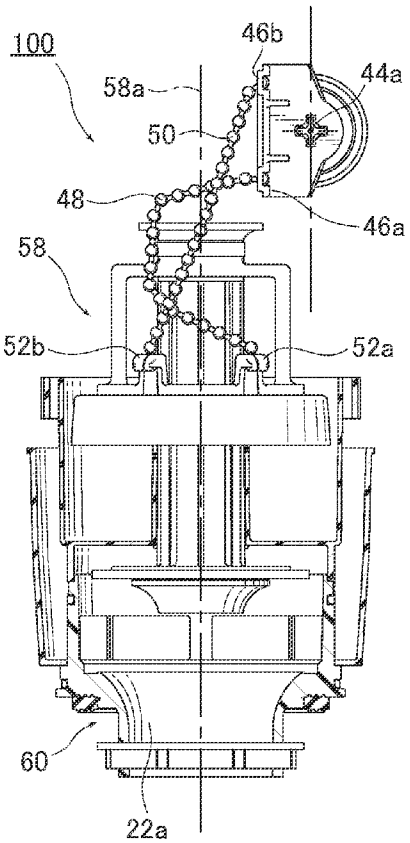
Figure 11A:
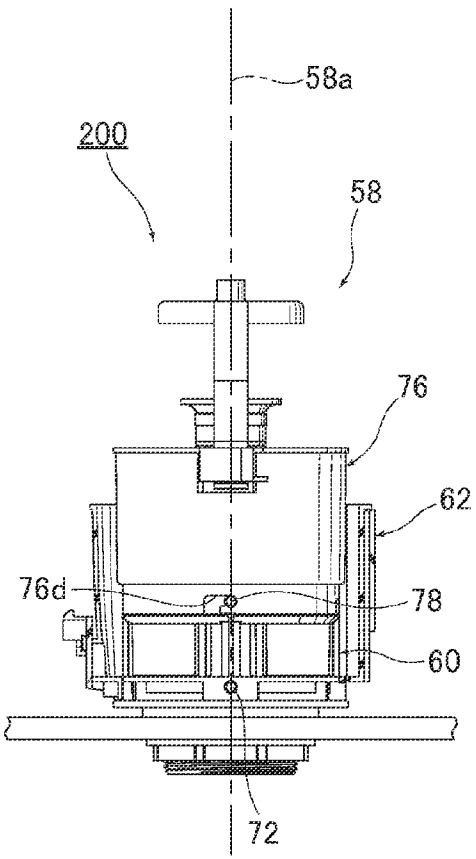
FIGS. 11(*a*) to 1(*c*) are process diagrams illustrating a process of reassembling a water discharge valve device according to a third embodiment of the present invention from a state in which a casing module is installed therein to a state in which the casing module is removed therefrom.
Figure 11B:
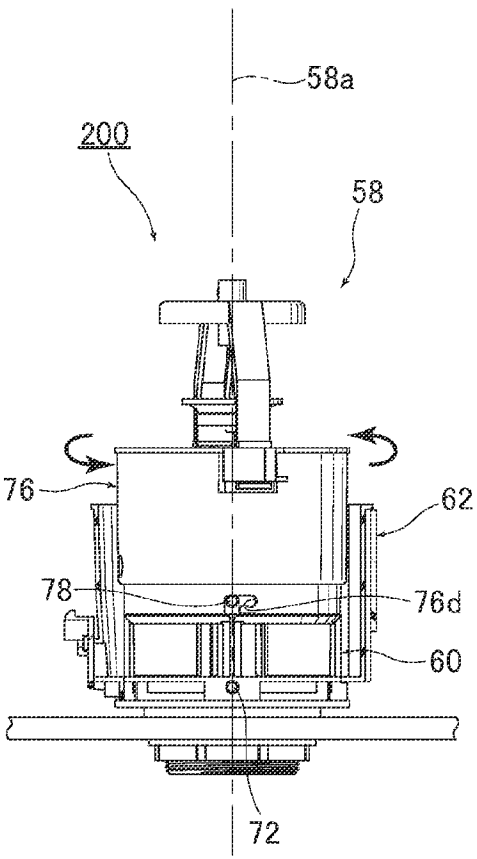
Figure 11C:
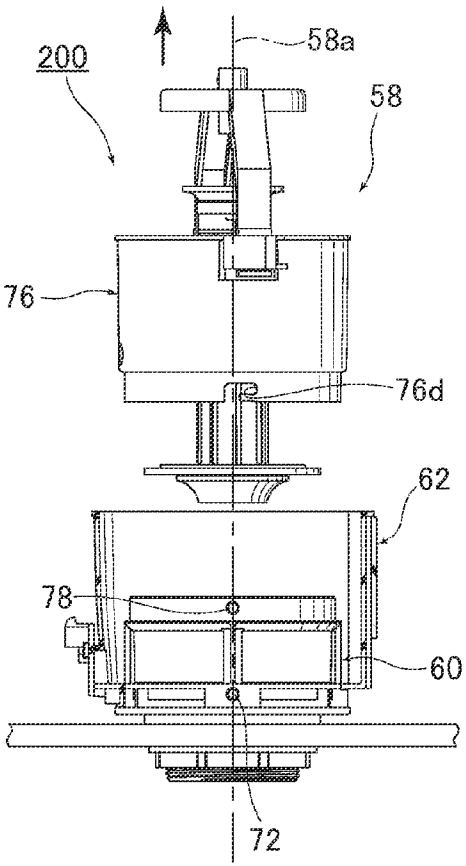
Figure 11F:
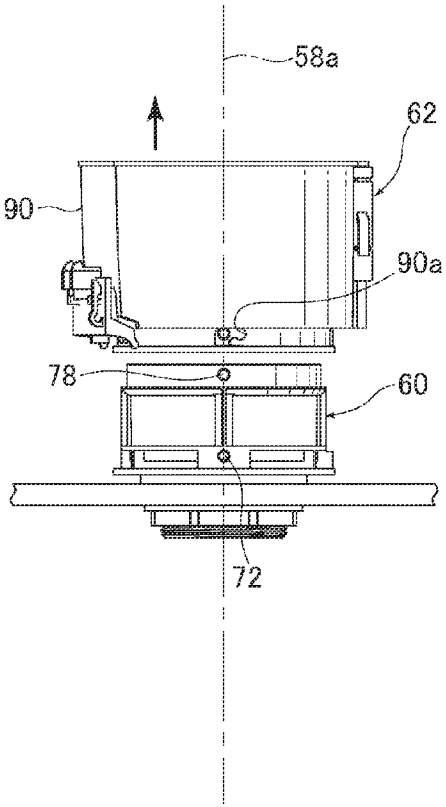
Figure 11E:
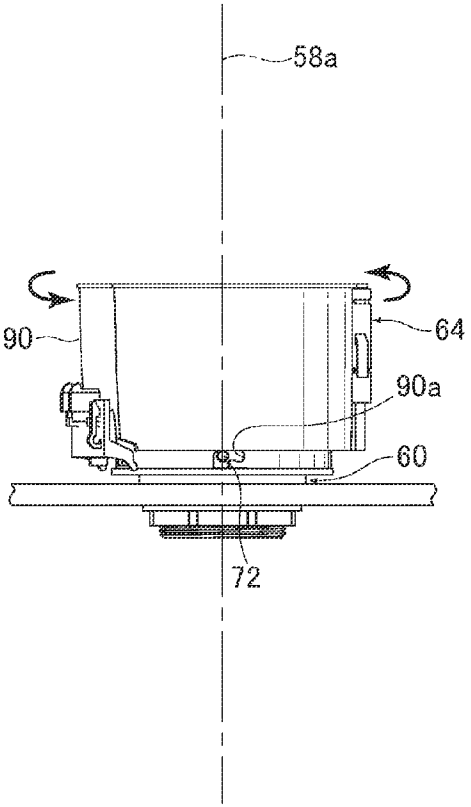
Figure 11D:
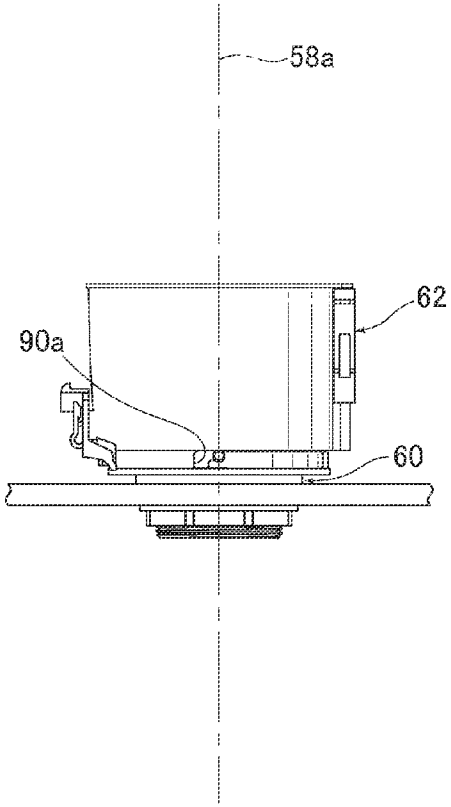
Figure 11I:
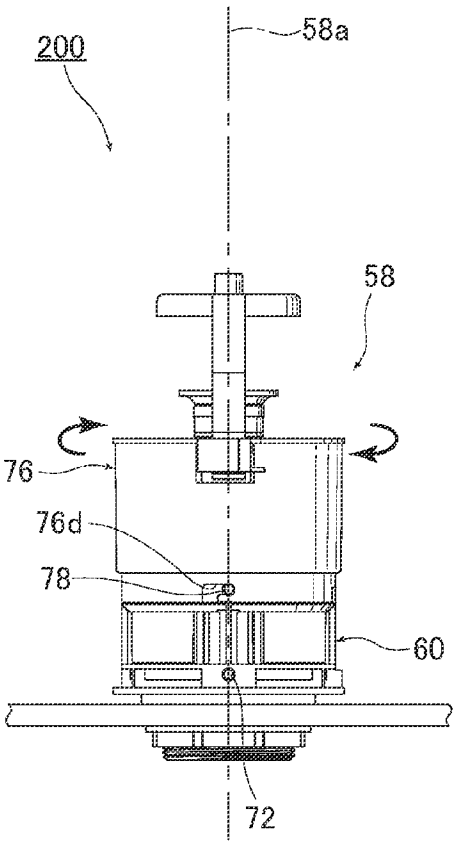
Figure 11H:
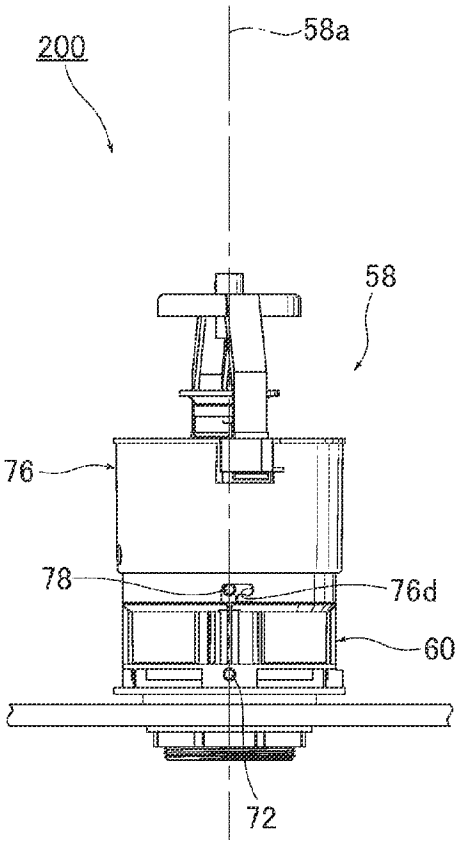
Figure 11G:
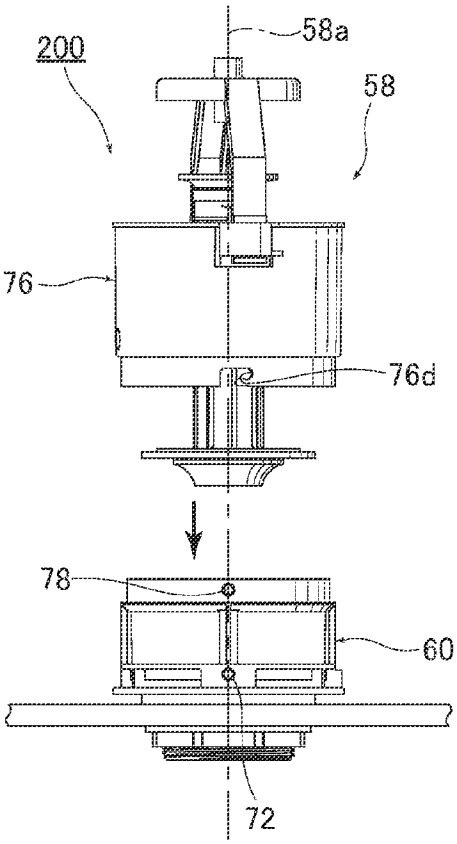

FIG. 10(*a*) is a sectional view illustrating the water discharge valve device of the flush water tank assembly according to the second embodiment, in a valve closed state. FIG. 10(*b*) is a sectional view illustrating the water discharge valve device of the flush water tank assembly according to the second embodiment, in a state at a timing of starting water discharge in the full flushing mode, and FIG. 10(*c*) is a sectional view illustrating the water discharge valve device of the flush water tank assembly according to the second embodiment, in a state at a timing of starting water discharge in the partial flushing mode.

In the following description about the water discharge valve device according to the second embodiment illustrated in FIGS. 10(*a*) to 10(*c*), the same element or component as that in the water discharge valve device according to the first embodiment illustrated in FIGS. 7(*a*) to 7(*c*) is assigned with the same reference numeral or code, and its description will be omitted.

As illustrated in FIGS. 10(*a*) to 10(*c*), the water discharge valve device 100 according to the second embodiment is the same as the water discharge valve device 28 according to the first embodiment illustrated in FIGS. 7(*a*) to 7(*c*), in terms of a configuration that a distance between a first bead chain mounting portion 46*a* and a second bead chain mounting portion 46*b* of a bead chain pulling-up member 46 is set to be approximately equal to a distance between a first bead chain mounting portion 52*a* and a second bead chain mounting portion 52*b* of a float member 52.

However, the water discharge valve device 100 according to the second embodiment is different from the water discharge valve device 28 according to the first embodiment illustrated in FIGS. 7(*a*) to 7(*c*), in that an axis 44*a* of a rotary shaft 44 of an operating lever 42 of the water discharge valve device 100 is set to be offset with respect to an axis 58*a* of a water discharge valve unit 58 without passing across the axis 58*a*, whereas the axis 44*a* of the rotary shaft 44 of the operating lever 42 of the water discharge valve device 28 according to the first embodiment illustrated in FIGS. 7(*a*) to 7(*c*) is set to pass across the axis 58*a* of the water discharge valve unit 58.

In the water discharge valve device 100 according to the second embodiment, when flushing of a bowl portion 4 of a flush toilet 1 is performed in the full flushing mode, in response to a user's operation of turning the operating lever 42 toward a near side (front side) by a given angle (e.g., 90 degrees) to rotationally operate the rotary shaft 44 in a given rotational direction, the first bead chain mounting portion 46*a* of the bead chain pulling-up member 46 is moved upwardly as illustrated in FIG. 10(*b*), with respect to a position in a pre-discharge state illustrated in FIG. 10(*a*). Thus, only a first bead chain 48 is pulled upwardly by the first bead chain mounting portion 46*a* of the bead chain pulling-up member 46, while allowing a second bead chain 50 and a third bead chain 54 to be slackened. Thus, the float member 52 is moved upwardly, and an overflow pipe 40 and a valve element 84 are integrally moved upwardly along with the upward movement of the float member 52, so that a discharge port 22*a* is opened while maintaining an opening 90*c* of a casing body 90 in its open state, whereby water discharge in the full flushing mode is performed.

On the other hand, when flushing of the bowl portion 4 of the flush toilet 1 is performed in the partial flushing mode, in response to a user's operation of turning the operating lever 42 toward a far side (rear side) by a given angle (e.g., 90 degrees) to rotationally operate the rotary shaft 44 in a rotational direction opposite to the given rotational direction, each of the second bead chain mounting portion 46*a* and a third bead chain mounting portion 46*c* of the bead chain pulling-up member 46 is moved upwardly as illustrated in FIG. 10(*c*), with respect to the position in the pre-discharge state illustrated in FIG. 10(*a*). Thus, each of the second bead chain 50 and the third bead chain 54 is pulled upwardly by a corresponding one of the second bead chain mounting portion 46*b* and the third bead chain mounting portion 46*c* of the bead chain pulling-up member 46, while allowing the first bead chain 48 to be slackened. Thus, the float member 52 is moved upwardly, and the overflow pipe 40 and the valve element 84 are integrally moved upwardly along with the upward movement of the float member 52, so that the discharge port 22*a* is opened while maintaining the opening 90*c* of the casing body 90 in its closed state, whereby water discharge in the partial flushing mode is performed.

In the second embodiment, respective strokes of up-down movements of the assembly of the valve element 84 and the overflow pipe 40 between the full and partial flushing modes become equal to each other, even though the axis 44*a* of the rotary shaft 44 is set to be offset with respect to the axis 58*a* of the water discharge valve unit 58 without passing across the axis 58*a*.

Thus, for example, even if a misalignment in relative position between the rotary shaft 44 and the water discharge valve unit 58 occurs due to manufacturing errors of an outer tank 20 and the water storage tank 22 made of porcelain, it becomes possible to suppress a difference between respective strokes of the up-down movements of the assembly of the valve element 84 and the overflow pipe 40 between the full and partial flushing modes.

In addition, during the up-down movement of the assembly of the valve element 84 and the overflow pipe 40, it becomes possible to reduce a rotation about the axis 58*a* of the assembly of the valve element 84 and the overflow pipe 40, and suppress an in-plane displacement of a position where the valve element 84 is seated on the discharge port 22*a*, in each discharge water stopping operation, thereby preventing an undesirable situation where a distortion occurs in a seating surface of the valve element 84 composed of a sealing member such as sheet packing, resulting in failing to adequately stop the discharge water.

Next, based on FIGS. 11(*a*) to 1(*d*), a water discharge valve device and a flush water tank assembly equipped therewith, according to a third embodiment of the present invention, will be described below.

FIGS. 11(*a*) to 11(*i*) are process diagrams illustrating a process of reassembling the water discharge valve device according to the third embodiment from a state in which a casing module is installed therein to the state in which the casing module is removed therefrom. In FIGS. 11(*a*) to 11(*i*), the same element or component as that in the water discharge valve device according to the first embodiment is assigned with the same reference numeral or code, and its description will be omitted.

The water discharge valve device 200 according to the third embodiment is different from the water discharge valve device 28 according to the first embodiment, in terms of a configuration that a casing module 62 detachably attached to a discharge port unit 60 is detached therefrom, as illustrated, particularly, in FIG. 11(*i*).

Therefore, with reference to FIGS. 11(*a*) to 11(*f*), a process of reassembling the water discharge valve device 200 from a state in which the casing module 62 is installed therein to a state in which the casing module 62 is removed therefrom will be described below.

As illustrated in FIG. 11(*a*), in the state in which the casing module 62 is attached to the water discharge valve device 200 according to the third embodiment, an engagement slot 90*a* of the casing body 90 is engaged with a casing module-mounting retention protrusion 72 of a discharge port-defining member 64 of a discharge port unit 60, and an engagement slot 76*d* of a control casing 76 of a water discharge valve unit 58 is engaged with a control casing-mounting retention protrusion 78 of the discharge port-defining member 64 of the discharge port unit 60.

Then, as illustrated in FIG. 11(*b*), when the casing module is removed from the water discharge valve unit 200 according to the third embodiment, in the state in which the casing module 62 is attached to the discharge port unit 60, the control casing 76 of the water discharge valve unit 58 is rotated about an axis 58*a* of the water discharge valve unit 58 in a direction causing a horizontal engagement between the engagement slot 76*d* of the control casing 76 and the control casing-mounting retention protrusion 78 of the discharge port-defining member 64 to be released. Thus, the horizontal engagement between the engagement slot 76*d* of the control casing 76 and the control casing-mounting retention protrusion 78 of the discharge port-defining member 64 is released.

Then, as illustrated in FIG. 11(*c*), the entire water discharge valve unit 58 in a state after completion of release of the horizontal engagement between the engagement slot 76*d* of the control casing 76 and the control casing-mounting retention protrusion 78 of the discharge port-defining member 64 is pulled upwardly along the axis 58*a* thereof. Thus, the engagement slot 76*d* of the control casing 76 of the water discharge valve unit 58 is completely separated from the control casing-mounting retention protrusion 78 of the discharge port-defining member 64.

In this regard, in order to prevent a bead chain pulling-up member 46 located just above the control casing 76 of the water discharge valve unit 58 from becoming an obstacle during the operation of pulling the entire water discharge valve unit 58 upwardly, the bead chain pulling-up member 46 is detached from a rotary shaft 44 before separating the water discharge valve unit 58 from the water discharge valve device 200.

Then, as illustrated in FIG. 11(*d*), when the entire water discharge valve unit 58 is detached from the discharge port unit 60 once, a state is achieved in which only the casing module 62 is attached to the discharge port unit 60.

Then, as illustrated in FIG. 11(*e*), the casing body 90 of the casing module 62 is rotated about the axis 58*a* of the water discharge valve unit 58 in a direction causing a horizontal engagement between the engagement slot 90*a* of the casing body 90 and the casing module-mounting retention protrusion 72 of the discharge port-defining member 64 to be released. Thus, the horizontal engagement between the engagement slot 90*a* of the casing body 90 and the casing module-mounting retention protrusion 72 of the discharge port-defining member 64 is released.

Then, as illustrated in FIG. 11(*f*), the casing body 90 in a state after completion of release of the horizontal engagement between the engagement slot 90*a* of the casing body 90 and the casing module-mounting retention protrusion 72 of the discharge port-defining member 64 is pulled upwardly along the axis 58*a* of the water discharge valve unit 58. Thus, the engagement slot 90*a* of the casing body 90 is completely separated from the casing module-mounting retention protrusion 72 of the discharge port-defining member 64.

Then, as illustrated in FIG. 11(*g*), in the state in which the casing module 62 is detached from the discharge port unit 60 from thereabove, the water discharge valve unit 58 previously detached once in FIG. 11(*c*) is re-attached to the discharge port unit 60 from thereabove to achieve a state as illustrated in FIG. 11(*h*).

In this state, as illustrated in FIG. 11(*h*), although the control casing-mounting retention protrusion 78 of the discharge port-defining member 64 is inserted into the engagement slot 76*d* of the control casing 76 from therebelow, the engagement slot 76*d* of the control casing 76 is not fully engaged with the control casing-mounting retention protrusion 78 of the discharge port-defining member 64.

Then, as illustrated in FIG. 11(*i*), the control casing 76 of the water discharge valve unit 58 is rotated about the axis 58*a* of the water discharge valve unit 58 in a direction causing the horizontal engagement between the engagement slot 76*d* of the control casing 76 and the control casing-mounting retention protrusion 78 of the discharge port-defining member 64 to be established. Thus, the control casing-mounting retention protrusion 78 of the discharge port-defining member 64 is fitted into the engagement slot 76*d* of the control casing 76 to achieve a full engagement therebetween. Thus, the water discharge valve device 200 is set in a state in which the casing module 62 is removed therefrom.

When the casing module 62 is re-installed in the water discharge valve device 200, a reverse process from the series of steps from FIGS. 11(*a*) to 11(*i*) is performed.

In the water discharge valve device 200 according to the third embodiment, the casing module 62 is detachably attached to the discharge port unit 60 from thereabove. Thus, even after a water storage tank 22 is installed onto a toilet main unit 2, the casing module 62 can be readily attached and detached with respect to the discharge port unit 60 from thereabove. More specifically, in a flush water tank assembly of a type capable of allowing a user to select either one of the full flushing mode and the partial flushing mode for flushing a bowl portion of a flush toilet 1, a water discharge valve device is used under a condition that the casing module 62 is attached to the discharge port unit 60, as in the water discharge valve device 28 according to the first embodiment. On the other hand, in a flush water tank assembly of a type capable of limitedly performing only the full flushing mode for flushing the bowl portion of the flush toilet 1, a water discharge valve device is used under a condition that the casing module 62 is detached from the discharge port unit 60, as in the water discharge valve device 200 according to the third embodiment. In this way, the water discharge valve device can be readily reassembled in a suitably state for each flushing type of the flush water tank assembly. That is, based on a simple structure which allows the casing module 62 to be attached and detached with respect to the discharge port unit 60, it becomes possible to readily add the partial flushing mode to the full flushing mode, and readily omit the partial flushing mode to limit a flushing mode to only the full flushing mode. Thus, components associated with the discharge port unit 60 and the water discharge valve unit 58 other than the casing module 62 of the water discharge valve device 200 can be standardized or commonized, irrespective of the flushing type of the flush toilet 1.

The water discharge valve device 200 according to the third embodiment is configured to, in the state in which the casing module 62 is attached to the discharge port unit 60, in response to operating the switching valve 56 to open an opening 90*c* of the casing body 90, increase an amount of flush water flowing into an inside of the casing body 90 to allow an amount of flush water suppliable to a water conduit 6 of the toilet main unit 2 when a valve element 84 of the water discharge valve unit 58 opens a discharge port 22*a*, to be set to a given value for the full flushing mode, and, in response to operating the switching valve 56 to close the opening 90*c* of the casing body 90, reduce the amount of flush water flowing into the inside of the casing body 90 to allow the amount of flush water suppliable to the water conduit 6 of the toilet main unit 2 when the valve element 84 of the water discharge valve unit 58 opens the discharge port 22*a*, to be set to a given value for the partial flushing mode.

The water discharge valve device 200 is also configured to, in the state in which the casing module 62 is detached from the discharge port unit 60, allow the amount of flush water suppliable to the water conduit 6 of the toilet main unit 2 when the valve element 84 of the water discharge valve unit 58 opens the discharge port 22*a*, to be set to a given value for only the full flushing mode.

In the water discharge valve device 200 according to the third embodiment, when flush water in a water compartment 76*b* of the control casing 76 of the water discharge valve unit 58 is drained through a small hole 76*a* to cause a lowering in water level within a water compartment 76*b*, a float member 52 is moved downwardly, and the valve element 84 of the water discharge valve unit 58 is moved downwardly in interlocking relation to the downward movement of the float member 52 to close the discharge port 22*a*, so that the water discharge valve unit 58 can be effectively operated, irrespective of whether or not the casing module 62 is attached to the discharge port unit 58. Thus, components associated with the discharge port unit 60 and the water discharge valve unit 58 other than the casing module 62 of the water discharge valve device 200 can be standardized or commonized, irrespective of the flushing type of the flush toilet 1.

When the water discharge valve device 200 according to the third embodiment is used in a flush water tank assembly of a type capable of allowing a user to select either one of the full flushing mode and the partial flushing mode for flushing a toilet bowl, it is used under a condition that the engagement slot 90*a* of the casing body 90 is attached to the casing module-mounting retention protrusion 72 of the discharge port-defining member 64 of the discharge port unit 60 from thereabove, and then the engagement slot 76*d* of the control casing 76 is attached to the control casing-mounting retention protrusion 78 of the discharge port-defining member 64. On the other hand, when the water discharge valve device 200 is used in a flush water tank assembly of a type capable of limitedly performing only the full flushing mode for flushing a toilet bowl, it is used under a condition that, after the engagement slot 90*a* of the casing body 90 is detached from the casing module-mounting retention protrusion 72 of the discharge port-defining member 64 of the discharge port unit 60 from thereabove, the engagement slot 76*d* of the control casing 76 is attached to the control casing-mounting retention protrusion 78 of the discharge port-defining member 64. In this way, the water discharge valve device can be readily reassembled in a suitably state for each flushing type of the flush water tank assembly.

In the water discharge valve device 200 according to the third embodiment, when the casing module 62 is attached and detached with respect to the discharge port unit 60, the engagement slot 90*a* of the casing body 90 formed in a discharge port-side end thereof is engaged or disengaged with respect to the casing module-mounting retention protrusion 72 of the discharge port-defining member 64 of the discharge port unit 60 by rotating the casing body 90 about the axis 58*a* of the water discharge valve unit 58. This makes it possible to prevent an undesirable situation where, when the water level within the water storage tank 22 is raised or lowered, the casing module 62 is moved upwardly or downwardly along with the rising or lowering of the water level, and unexpectedly disengaged from the discharge port unit 60.

Next, based on FIGS. 12 to 29(*d*), a water discharge valve device and a flush water tank assembly equipped therewith, according to a fourth embodiment of the present invention, will be described.

Figure 12:
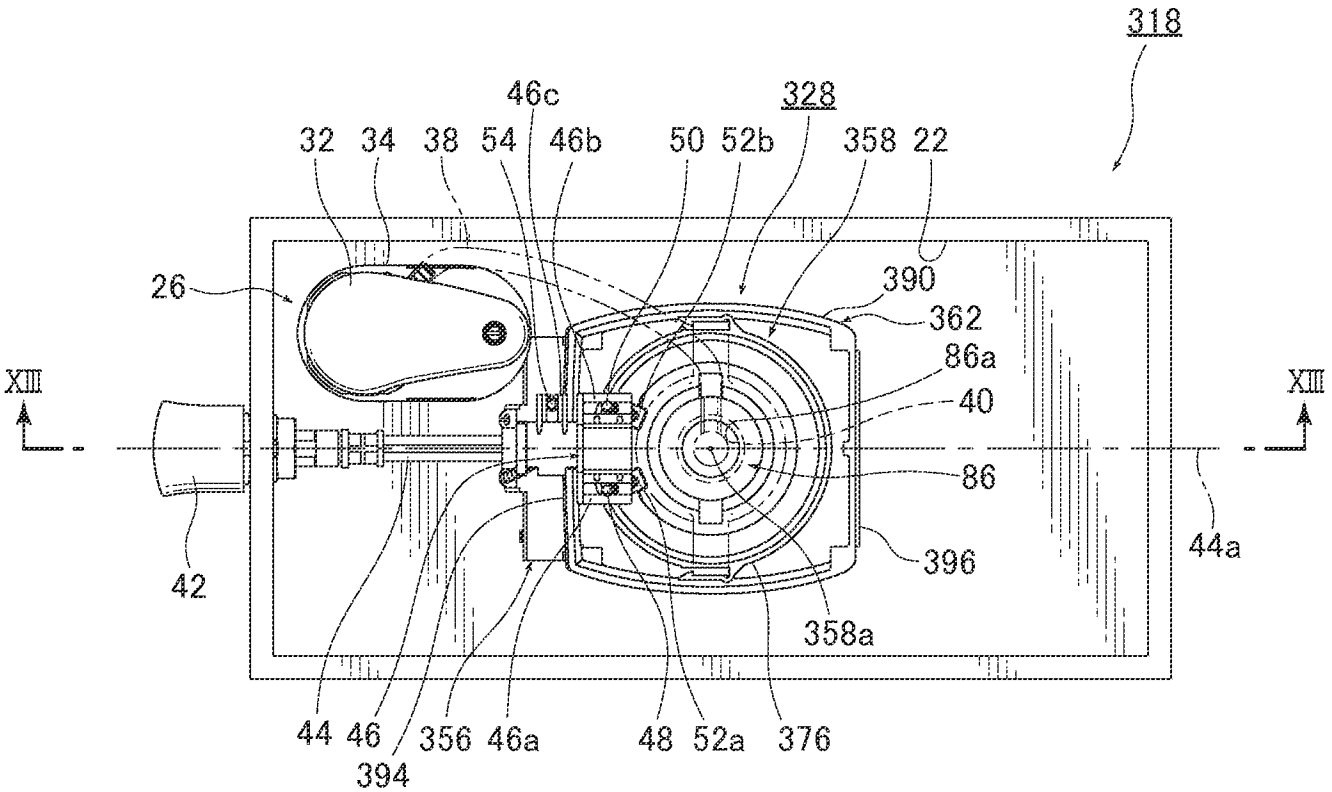
FIG. 12 is a top plan view illustrating a structure inside a water storage tank in a flush water tank assembly according to a fourth embodiment of the present invention.
Figure 13:
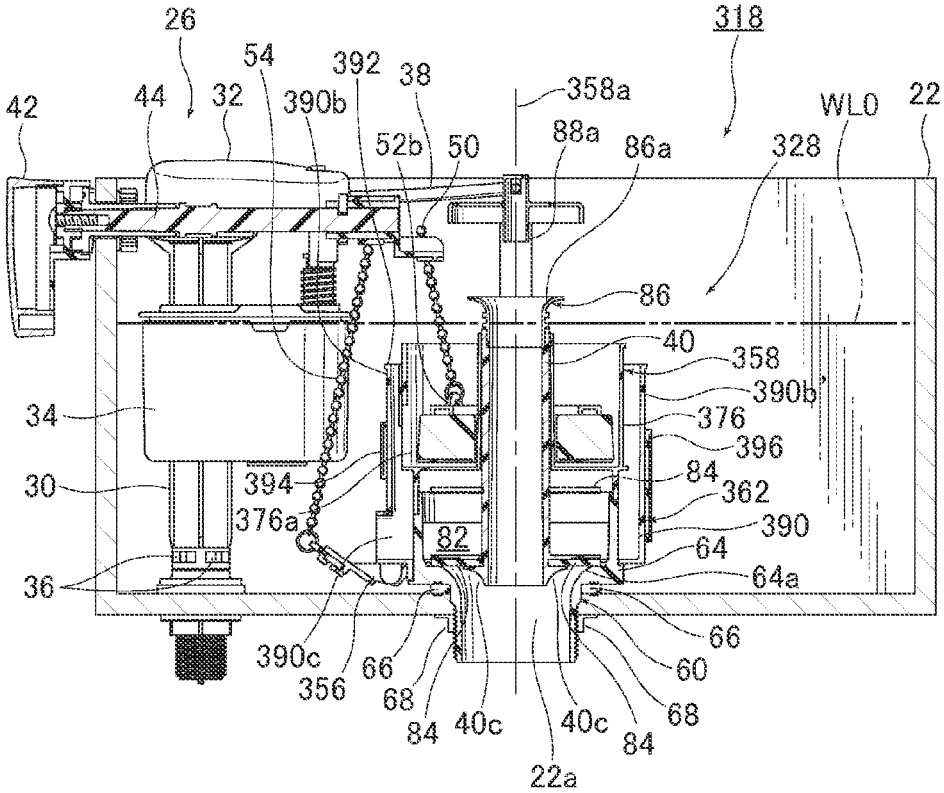
FIG. 13 is a sectional view taken along the line XIII-XIII in FIG. 12.
Figure 14:
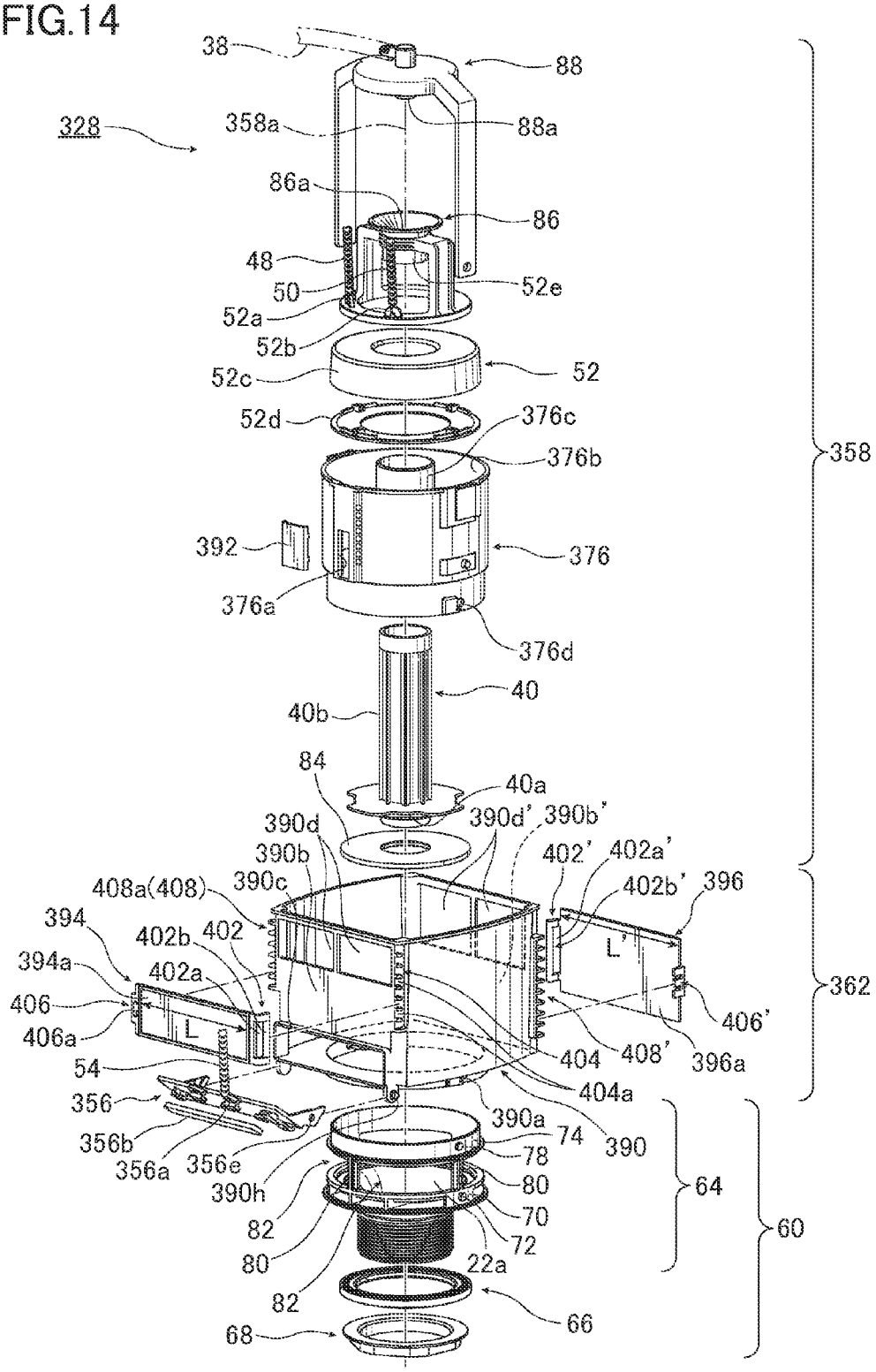
FIG. 14 is an exploded perspective view of a water discharge valve device of the flush water tank assembly according to the fourth embodiment.

FIG. 12 is a top plan view illustrating a structure inside a water storage tank of the flush water tank assembly according to the fourth embodiment, and FIG. 13 is a sectional view taken along the line XIII-XIII in FIG. 12. FIG. 14 is an exploded perspective view of a water discharge valve device of the flush water tank assembly according to the fourth embodiment. In FIGS. 12 to 14, the same element or component as that in the water discharge valve device and the flush water tank assembly equipped therewith, according to each of the first to third embodiments, is assigned with the same reference numeral or code, and its description will be omitted.

As illustrated in FIGS. 12 and 13, a water storage tank 22 of a flush water tank assembly 318 according to the fourth embodiment is internally provided with a water supply device 26 for supplying flush water into the water storage tank 22, and a water discharge valve device 328 for selectively opening a discharge port 22*a* to discharge flush water stored in the water storage tank 22 to a water conduit 6 of a toilet main unit 2.

As illustrated in FIG. 14, the water discharge valve device 328 comprises the water discharge valve unit 358 attached to an upper end of a discharge port unit 60, and an outer control casing member 362 detachably attached to the discharge port unit 60 from thereabove.

As illustrated in FIG. 14, the water discharge valve unit 358 of the water discharge valve device 328 comprises: a valve element 84; an overflow pipe 40; an inner control casing member 376; a float member 52; an overflow pipe mounting member 86; and a refill pipe mounting member 88.

The inner control casing member 376 is adapted to function as means to control an up-down movement of the valve element 84, and comprises: a hollow and generally circular cylindrical water compartment 376*b* adapted to store therein flush water, and having a peripheral wall formed with an opening 376*a* for draining the stored flush water at a given flow rate; a generally circular tubular guide portion 376*c* extending upwardly from a central region of a bottom of the water compartment 376*b*; and one or more engagement slots 376*d* each formed at a lower end of the water compartment 376*b* and adapted to be engaged with a retention protrusions 78 of a discharge port-defining member 64 of the discharge port unit 60. Each of the engagement slots 376*d* is formed as a generally L-shaped keyhole-like slot, so that it can be engaged with the control casing-mounting retention protrusions 78 through an operation of positioning the engagement slot 376*d* to allow the control casing-mounting retention protrusion 78 to be inserted thereinto from therebelow, and then displacing the engagement slot 376*d* in a horizontal direction.

Further, a flow rate adjusting member 392 as described in detail later is attached with respect to the opening 376*a* of the water compartment 376*b* of the inner control casing member 376. An attaching position of the flow rate adjusting member 392 can be changed in an up-down direction to adjust an effective sectional area of the opening 376*a*.

The float member 52 has: a float portion 52*c* formed in a thin-walled and generally annular shape, and received between an inner peripheral surface of the water compartment 376*b* of the control casing 376 and an outer peripheral surface of the guide portion 376*c*; and a bottom portion 52*d* attached to a lower end of the float portion 52*c*, so that an internal space is defined between an inner surface of the float member 52*c* and the bottom portion 52*d*. In a situation where flush water is stored in the water compartment 376*b* of the inner control casing member 376, the float portion 52*c* and the bottom portion 52*d* are received within the water compartment 376*b* of the inner control casing member 376 in a floating state by an action of buoyancy. Then, along with a lowering in flush water level within the water compartment 376*b* of the inner control casing member 376, they are moved downwardly while being guided by the guide portion 376*c* of the inner control casing member 376.

As illustrated in FIG. 14, the outer control casing member 362 comprises a casing body 390 formed in a generally rectangular shape in cross-section and opened upwardly. The casing body 390 has a lower end which defines an opening for allowing the discharge port-defining member 64 of the discharge port unit 60 to be inserted thereinto in the up-down direction. The lower end of the casing body 390 has a peripheral edge portion provided with one or more engagement slots 390*a* each disengageably engageable with a retention protrusions 72 of the discharge port-defining member 64 of the discharge port unit 60 by rotating the casing body 390 about an axis thereof (corresponding to an axis 358*a* of the water discharge valve unit 358).

Each of the engagement slots 390*a* forms a generally L-shaped keyhole-like slot, so that it can be engaged with the retention protrusions 72 through an operation of positioning the engagement slot 390*a* to allow the retention protrusion 72 to be inserted thereinto from therebelow, and then displacing the engagement slot 390*a* in a horizontal direction.

In a state in which the engagement slot 90*a* of the casing body 390 is engaged with the retention protrusion 72 of the discharge port-defining member 64 of the discharge port unit 60, a peripheral wall of the casing body 390 extends upwardly from a bottom wall of the water storage tank 22 while surrounding respective parts of the discharge port unit 60 and the inner control casing member 376, and one side 390*b* of the peripheral wall proximal to an operating lever 42 (hereinafter referred to as "proximal sidewall 390*b*") is formed with a flushing mode-switching opening 390*c* penetrating through the proximal sidewall 390*b*.

Further, a switching valve 356 (as described in detail later) is attached to the proximal sidewall 390*b* of the casing body 390 and adapted to open and close the opening 390*c*, and an aftermentioned weight member 356*b* is detachably attached to the switching valve 356. When the switching valve 356 is operated to open the opening 390*c*, water discharge is performed in a full flushing mode. On the other hand, when the switching valve 356 is operated to close the opening 390*c*, water discharge is performed in a partial flushing mode.

Further, a proximal-side flow rate adjusting opening 390*d* is formed in the proximal sidewall 390*b* of the casing body 390 at a position above the opening 390*c*, and a proximal-side flow rate adjusting member 394 as described in detail later is attached with respect to the proximal-side flow rate adjusting opening 390*d*.

Similarly, a distal-side flow rate adjusting opening 390*d'* is formed in one of the remaining sidewalls of the casing body 390 opposed to the proximal sidewall 390*b* (hereinafter referred to as "distal sidewall 390*b*"), and a distal-side flow rate adjusting member 396 as described in detail later is attached with respect to the distal-side flow rate adjusting opening 390*d'*.

An attaching position of each of the proximal-side flow rate adjusting member 394 and the distal-side flow rate adjusting member 396 can be change in the up-down direction to adjust an effective sectional area of a corresponding one of the openings 390*d*, 390*d'*, thereby making it possible to adjust a flow rate of flush water to be permitted to flow from an inside of the water storage tank 22 into the casing body 390 through the corresponding one of the openings 390*d*, 390*d* in the partial flushing mode, and adjust a flow rate of flush water to be permitted to flow out of the flush water tank 22.

Then, as illustrated in FIG. 14, in a state in which the engagement slot 376*d* of the inner control casing member 376 is engaged with the control casing-mounting retention protrusion 78 of the discharge port-defining member 64 of the discharge port unit 60, and the engagement slot 390*a* on the casing body 90 is engaged with retention protrusion 72 of the discharge port-defining member 64 of the discharge port unit 60, a plurality of communication ports 82 formed in a peripheral surface of the discharge port-defining member 64 extending from a bottom of the inner control casing member 376 to the discharge port 22*a* serve as communication ports for providing fluid communication between an inside of the casing body 390 and the discharge port 22*a*, and the flushing mode-switching opening 390*c* of the casing body 390 is provided at a height position equal to or lower than an upper end of each of the communication ports 82.

As in the valve element 84 indicated by the two-dot chain line in FIG. 13, the valve element 84 of the water discharge valve unit 358 immediately after start of water discharge in the full flushing mode and the partial flushing mode is moved upwardly to a given uppermost height position where it is in contact with the bottom of the inner control casing member 376. The uppermost height position of the valve element 84 is set to be equal to or higher than a height position of an upper end of the flushing mode-switching opening 390*c* of the casing body 390.

Further, as illustrated in FIGS. 13 and 14, the opening 376*a* of the water compartment 376*b* of the inner control casing member 376 is set to a height position equal to or higher than that of the upper end of the flushing mode-switching opening 390*c* of the casing body 390.

With reference to FIGS. 15 to 19, details of the flow rate adjusting member 392 to be attached to the inner control casing member 376 of the water discharge valve device 328 will be described below.

Figure 15:
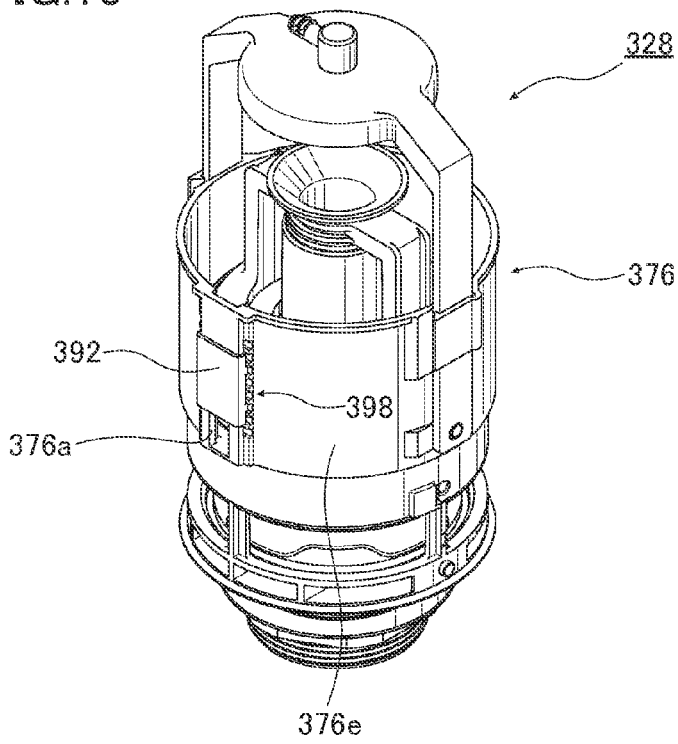
FIG. 15 is a perspective view illustrating the water discharge valve device of the flush water tank assembly according to the fourth embodiment, wherein an outer control casing member is removed therefrom.
Figure 16:
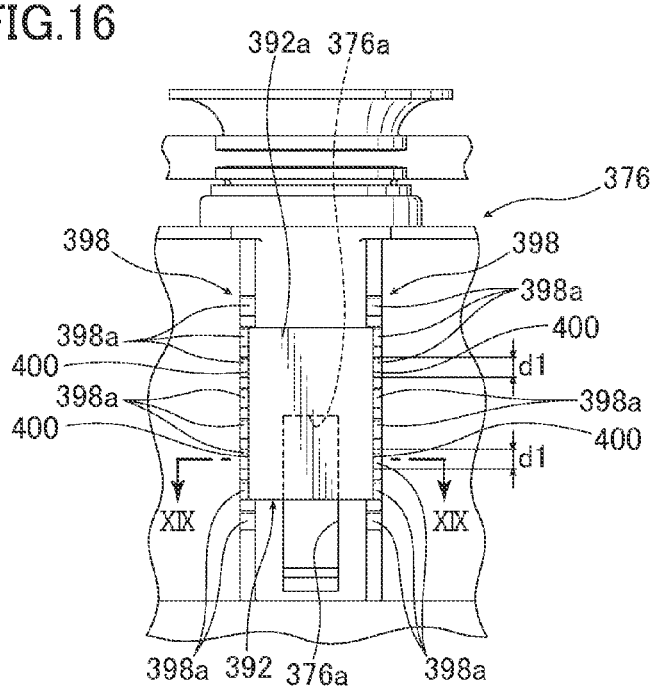
FIG. 16 is an enlarged view illustrating a flow rate adjusting member attached to an inner control casing member in the water discharge valve device of the flush water tank assembly according to the fourth embodiment.

FIG. 15 is a perspective view illustrating the water discharge valve device of the flush water tank assembly according to the fourth embodiment, wherein the outer control casing member is removed therefrom, and FIG. 16 is an enlarged view illustrating the adjusting member for adjusting the effective sectional area of the opening of the inner control casing member, in the water discharge valve device of the flush water tank assembly according to the fourth embodiment.

Figure 17:
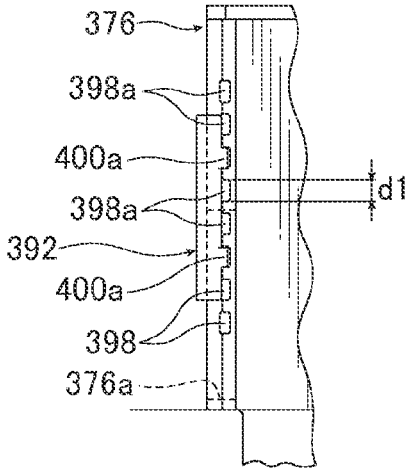
FIG. 17 is an enlarged front view illustrating the flow rate adjusting member attached to the inner control casing member in the water discharge valve device of the flush water tank assembly according to the fourth embodiment.
Figure 18:
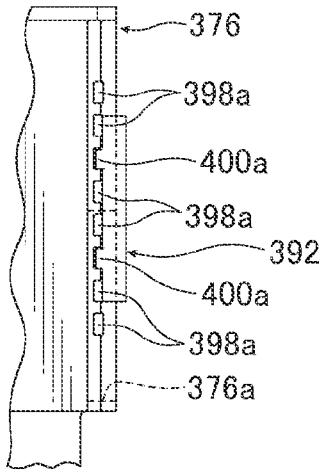
FIG. 18 is an enlarged rear view illustrating the flow rate adjusting member attached to the inner control casing member in the water discharge valve device of the flush water tank assembly according to the fourth embodiment.
Figure 19:
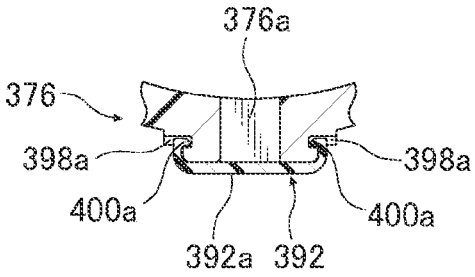
FIG. 19 is a section taken along line XIX-XIX in FIG. 16.

FIG. 17 is an enlarged front view illustrating the adjusting member attached to the inner control casing member in the water discharge valve device of the flush water tank assembly according to the fourth embodiment, and FIG. 18 is an enlarged rear view illustrating the adjusting member of the inner control casing member in the water discharge valve device of the flush water tank assembly according to the fourth embodiment. FIG. 19 is a section taken along line XIX-XIX in FIG. 16.

As illustrated in FIGS. 15 to 19, the inner control casing member 376 and flow rate adjusting member 392 have, respectively, fitting portions 398, 400 fittable to each other. The fitting portion 398 of the inner control casing member 376 serves as a female-side fitting portion (hereinafter referred to as "female fitting portion 398"), and the fitting portion 400 of the flow rate adjusting member 392 serves as a male-side fitting portion (hereinafter referred to as "male fitting portion 400") fittable to the female fitting portion 398 of the inner control casing member 376.

The female fitting portion 398 of the inner control casing member 376 is integrally provided in wall portions 376*e* of the inner control casing member 376 on both sides of the opening 376*a*, and provided with a plurality of positioning recesses 398*a* each adapted to positionally fix the attaching position of the flow rate adjusting member 392. Each of the plurality of positioning recesses 398*a* is concaved inward of the wall portions 376*e* of the inner control casing member 376, and approximately linearly arranged side-by-side in the up-down direction.

Alternatively, the plurality of positioning recesses 398*a* may be approximately linearly arranged side-by-side in a left-right direction along wall portions 376*e* on upper and lower sides of the opening 376*a* of the inner control casing member 76, so as to positionally fix the flow rate adjusting member 392 in the left-right direction.

The flow rate adjusting member 392 has a cover portion 392*a* for covering the opening 376*a* of the inner control casing member 376 when attached to a given position of the inner control casing member 76. In the attaching position of the flow rate adjusting member 392 illustrated in FIG. 16, the cover portion 392*a* covers an upper region of the opening 376*a* of the inner control casing member 376 located above an approximately central height position of the opening 376*a*.

The male fitting portion 400 of the flow rate adjusting member 392 is provided on each of opposite lateral sides of the cover portion 392*a* at given intervals in the up-down direction, as illustrated, particularly, in FIGS. 17 and 18, and provided with a claw-shaped protrusion 400*a* fittable to one of the positioning recesses 398*a* of the female fitting portion 398 of the inner control casing member 376.

For example, as the claw-shaped protrusion 400*a* of the flow rate adjusting member 392 is attached to the positioning recess 398*a* of the inner control casing member 376 at a higher position, the effective sectional area of the opening 376*a* of the inner control casing member 376 becomes larger, so that a flow rate of flush water flowing out of the inside of the water compartment 376*b* of the inner control casing member 376 through the opening 376*a* during an water discharge operation of the water discharge valve device 328 becomes larger, and the float portion 52*c* and the valve element 84 are moved downwardly at a higher speed.

Each of the plurality of positioning recesses 398*a* of the female fitting portions 398 of the inner control casing member 376 is formed to have the same width d1 in the up-down direction, and it is preferably set to a value less than a width of a finger of an installation or maintenance person, so that, once the claw-shaped protrusion 400*a* of the male fitting portion 400 of the flow rate adjusting member 392 is fitted in the positioning recess 398*a* of the female fitting portion 398 of the inner control casing member 376, an installation or maintenance person is precluded from releasing the fitting engagement between the fitting portions 398, 400 by his/her finger.

More specifically, the width d1 in each of the positioning recesses 398*a* in the up-down direction is set preferably to 13 mm or less, more preferably to 5 mm or less.

Although the fourth embodiment has been described based on one example where, as for the fitting engagement between the inner control casing member 376 and the flow rate adjusting member 392 in the water discharge valve device 328, the fitting portion 398 of the inner control casing member 376 is formed as a female fitting portion, and the fitting portion 400 of the flow rate adjusting member 392 is formed as a male fitting portion, the present invention is not limited to such a configuration. For example, a configuration may be employed in which the fitting portion 398 of the inner control casing member 376 is formed as a male fitting portion, and the fitting portion 400 of the flow rate adjusting member 392 is formed as a female fitting portion.

With reference to FIGS. 20 to 25, details of the outer control casing member 362 of the water discharge valve device 328, and details of the proximal-side flow rate adjusting member 394 and the distal-side flow rate adjusting member 396 to be attached to the outer control casing member 362, will be described below.

Figure 20:
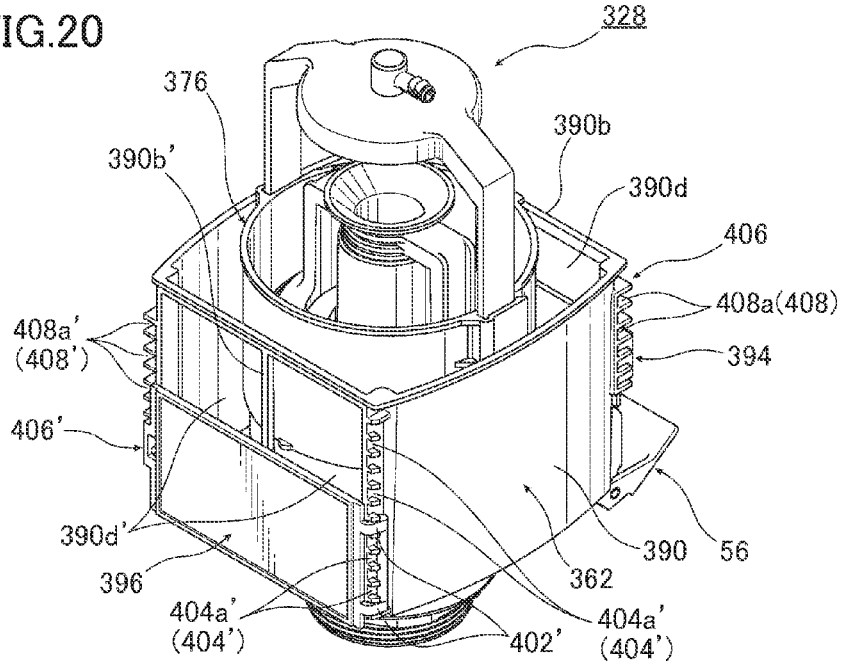
FIG. 20 is a perspective view illustrating the water discharge valve device of the flush water tank assembly according to the fourth embodiment, when viewed from a rearward and oblique upward position.
Figure 21:
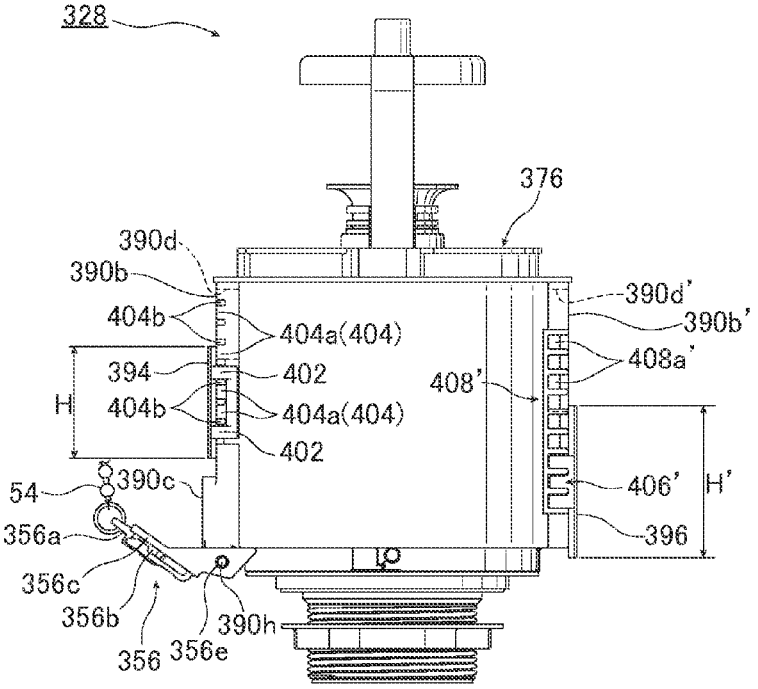
FIG. 21 is a front view illustrating the water discharge valve device of the flush water tank assembly according to the fourth embodiment.

FIG. 20 is a perspective view illustrating the water discharge valve device of the flush water tank assembly according to the fourth embodiment, when viewed from a rearward and oblique upward position, and FIG. 21 is a front view illustrating the water discharge valve device of the flush water tank assembly according to the fourth embodiment.

Figure 22:
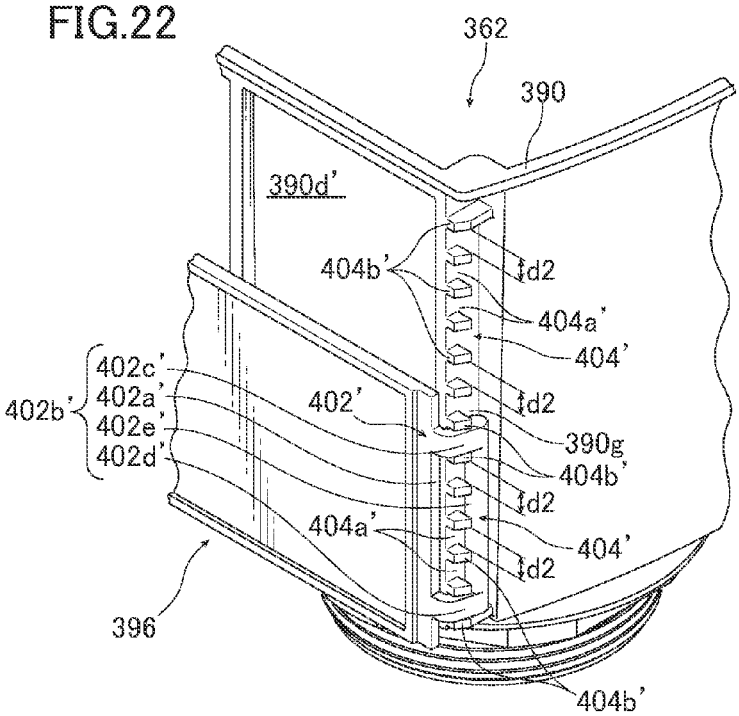
FIG. 22 is an enlarged perspective view illustrating a fitted state between a positioning recess of a rear-side female fitting portion of the outer control casing member, and a frame-shaped protrusion of a male fitting portion of a distal-side flow rate adjusting member, in the water discharge valve device of the flush water tank assembly according to the fourth embodiment.
Figure 23:
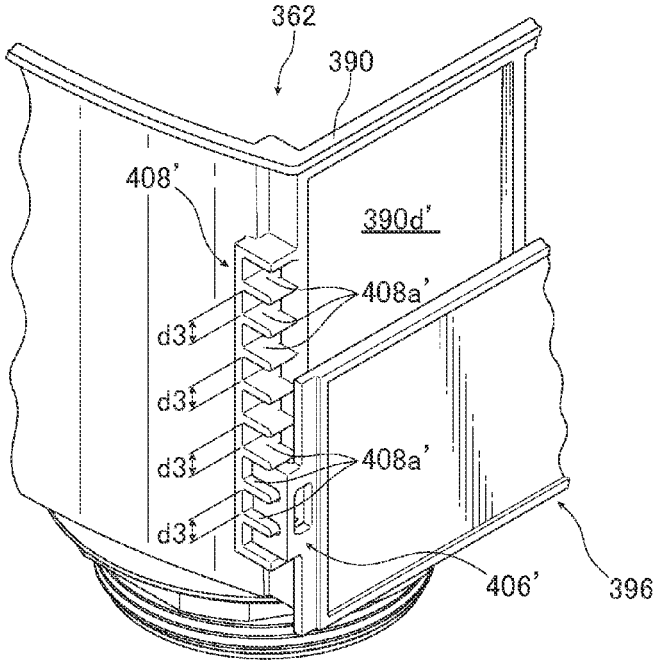
FIG. 23 is an enlarged perspective view illustrating a fitted state between a positioning recess of a front-side female fitting portion of the outer control casing member, and a claw-shaped protrusion of a male fitting portion of the distal-side flow rate adjusting member, in the water discharge valve device of the flush water tank assembly according to the fourth embodiment.

FIG. 22 is an enlarged perspective view illustrating a fitted state between a positioning recess of a rear-side female fitting portion of the outer control casing member, and a frame-shaped protrusion of a male fitting portion of the distal-side flow rate adjusting member, in the water discharge valve device of the flush water tank assembly according to the fourth embodiment, and FIG. 23 is an enlarged perspective view illustrating a fitted state between a positioning recess of a front-side female fitting portion of the outer control casing member, and a claw-shaped protrusion of a male fitting portion of the distal-side flow rate adjusting member, in the water discharge valve device of the flush water tank assembly according to the fourth embodiment.

Figure 24:
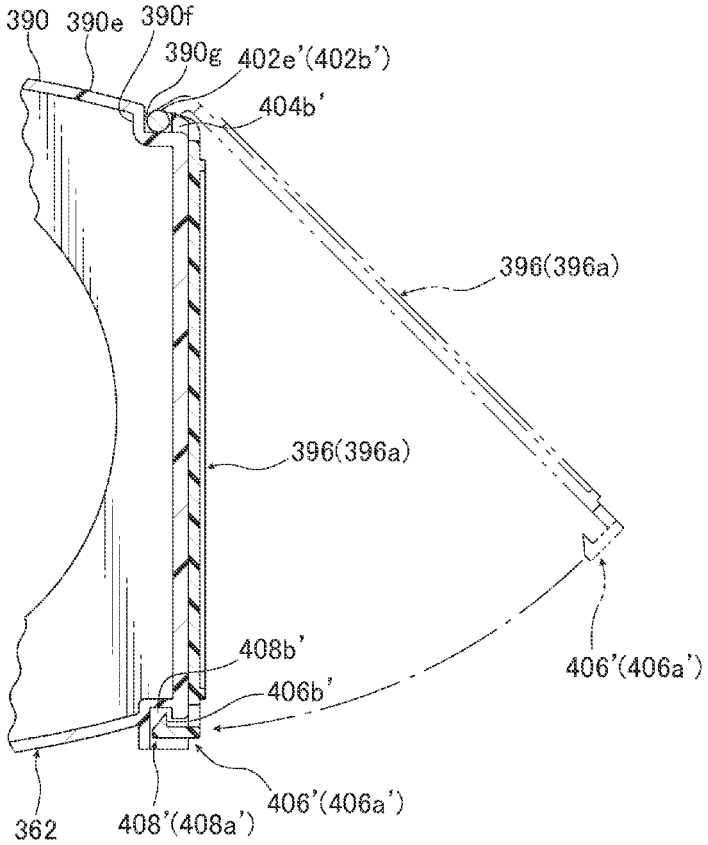
FIG. 24 is a fragmentary top plan sectional view illustrating a state during a period after the frame-shaped protrusion of the male fitting portion of the distal-side flow rate adjusting member is fitted in the positioning recess of the rear-side female fitting portion of the outer control casing member in the water discharge valve device of the flush water tank assembly according to the fourth embodiment, through until the claw-shaped protrusion of the male fitting portion of the distal-side flow rate adjusting member is fitted in the positioning recess of the front-side female fitting portion of the outer control casing member.

FIG. 24 is a fragmentary top plan sectional view illustrating a state during a period after the frame-shaped protrusion of the male fitting portion of the distal-side flow rate adjusting member is fitted in the positioning recess of the rear-side female fitting portion of the outer control casing member in the water discharge valve device of the flush water tank assembly according to the fourth embodiment, through until the claw-shaped protrusion of the male fitting portion of the distal-side flow rate adjusting member is fitted in the positioning recess of the front-side female fitting portion of the outer control casing member.

Figure 25:
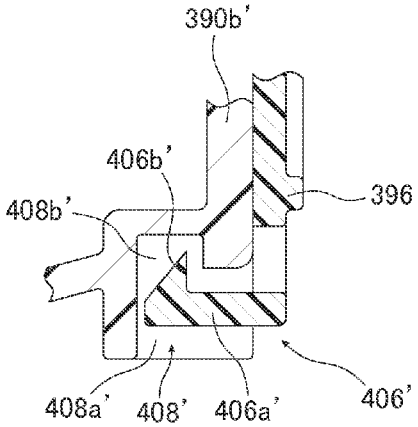
FIG. 25 is an enlarged top plan sectional view illustrating a fitting region between the positioning recess of the front-side female fitting portion of the outer control casing member, and the claw-shaped protrusion of the male fitting portion of the distal-side flow rate adjusting member, in the water discharge valve device of the flush water tank assembly according to the fourth embodiment.

FIG. 25 is an enlarged top plan sectional view illustrating a fitting region between the positioning recess of the front-side female fitting portion of the outer control casing member, and the claw-shaped protrusion of the male fitting portion of the distal-side flow rate adjusting member, in the water discharge valve device of the flush water tank assembly according to the fourth embodiment.

As illustrated in FIGS. 14 and 20 to 25, the proximal-side flow rate adjusting opening 390*d* formed in the proximal sidewall 390*b* of the casing body 390 of the outer control casing member 362 has a rectangular sectional shape in which two sub-openings each having the same sectional area are arranged in a front-rear direction.

Similarly, the distal-side flow rate adjusting opening 390*d'* formed in the distal sidewall 390*b'* of the casing body 390 of the outer control casing member 362 has a rectangular sectional shape in which two sub-openings each having the same sectional area are arranged in the front-rear direction.

An upper edge of the two sub-openings of the proximal-side flow rate adjusting opening 390*d* and an upper edge of the two sub-openings of the distal-side flow rate adjusting opening 390*d'* are at approximately the same height positions. However, a lower edge of the two sub-openings of the distal-side flow rate adjusting opening 390*d'* is located above an upper edge of the flushing mode-switching opening 390*c* and below a lower edge of the two sub-openings of the proximal-side flow rate adjusting opening 390*d*.

Thus, when the entire section of the openings 390*d*, 390*d'* is opened, the entire sectional area of the opening 390*d* is less than the entire sectional area of the opening 390*d'*.

As illustrated in FIGS. 14 and 20 to 25, the outer control casing member 362 has: a female fitting portion 404 integrally provided in a region of the proximal sidewall 390*b* on the side of a front surface of the casing body 390 and fittable to a male fitting portion 402 of the proximal-side flow rate adjusting member 394; and a female fitting portion 408 provided in a rear surface of the casing body 390 and fittable to a male fitting portion 406 of the proximal-side flow rate adjusting member 394.

The outer control casing member 362 also has: a female fitting portion 404' integrally provided in the rear surface of the casing body 390 and fittable to a male fitting portion 402' of the distal-side flow rate adjusting member 396; and a female fitting portions 408' provided in a region of the distal sidewall 390*b'* on the side of the front surface of the casing body 390 and fittable to a male fitting portions 406' of the distal flow rate adjusting member 396.

Each of the female fitting portions 404, 408 of the outer control casing member 362 has a respective one of two groups of positioning recesses 404*a*, 408*a* for fixing an attaching position of the proximal-side flow rate adjusting member 394. Each of the groups of positioning recesses 404*a*, 408*a* are concaved inward of the proximal sidewall 392*b* of the outer control casing member 362, and approximately linearly arranged side-by-side in the up-down direction.

Similarly, each of the male fitting portions 404', 408' of the outer control casing member 362 has a respective one of two groups of positioning recesses 404*a*', 408*a*' for fixing an attaching position of the distal-side flow rate adjusting member 396. Each of the groups of positioning recesses 404*a*', 408*a*' are concaved inward of the distal sidewall 392*b*' of the outer control casing member 362, and approximately linearly arranged side-by-side in the up-down direction.

In the fourth embodiment, each of the positioning recesses 404*a* of the female fitting portion 404 and each of the positioning recesses 404*a*' of the female fitting portion 404' in the outer control casing member 362 are formed in the same configuration. However, the positioning recesses 404*a*' are arranged in a number greater than that of the positioning recesses 404*a*.

Similarly, while each of the positioning recesses 408*a* of the female fitting portion 408 and each of the positioning recesses 408*a*' of the female fitting portion 408' in the outer control casing member 362 are formed in the same configuration, the positioning recesses 408*a*' are arranged in a number greater than that of the positioning recesses 408*a*.

Each of the proximal-side flow rate adjusting member 394 and the distal-side flow rate adjusting member 396 is illustrated in FIGS. 13 and 20 to 23, in a state when an attaching position thereof with respect to the outer control casing member 362 is set to a lowermost position. However, as the attaching position of each of the proximal-side flow rate adjusting member 394 and the distal-side flow rate adjusting member 396 with respect to the outer control casing member 362 is set to a lower position, the sectional area of a corresponding one of the openings 390*d*, 390*d*' is set to a larger value.

Then, as the sectional area of each of the openings 390*d*, 390*d*' is set to a larger value, a flow rate of flush water flowing from the inside of the water storage tank 22 into the inside of the casing body 390 through the openings 390*d*, 390*d*' of the casing body 390 during the water discharge operation of the water discharge valve device 328 in the partial flushing mode becomes larger, so that an amount of flush water suppliable to the toilet main unit 2 through the discharge port 22*a* of the water storage tank 22 in the partial flush mode can be set to a larger value.

For example, when the attaching position of each of the proximal-side flow rate adjusting member 394 and the distal-side flow rate adjusting member 396 with respect to the outer control casing member 362 is set to an uppermost position, the openings 390*d*, 390*d*' are fully closed, respectively, by the proximal-side flow rate adjusting member 394 and the distal-side flow rate adjusting member 396, to preclude flush water in the water storage tank 22 from flowing into the inside of the casing body 390 through the openings 390*d*, 390*d*' of the casing body 390 during the water discharge operation of the water discharge valve device 328, so that the amount of flush water suppliable to the toilet main unit 2 through the discharge port 22*a* of the water storage tank 22 in the partial flushing mode can be set to a minimum value.

The proximal-side flow rate adjusting member 394 has a cover portion 394*a* for covering the proximal opening 390*d* of the outer control casing member 362 when attached to the outer control casing member 362 at a given attaching position.

The male fitting portion 402 of the proximal-side flow rate adjusting member 394 has a frame-shaped protrusion 402*b* provided on a front-side edge region of the cover portion 394*a* of the proximal-side flow rate adjusting member 394, and formed to define thereinside an elongate hole 402*a* extending in the up-down direction.

The male fitting portion 406 of the proximal-side flow rate adjusting member 394 is provided on a rear-side edge region of the cover portion 394*a* of the proximal-side flow rate adjusting member 394, and provided with a claw-shaped protrusion 406*a* fittable to one of the positioning recesses 408*a* of the female fitting portion 408 of the outer control casing member 362.

Similarly, the distal-side flow rate adjusting member 396 has a cover portion 396*a* for covering the distal opening 390*d*' of the outer control casing member 362 when attached to the outer control casing member 362 at a given attaching position.

The male fitting portion 402' of the distal-side flow rate adjusting member 394 has a frame-shaped protrusion 402*b*' provided on a rear-side edge region of the cover portion 396*a* of the distal-side flow rate adjusting member 396, and formed to define thereinside an elongate hole 402*a*' extending in the up-down direction.

The male fitting portion 406' of the distal-side flow rate adjusting member 396 is provided on a front-side edge region of the cover portion 396*a* of the distal-side flow rate adjusting member 396, and provided with a claw-shaped protrusion 406*a*' fittable to one of the positioning recesses 408*a*' of the female fitting portion 408' of the outer control casing member 362.

A height dimension H of the cover portion 394*a* of the proximal-side flow rate adjusting member 394 in the up-down direction is set to be less than a height dimension H' of the cover portion 396*a* of the distal-side flow rate adjusting member 396 in the up-down direction. On the other hand, a length L of the cover portion 394*a* in the front-rear direction is set to be equal to a length L' of the cover portion 396*a* in the front-rear direction.

The frame-shaped protrusion 402*b* of the male fitting portion 402 of the proximal-side flow rate adjusting member 394 and the frame-shaped protrusion 402*b*' of the male fitting portion 402' of the distal-side flow rate adjusting member 396 have the same configuration, and the claw-shaped protrusion 406*a* of the male fitting portion 406 of the proximal-side flow rate adjusting member 394 and the claw-shaped protrusion 406*a*' on the male fitting portion 406' of the distal-side flow rate adjusting member 396.

Therefore, a fitted state between the frame-shaped protrusion 402*b* of the male fitting portion 402 of the proximal-side flow rate adjusting member 394 and the positioning recess 404*a* of the female-side fitting portion 404 of the outer control casing member 362 is identical to a fitted state between the frame-shaped protrusion 402*b*' of the male fitting portion 402' of the distal-side flow rate adjusting member 396 and the positioning recess 404*a*' of the female fitting portion 404' of the outer control casing member 362 as illustrated in FIG. 22. Thus, description about the fitted state between the frame-shaped protrusion 402*b* and the positioning recess 404*a* will be omitted.

Further, a fitted state between the claw-shaped protrusion 406*a* of the male fitting portion 406 of the proximal-side flow rate adjusting member 394 and the positioning recess 408*a* of the female fitting portion 408 of the outer control casing member 362 is identical to a fitted state between the claw-shaped protrusion 406*a*' of the male fitting portion 406' of the distal-side flow rate adjusting member 396 and the positioning recess 408*a*' of the female fitting portion 408' of the outer control casing member 362 as illustrated in FIG. 23. Thus, description about the fitted state between the claw-shaped protrusion 406*a* and the positioning recess 408*a* will be omitted.

As illustrated in FIG. 22, the frame-shaped protrusion 402*b*' provided in the male fitting portion 402' of the distal-side flow rate adjusting member 96 and formed to define thereinside the elongate hole 402*a*' extending in the up-down direction has an upper edge portion 402*c*', a lower edge portion 402*d*', and a bridge portion 402*e*' extending from the lower edge portion 402*d*' to the upper edge portion 402*c*'.

A plurality of recess-defining protrusions 404*b*' are arranged in the up-down direction along an edge of the casing body 390 at which the female fitting portion 404' of the outer control casing member 362 is located, in such a manner as to protrude outwardly to define the positioning recesses 404*a*' of the female fitting portion 404' of the outer control casing member 362.

In this regard, each of the positioning recesses 404*a*' is formed to have the same width d2 in the up-down direction, and is equal to a distance between adjacent ones of the recess-defining protrusions 404*b*'. Preferably, the width d2 is set to a value less than a width of a finger of an installation or maintenance person.

More specifically, the width d2 in each of the positioning recesses 404*a*' in the up-down direction is set preferably to 13 mm or less, more preferably to 5 mm or less.

With reference to FIGS. 22 to 25, an operation of attaching the distal-side flow rate adjusting member 396 to the outer control casing member 362 will be described below.

As illustrated in FIGS. 22 and 24, in the operation of attaching the distal-side flow rate adjusting member 396 to the outer control casing member 362, the bridge portion 402*e*' of the frame-shaped protrusion 402*b*' of the distal-side flow rate adjusting member 396 is firstly fitted into a concave portion 390*g* which is formed between an array of the recess-defining protrusions 404*b*' defining the positioning recesses 404*a*' of the female fitting portions 404' of the outer control casing member 362, and a side surface 390*f* of a rear sidewall 390*e* of the casing body 390, to extend in a vertical direction.

Then, the distal-side flow rate adjusting member 396 is swingingly moved about the bridge portion 402*e*' toward the outer control casing member 362, to allow the upper edge portion 402*c*' and the lower edge portion 402*d*' of the frame-shaped protrusion 402*b*' of the distal-side flow rate adjusting member 396 to be fitted into corresponding opposed ones of the positioning recesses 404*a*' of the female fitting portion 404' of the outer control casing member 362.

Subsequently, the claw-shaped protrusion 406*a*' of the male fitting portions 406' of the distal-side flow rate adjusting member 396 is fitted into a corresponding opposed one of the positioning recesses 408*a*' of the female fitting portion 408' of the outer control casing member 362, and then a distal end 406*b*' of the claw-shaped protrusion 406*a*' is fitted into a depressed portion 408*b*' formed in the positioning recess 408*a*. In this way, the operation of attaching the distal-side flow rate adjusting member 396 to the outer control casing member 362 is completed.

In this regard, each of the positioning recesses 408*a*' is formed to have the same width d3 in the up-down direction. Preferably, the width d3 is set to a value less than a width of a finger of an installation or maintenance person.

More specifically, the width d3 in each of the positioning recesses 408*a*' in the up-down direction is set preferably to 13 mm or less, more preferably to 5 mm or less.

Although the fourth embodiment has been described based on one example where, as for the fitting engagement between the outer control casing member 362 and the proximal-side flow rate adjusting member 394 in the water discharge valve device 328, and the fitting engagement between the outer control casing member 362 and the distal-side flow rate adjusting member 396 in the water discharge valve device 328, each of the fitting portions 404, 404', 408, 408' of the outer control casing member 362 is formed as a female fitting portion, and each of the fitting portions 402, 406 of the proximal-side flow rate adjusting member 394 and the fitting portions 402', 406' of the distal-side flow rate adjusting member 396 is formed as a male fitting portion, the present invention is not limited to such a configuration. For example, a configuration may be employed in which the relation in terms of the female fitting portion and the male fitting portion is reversed.

Although the fourth embodiment has been described based on one example where, as for the front and rear male fitting portions 402, 406 of the proximal-side flow rate adjusting member 394 and the rear and front male fitting portions 402', 406' of the distal-side flow rate adjusting member 396, the male fitting portions 402, 402' are formed as the frame-shaped protrusions 402*b*, 402*b*', and the male fitting portions 406, 406' are formed as the claw-shaped protrusions 406*a*, 406*a*', i.e., a different type of protrusion is used for each side, the present invention is not limited to such a configuration. For example, each of the front and rear male fitting portions 402, 406 of the proximal-side flow rate adjusting member 394 and the rear and front male fitting portions 402', 406' of the distal-side flow rate adjusting member 396 may be formed as the same type of claw-shaped protrusion.

Figure 26A:
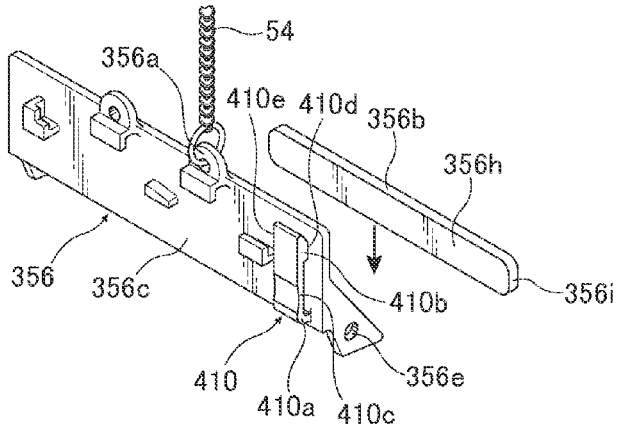
FIG. 26(*a*) is a perspective view illustrating a switching valve in a state before attaching a weight member thereto, in the water discharge valve device of the flush water tank assembly according to the fourth embodiment.
Figure 26B:
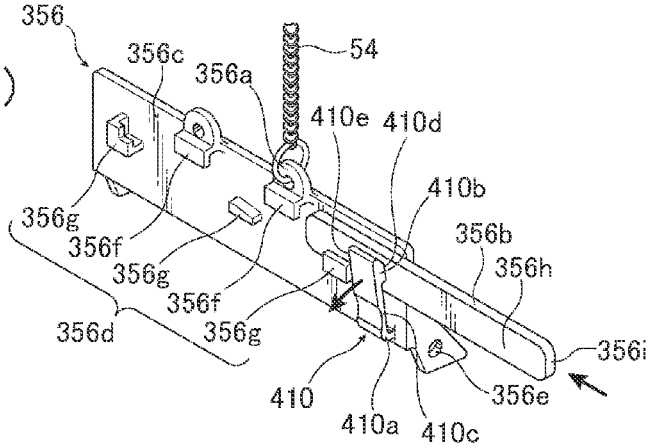
Figure 26C:
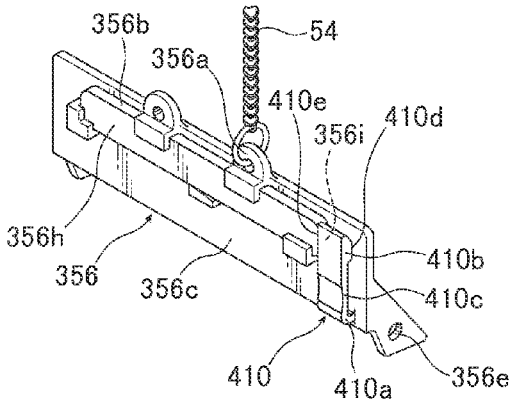

With reference to FIGS. 14, 26(*a*) to 26(*c*) and 27, details of the switching valve 356 of the outer control casing member 362 of the water discharge valve unit 358 will be described.

FIG. 26(*a*), FIG. 26(*b*) and FIG. 26(*c*) are, respectively, a perspective view illustrating the switching valve in a state before attaching the weight member thereto, in the water discharge valve device of the flush water tank assembly according to the fourth embodiment, a perspective view illustrating the switching valve in a state during the attachment of the weight member, in the water discharge valve device of the flush water tank assembly according to the fourth embodiment, and a perspective view illustrating the switching valve in a state after completion of the attachment of the weight member, in the water discharge valve device of the flush water tank assembly according to the fourth embodiment.

Figure 27:
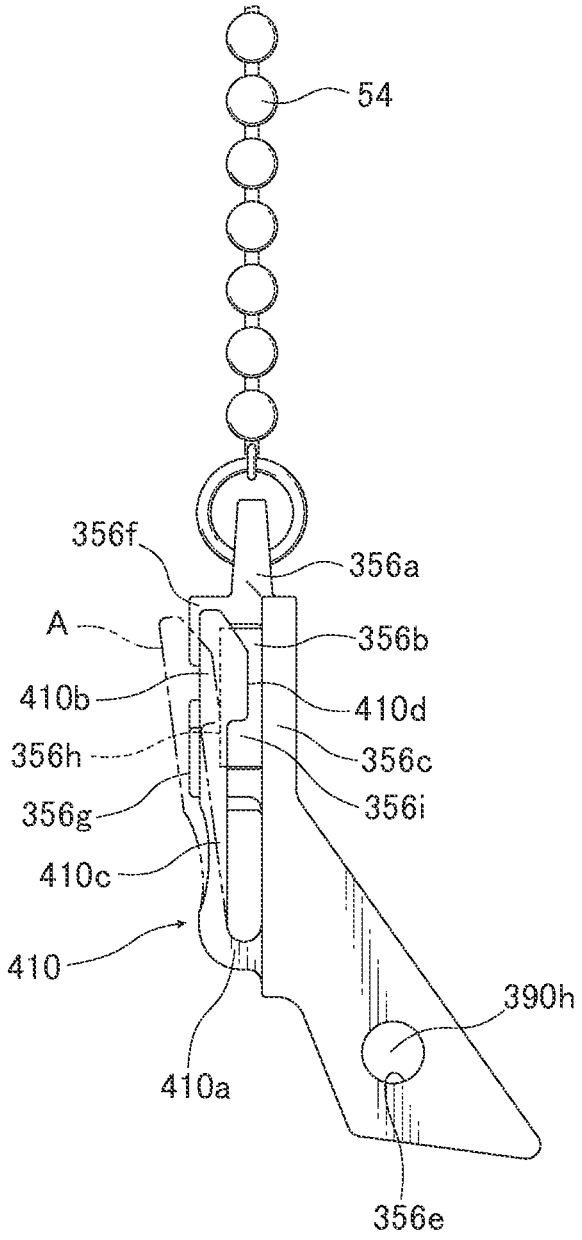
FIG. 27 is a front view illustrating the switching valve in the water discharge valve device of the flush water tank assembly according to the fourth embodiment.
Figure 28A:
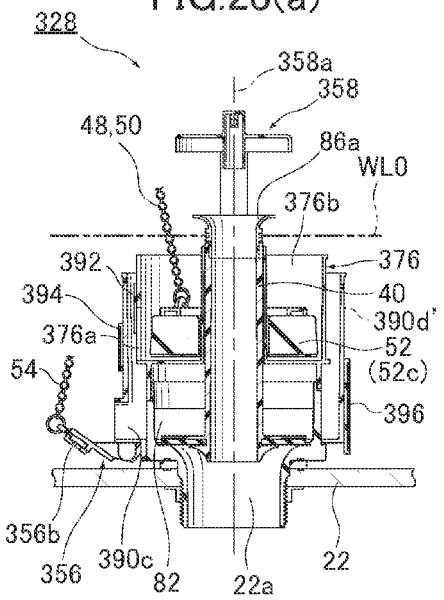
FIG. 28(*a*) is a front sectional view illustrating the water discharge valve device of the flush water tank assembly according to the fourth embodiment, in a state before starting water discharge in the full flushing mode.
Figure 28B:
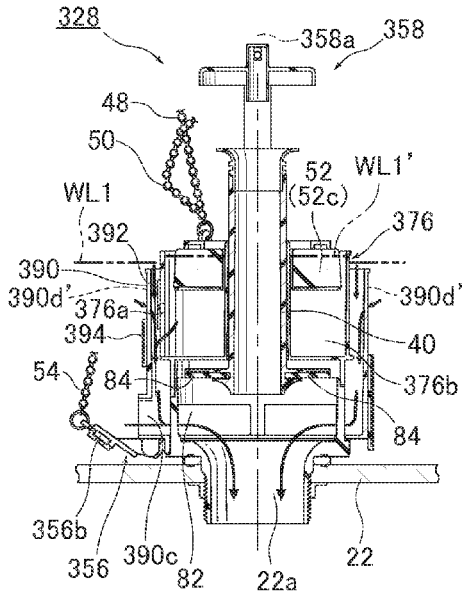
Figure 28C:
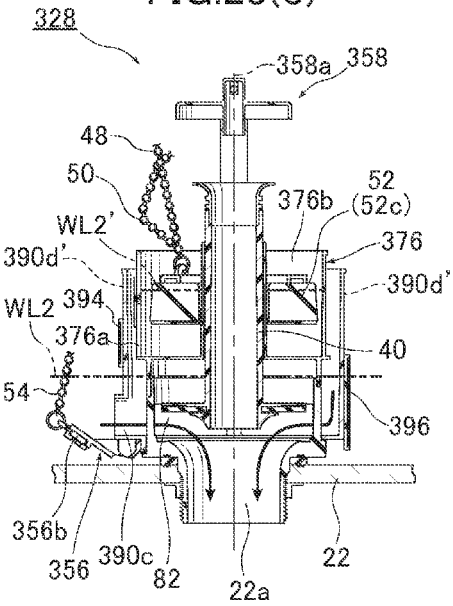
Figure 28D:
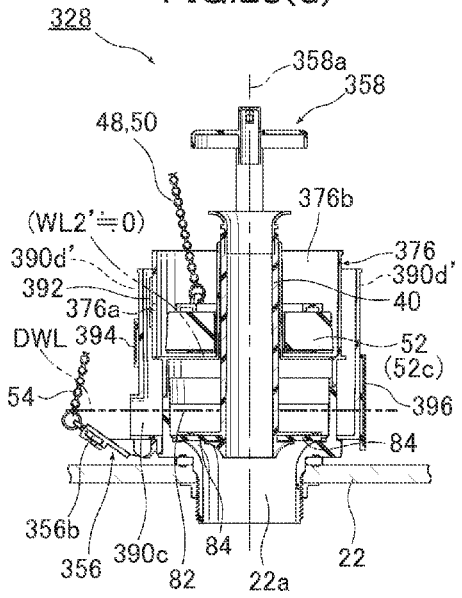
Figure 29A:
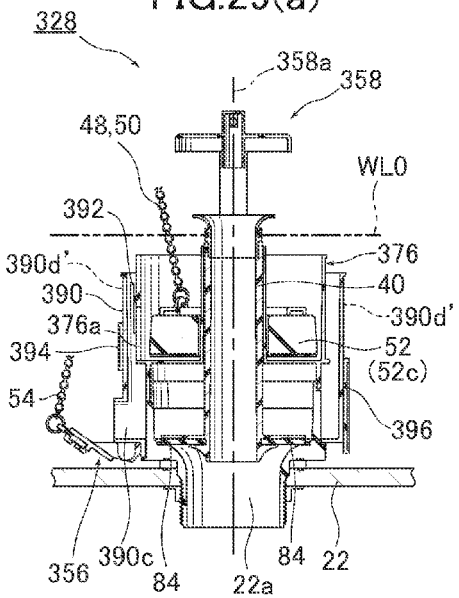
FIG. 29(*a*) is a front sectional view illustrating the water discharge valve device of the flush water tank assembly according to the fourth embodiment, in a state before starting water discharge in the partial flushing mode.
Figure 29B:
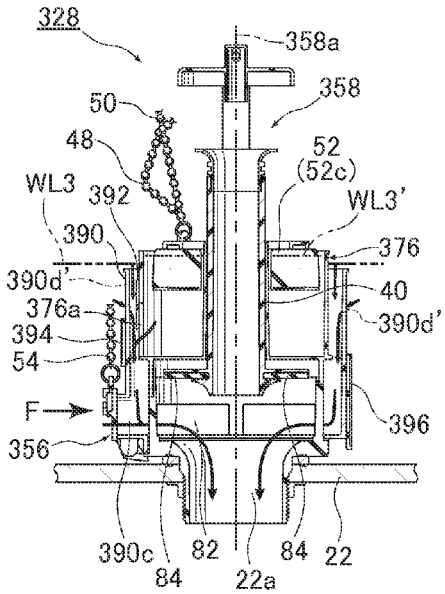
Figure 29C:
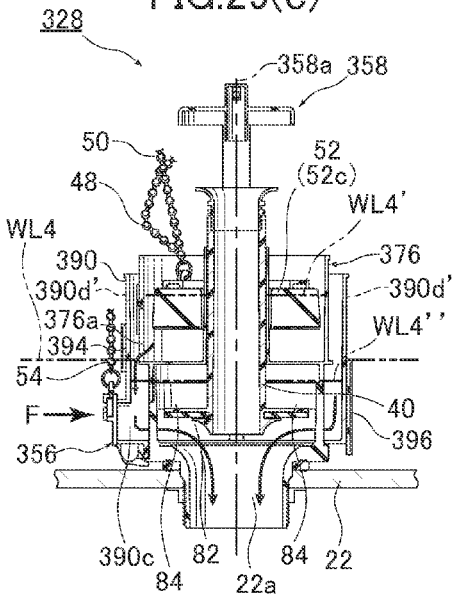
Figure 29D:
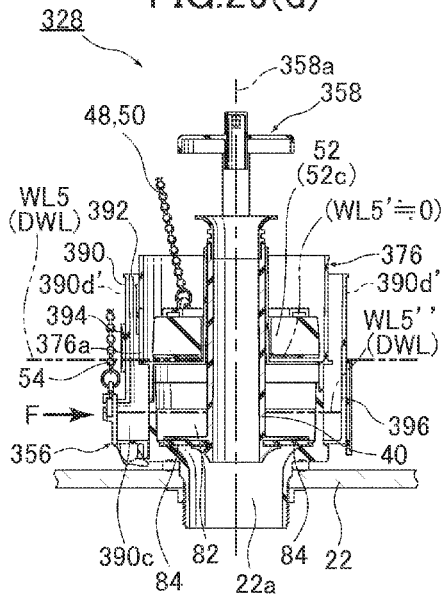

FIG. 27 is a front view illustrating the switching valve in the water discharge valve device of the flush water tank assembly according to the fourth embodiment.

As illustrated in FIGS. 14, 21, 26(*a*) to 26(*c*) and 27, the switching valve 356 of the outer control casing member 362 comprises: a switching valve body 356*c* made of a resin material and attached to the proximal sidewall 390*b* of the casing body 390 to switchably open and close the opening 390*c*; a thin plate-shaped weight member 356*b* made of stainless steel and disposed to extend in a horizontal direction; and a weight member mounting section 356*d* provided on an outer surface of the switching valve body 356*c* and adapted to allow the weight member to be detachably attached thereto.

The switching valve body 356*c* has a hinge portion 356*e* swingably attached to a pair of hinge members 390*h* provided, respectively, at a front lower end and a rear lower end of the proximal sidewall 390*b* formed with the opening 390*c* in the casing body 39 of the outer control casing member 362.

When the hinge portion 356*e* of the switching valve body 356*c* is swinging moved about the hinge members 390*h* of the casing body 390, the switching valve body 356*c* can be swingingly moved from a given upper position where the switching valve body 356*c* stands upright and closes the opening 390*c* of the casing body 390, to a given lower position where the switching valve body 356*c* opens the opening 390*c* of the casing body 390 after it is swingingly moved outwardly with respect to the proximal sidewall 390*b* of the casing body 390.

The weight member mounting section 356*d* comprises: an upper support portion 356*f* and a lower support portion 356*g* each adapted to support a respective one of an upper edge and a lower edge of the weight member 356*b*; and a snap-fit element 410 which is an elastic fastener provided on the front side with respect to the support portions 356*f*, 356*g* and adapted to fix the weight member 356*b* in the front-rear direction.

When the weight member 356*b* is attached to the weight member mounting section 356*d*, the weight member 356*b* is inserted between the switching valve body 356*c* and the snap-fit element 410 from thereabove (see FIG. 26(*a*)), so that a part of the weight member 356*b* is clamped between the switching valve body 356*c* and the snap-fit element 410 (see FIG. 26(*b*)). In the state in which a part of the weight member 356*b* is clamped between the switching valve body 356*c* and the snap-fit element 410, the snap-fit element 410 functions as elastic contact means which allows the weight member 356*b* to pass between the switching valve body 356*c* and the snap-fit element 410 in the front-rear direction, while elastically contacting against the weight member 356*b* during the course of the passing.

The snap-fit element 410 has a base end 410*a* protruding outwardly from a portion of the switching valve body 356*c* adjacent to a lower end of the outer surface of the switching member body 356*c* by a given length, and a distal end 410*b* extending upwardly from the base end 410*a* by a given length while maintaining a spaced-apart relation to the outer surface of the switching member body 356*c* by a given distance.

The snap-fit element 410 further has an elastically deformable portion 410*c* extending from the base end 410*a* to the distal end 410*b*. The elastically deformable portion 410*c* is adapted, when the weight member 356*b* is attached to the weight member mounting section 356*d*, to be elastically deformed outwardly with respect to the outer surface of the switching member body 356*c*, in such a manner that the base end 410*a* and the distal end 410*b* serve as a fixed end and a free end, respectively, so as to allow the weight member 356*b* to pass between the switching member body 356*c* and the snap-fit element 410 in the front-rear direction.

The elastically deformable portion 410*c* has a protrusion 410*d* which protrudes from the distal end 410*b* toward the outer surface of the switching valve body 356*c*. During the operation of attaching the weight member 356*b* to the weight member mounting section, when the weight member 356*b* passes between the switching member body 356*c* and the snap-fit element 410 in the front-rear direction, the elastically deformable portion 410*c* is elastically bendingly deformed outwardly with respect to the outer surface of the switching valve body 356*c*, so that the weight member 356*b* can be moved in the front-rear direction while causing an outer surface 356*h* of the weight member 356*b* and the protrusion 410*d* to elastically contact each other.

In FIG. 27, a posture of the snap-fit element 410 occurring when the elastically deformable portion 410*c* is being elastically bendingly deformed outwardly with respect to the outer surface of the switching valve body 356*c* during the course of passing of the weight member 356*b* between the switching member body 356*c* and the snap-fit element 410, is indicated by the two-dot chain line A.

As illustrated in FIGS. 26(*c*) and 27, when the entire weight member 356*b* is fully inserted between the upper support portion 356*f* and the lower support portion 356*g*, the elastic contact between the outer surface 356*h* of the weight member 356*b* and the protrusion 410*d* is released, and the operation of attaching the weight member 356*b* to the weight member mounting section 356*d* is completed.

In a state after completion of the operation of attaching the weight member 356*b* to the weight member mounting section 356*d*, the elastic bending deformation based on the elastically deformable portion 410*c* is restored to cause a front end surface 356*i* of the weight member 356*b* and a rear (weight member-side) end surface 410*e* of the elastically deformable portion 410*c* to contact each other, thereby allowing the weight member 356*b* to be fixed by the snap-fit element 410 in the front-rear direction.

With reference to FIGS. 1 and 12 to 29(*d*), operations (functions) of the water discharge valve device and the flush water tank assembly equipped therewith, according to the fourth embodiment, will be described.

FIG. 28(*a*), FIG. 28(*b*), FIG. 28(*c*) and FIG. 28(*d*) are, respectively, a front sectional view illustrating the water discharge valve device of the flush water tank assembly according to the fourth embodiment, in a state before starting water discharge in the full flushing mode, a front sectional view illustrating the water discharge valve device of the flush water tank assembly according to the fourth embodiment, in a state just after starting the water discharge in the full flushing mode, a front sectional view illustrating the water discharge valve device of the flush water tank assembly according to the fourth embodiment, in a state during the course of the water discharge in the full flushing mode, and a front sectional view illustrating the water discharge valve device of the flush water tank assembly according to the fourth embodiment, in a state after completion of the water discharge in the full flushing mode.

FIG. 29(*a*), FIG. 29(*b*), FIG. 29(*c*) and FIG. 29(*d*) are, respectively, a front sectional view illustrating the water discharge valve device of the flush water tank assembly according to the fourth embodiment, in a state before starting water discharge in the partial flushing mode, a front sectional view illustrating the water discharge valve device of the flush water tank assembly according to the fourth embodiment, in a state just after starting the water discharge in the partial flushing mode, a front sectional view illustrating the water discharge valve device of the flush water tank assembly according to the fourth embodiment, in a state during the course of the water discharge in the partial flushing mode, and a front sectional view illustrating the water discharge valve device of the flush water tank assembly according to the fourth embodiment, in a state after completion of the water discharge in the partial flushing mode.

In FIGS. 28(*a*) to 28(*d*) and 29(*a*) to 29(*d*), a flow of flush water is schematically indicated by the arrowed line.

During both the full flushing and partial flushing modes in the following description, the cover portion 392*a* of the flow rate adjusting member 392 in the flow rate adjusting member 392 attached to the inner control casing member 376 is set to cover an upper region of the opening 376*a* of the inner control casing member 376 located above an approximately central height position of the opening 376*a*, as illustrated in FIG. 16.

Further, during both the full flushing and partial flushing modes in the following description, each of the proximal-side flow rate adjusting member 394 and the distal-side flow rate adjusting member 396 is attached to the outer control casing member 362 at a lowermost attaching position with respect to the casing body 390, so that each of the proximal-side flow rate adjusting opening 390*d* and the distal-side flow rate adjusting opening 390*d*' of the casing body 390 is approximately fully opened. More specifically, the upper edge of the distal-side flow rate adjusting member 396 is located below the upper edge of the proximal-side flow rate adjusting member 394, so that a lower edge of an open region of the distal-side flow rate adjusting opening 390*d*' is located above a lower edge of an open region of the proximal-side flow rate adjusting opening 390*d* and above the upper edge of the flushing mode-switching opening 390*c*.

Based on FIGS. 28(*a*) to 28(*d*), the full flushing mode in the two types of flushing modes to be performed by the flush water tank assembly according to the fourth embodiment will first be described below.

As illustrated in FIG. 28(*a*), in the water discharge valve device 328 in the state before start of water discharge in the full flushing mode, each of a first bead chain 48 and a second bead chain 50 is stretched approximately linearly in the up-down direction. In this state, due to a self-weight of the switching valve 356 with the weight member 356*b*, a third bead chain 54 is in a slackened state, and the switching valve 356 is in its valve open state in which it is moved to open the flushing mode-switching opening 390*c* of the casing body 390 of the outer control casing member 362.

Further, the water level within the water storage tank 22 reaches the maximum water level WL0 which is located above the upper end of the inner control casing member 376 and below the inlet port 86*a* of the overflow pipe 40, so that the inside of the casing body 390 of the outer control casing member 362 and the inside of the water compartment 376*b* of the inner control casing member 376 are filled with flush water.

Then, as illustrated in FIG. 28(*b*), in the water discharge valve device 328 in the state just after start of water discharge in the full flushing mode, when a user turns the operating lever 42 (see FIGS. 2 to 4) toward a near side (front side) by a given angle (e.g., 90 degrees), a bead chain pulling-up member 46 is rotated together with the rotary shaft 44, in such a manner that the first bead chain 48 is stretched approximately linearly in the up-down direction, and the second bead chain 50 is slackened. The third bead chain 50 is also slackened, so that the switching valve 356 is maintained in the state in which it opens the opening 390*c* of the casing body 390.

In this state, a first bead chain mounting portion 46*a* of the bead chain pulling-up member 46 is moved to a height position higher than that in the pre-discharge state illustrated in FIG. 29(*a*), so that only the first bead chain 48 is pulled upwardly by the first bead chain mounting portion 46*a* of the bead chain pulling-up member 46, thereby causing the float member 52 to be moved upwardly. Then, along with the upward movement of the float member 52, the overflow pipe 40 and the valve element 84 are integrally moved upwardly.

As a result, the valve element 84 is set to a pulling-up completion state in which it is in contact with the bottom of the inner control casing member 376, and located at the uppermost height position equal to or higher than the height position of the upper end of the opening 390*c* of the casing body 390. Thus, the discharge port 22*a* is opened to start water discharge, while allowing the switching valve 56 to continue to open the opening 390*c* of the casing body 390.

In this situation, flush water in a region of the water storage tank 22 outside the casing body 390 of the outer control casing member 362 flows into an inside of the casing body 390 through the openings 390*c*, 390*d*, 390*d*' being opened by the switching valve 356, the proximal-side flow rate adjusting member 394 and the distal-side flow rate adjusting member 396, and flush water in the water compartment 376*b* of the inner control casing member 376 flows into the inside of the casing body 90 through the opening 376*a*. Subsequently, flush water in the inside of the casing body 390 passes through the communication ports 82 of the discharge port unit 60, and is discharged to the water conduit 6 of the toilet main unit 2 through the discharge port 22*a*. Thus, as illustrated in FIG. 28(*b*), due to the water discharge, a water level WL1 within the water storage tank 22 is lowered with respect to the maximum water level WL0. For example, it is located above an upper end of the casing body 390 and below the upper end of the inner control casing member 376.

However, a water level WL1' within the water compartment 376*b* of the inner control casing member 376 is higher than the water level WL1 within the water storage tank 22 and lower than the maximum water level WL0, because a speed of a stream flowing from the outside of the casing body 390 into the discharge port 22*a* through the communication ports 82 is greater than a speed of a stream flowing from the inside of the water compartment 376*b* of the inner control casing member 376 into the inside of the casing body 390 through the opening 376*a*.

Then, as illustrated in FIG. 28(*c*), in the water discharge valve device 328 in the state during the course of the water discharge in the full flushing mode, the float member 52 is floating based on buoyancy imparted by flush water in the water compartment 376*b* of the inner control casing member 376, and each of the first bead chain 48 and the second bead chain 50 is in a slackened state, because the operating lever 42 is returned to its initial position just after the pulling-up of the first bead chain 48, the float member 52 and the valve element 84 is completed.

Subsequently, after the water level within the water storage tank 22 is gradually lowered over time from the water level WL1 illustrated in FIG. 28(*b*) to reach the upper edge of the distal-side flow rate adjusting member 396 attached to the casing body 390 (lower edge of the distal-side flow rate adjusting opening 390*d*' of the casing body 390), the inside of the water storage tank 22 and the inside of the casing body 390 are communicated with each other through the opening 390*c*. Thus, the water level within the water storage tank 22 and the water level within the casing body 390 are lowered to have the same water level WL2. Then, when the water level WL2 is gradually lowered over time to become lower than the upper end of the opening 376*a* of the water compartment 376*b* of the inner control casing member 376, a water level WL2' within the water compartment 376*b* of the inner control casing member 376 starts being lowered at a given speed corresponding to a flow rate of flush water flowing from the inside of the water compartment 376*b* of the inner control casing member 376 through the opening 376*a*.

Along with the lowering of the water level WL2' (illustrated in FIG. 28(*c*)) within the water compartment 376*b* of the inner control casing member 376, the float member 52 is moved downwardly, and the overflow pipe 40 and the valve element 84 are moved downwardly in interlocking relation to the downward movement of the float member 52, at the same speed as that of the downward movement of the float member 52.

For example, as the claw-shaped protrusion 400*a* of the flow rate adjusting member 392 is attached to the positioning recess 398*a* of the inner control casing member 376 at a higher position, the effective sectional area of the opening 376*a* of the inner control casing member 376 becomes larger, so that a flow rate of flush water flowing out of the inside of the water compartment 376*b* of the inner control casing member 376 through the opening 376*a* during the water discharge operation of the water discharge valve device 328 becomes larger, and the float portion 52*c* and the valve element 84 are moved downwardly at a higher speed. Thus, a time period in which the valve element 84 opens the discharge port 22*a* (valve open period) becomes shorter, and thereby the amount of flush water suppliable from the flush water tank assembly 318 to the toilet main unit 2 becomes smaller.

Then, as illustrated in FIG. 28(*d*), in the water discharge valve device 328 in the state after completion of the water discharge in the full flushing mode, when the water level WL2' (illustrated in FIG. 28(*c*)) within the water compartment 376*b* of the inner control casing member 376 is lowered to a water level imparting no buoyancy to the float member 52 (i.e., the water level WL2' becomes approximately zero), and the bottom portion 52*d* of the float portion 52*c* reaches the bottom of the water compartment 376*b*, the valve element 84 closes the discharge port 22*a* to complete the water discharge.

As a result, the water level within the water storage tank 22 and the water level within the casing body 390 are set to the dead water level DWL which is lower than the water level WL2 illustrated in FIG. 28(*c*).

Based on FIGS. 29(*a*) to 29(*d*), the partial flushing mode to be performed by the flush water tank assembly according to the fourth embodiment will secondly be described below.

An operation of the water discharge valve device 328 in the state before start of water discharge in the partial flushing mode as illustrated in FIG. 29(*a*) is the same as that in the full flushing mode as illustrated in FIG. 28(*a*), and its description will be omitted.

Then, as illustrated in FIG. 29(*b*), in the water discharge valve device 328 in the state just after start of water discharge in the partial flushing mode, when a user turns the operating lever 42 toward a far side (rear side) by a given angle (e.g., 90 degrees), the bead chain pulling-up member 46 is rotated together with the rotary shaft 44, the bead chain pulling-up member 46 is rotated together with the rotary shaft 44, in such a manner that a second bead chain 50 and the third bead chain 54 are stretched approximately linearly in the up-down direction, and the first bead chain 48 is slackened.

In this state, as illustrated in FIG. 29(*b*), the second bead chain mounting portion 46*b* of the bead chain pulling-up member 46 is moved to a height position higher than that in the pre-discharge state illustrated in FIG. 29(*a*), so that the second bead chain 50 is pulled upwardly by the second bead chain mounting portion 46*b* of the bead chain pulling-up member 46, thereby causing the float member 52 to be moved upwardly. Then, along with the upward movement of the float member 52, the overflow pipe 40 and the valve element 84 are integrally moved upwardly.

Concurrently, the third bead chain 54 is pulled upwardly by a third bead chain mounting portion 46*c* of the bead chain pulling-up member 46, and the third bead chain mounting portion 356*a* of the switching valve 356 is also pulled upwardly, so that the opening 390*c* of the casing body 390 is closed by the switching valve 356.

As a result, the valve element 84 is set to the pulling-up completion state in which it is in contact with the bottom of the inner control casing member 376, and located at the uppermost height position equal to or higher than the height position of the upper end of the opening 390*c* of the casing body 390. Thus, the discharge port 22*a* is opened to start water discharge, while allowing the switching valve 356 to close the opening 390*c* of the casing body 390.

As illustrated in FIG. 29(*b*), after start of the water discharge, a speed of flush water flowing inside the casing body 390 becomes relatively high as compared to a speed of flush water flowing outside the casing body 390, because flush water in the inside of the casing body 390 is discharged from the discharge port 22*a*, ahead of flush water of the outside of the casing body 390. Thus, a water pressure outside the switching valve 356 becomes higher than a water pressure inside the switching valve 356, which causes a pressure difference in water pressure between the inside and outside of the switching valve 356. Due to the pressure difference, a force F is applied to the switching valve 356 in a direction causing the switching valve 356 to close the opening 390*c* of the casing body 390, so that the switching valve 356 is maintained in its closed state.

Further, as illustrated in FIG. 29(*b*), flush water in a region of the water storage tank 22 outside the casing body 390 flows from the openings 390*d*, 390*d'* of the casing body 390 opened by respective ones of the proximal-side flow rate adjusting member 394 and the distal-side flow rate adjusting member 396, and the upper end of the casing body 90, into the inside of the casing body 390 without flowing into the inside of the casing body 390 through the opening 390*c* being closed by the switching valve 356.

Thus, flush water in the inside of the casing body 390 passes through the communication ports 82 of the discharge port unit 60, and is discharged to the water conduit 6 of the toilet main unit 2 through the discharge port 22*a*. Due to the water discharge, a water level WL3 (illustrated in FIG. 29(*b*)) within the water storage tank 22 is lowered with respect to the maximum water level WL0, and finally stabilized at a water level WL4, WL5 which is equal to a height position of the upper edge of the distal-side flow rate adjusting member 396 (lower edge of the distal-side flow rate adjusting opening 390*d'* of the casing body 390), as illustrated in FIGS. 29(*c*) and 29(*d*).

Further, flush water in the water compartment 376*b* of the inner control casing member 376 flows into the inside of the casing body 390 through the opening 376*a*. As illustrated in FIG. 29(*b*), a water level WL3' within the water compartment 376*b* of the inner control casing member 376 is higher than the water level WL3 within the water storage tank 22 and lower than the maximum water level WL0, because a speed of a stream flowing from the outside of the casing body 390 into the discharge port 22*a* through the communication ports 82 is greater than a speed of a stream flowing from the inside of the water compartment 376*b* of the inner control casing member 376 into the inside of the casing body 390 through the opening 376*a*.

Then, as illustrated in FIG. 29(*c*), in the water discharge valve device 328 in the state during the course of the water discharge in the partial flushing mode, the float member 52 is floating based on buoyancy imparted by flush water in the water compartment 376*b* of the inner control casing member 376, and each of the first bead chain 48, the second bead chain 50 and the third bead chain 54 is in a slackened state, because the operating lever 42 is returned to the initial position just after the pulling-up of the second bead chain 50, the third bead chain 54, the float member 52 and the valve element 84 as illustrated in FIG. 29(*b*) is completed.

Even if the third bead chain 54 is in the slackened state, the switching valve 356 is maintained in the closed state, because, due to the aforementioned pressure difference in water pressure between the inside and outside of the switching valve 356, the force F is continuously applied to the switching valve 356 in the direction causing the switching valve 356 to close the opening 390*c* of the casing body 390.

Subsequently, as illustrated in FIG. 29(*c*), when a water level WL4 within the water storage tank 22 is gradually lowered over time from the water level WL3 illustrated in FIG. 29(*b*) to reach a vicinity of the upper edge of the distal-side flow rate adjusting member 396 (lower edge of the distal-side flow rate adjusting opening 390*d*' of the casing body 390), flush water in the inside of the casing body 390 starts being rapidly discharged from the discharge port 22*a* through the communication ports 82.

Further, a water level WL4" within the casing body 390 is gradually lowered over time to become lower than the upper end of the opening 376*a* of the water compartment 376*b* of the control casing 76, a water level WL4' within the water compartment 76*b* of the inner control casing member 376 starts being lowered at a given speed corresponding to a flow rate of flush water flowing from the inside of the water compartment 376*b* of the inner control casing member 376 through the opening 376*a*.

Along with the lowering of the water level WL4' (illustrated in FIG. 29(*c*)) within the water compartment 376*b* of the inner control casing member 376, the float member 52 is moved downwardly, and the overflow pipe 40 and the valve element 84 are moved downwardly in interlocking relation to the downward movement of the float member 52, at the same speed as that of the downward movement of the float member 52.

As with the state in FIG. 29(*b*), the switching valve 356 is maintained in the closed state, because, due to the pressure difference in water pressure between the inside and outside of the switching valve 356, the force F is continuously applied to the switching valve 356 in the direction causing the switching valve 356 to close the opening 390*c* of the casing body 390.

Then, as illustrated in FIG. 29(*d*), in the water discharge valve device 328 in the state after completion of the water discharge in the partial flushing mode, when a water level WL5' within the water compartment 376*b* of the inner control casing member 376 is lowered to a water level imparting no buoyancy to the float member 52 (i.e., the water level WL5' becomes approximately zero), and the bottom portion 52*d* of the float portion 52*c* reaches the bottom of the water compartment 376*b*, the valve element 84 closes the discharge port 22*a* to complete the water discharge.

In this state, a water level WL5 within the water storage tank 22 is equal to the water level WL4 illustrated in FIG. 29(*c*), and defined as a substantial dead water level DWL' within the water storage tank 22.

On the other hand, a water level WL5" within the casing body 390 is lowered with respect to the water level WL4" illustrated in FIG. 29(*c*), and defined as a substantial dead water level DWL" within the casing body 390.

As with the states in FIGS. 29(*b*) and 29(*c*), the switching valve 356 is maintained in the closed state, because, due to the pressure difference in water pressure between the inside and outside of the switching valve 356, the force F is continuously applied to the switching valve 356 in the direction causing the switching valve 356 to close the opening 390*c* of the casing body 390.

As above, in the partial flushing mode, after start of the water discharge, the switching valve 356 is maintained in the state in which it closes the opening 390*c* of the casing body 390. Thus, a flow rate of flush water to be discharged from the discharge port 22*a* is reduced as compared to the full flushing mode by an amount corresponding to a flow rate of flush water in the water storage tank 22 to be discharged from the discharge port 22*a* after passing through the opening 390*c* from the outside of the casing body 390.

The fourth embodiment has been described based on one example where the attaching position of each of the proximal-side flow rate adjusting member 394 and the distal-side flow rate adjusting member 396 with respect to the outer control casing member 362 is set to a lowermost position. However, as the attaching position of each of the proximal-side flow rate adjusting member 394 and the distal-side flow rate adjusting member 396 with respect to the outer control casing member 362 is set to a higher position, the sectional area of each of the openings 390*d*, 390*d*' to be opened, respectively, by the proximal-side flow rate adjusting member 394 and the distal-side flow rate adjusting member 396 becomes smaller, so that, during the water discharge operation of the water discharge valve device 328, flush water in the water storage tank 22 hardly flows into the inside of the casing body 390 through the openings 390*d*, 390*d*' of the casing body 390. Therefore, an amount of flush water suppliable to the toilet main unit 2 through the discharge port 22*a* in the partial flush mode becomes smaller.

In the water discharge valve device 328 and the flush water tank assembly 318 equipped therewith, according to the fourth embodiment, the up-down directional width d1 of each of the positioning recesses 398*a* in the female fitting portion 398 of the inner control casing member 376 each fittable with the male fitting portion 400 of the flow rate adjusting member 392 is set to a value less than a width of a finger of an installation or maintenance person. The up-down directional width d2 of each of the positioning recesses 404*a* in the female fitting portion 404 of the outer control casing member 362 each fittable with the male fitting portion 402 of the proximal-side flow rate adjusting member 394, and the up-down directional width d2 of each of the positioning recesses 404*a*' in the female fitting portion 404' of the outer control casing member 362 each fittable with the male fitting portion 402' of the distal-side flow rate adjusting member 396, are also set to a value less than a width of a finger of an installation or maintenance person. Further, the up-down directional width d3 of each of the positioning recesses 408*a* in the female fitting portion 408 of the outer control casing member 362 each fittable with the male fitting portion 406 of the proximal-side flow rate adjusting member 394, and the up-down directional width d3 of each of the positioning recesses 408*a*' in the female fitting portion 408' of the outer control casing member 362 each fittable with the male fitting portion 406' of the distal-side flow rate adjusting member 396, are also set to a value less than a width of a finger of an installation or maintenance person. Thus, it becomes possible to prevent an undesirable situation where an installation or maintenance person inserts his/her finger into each of the positioning recesses 389*a*, 404*a*, 404*a*', 408*a*, 408*a*' on site to easily perform: an operation of releasing fitting engagement between the male fitting portion 400 of the flow rate adjusting member 392 and the female fitting portion 398 of the inner control casing member 376; an operation of releasing fitting engagement between each of the male fitting portions 402, 406 of the proximal-side flow rate adjusting member 394 and a respective one of the female fitting portions 404, 408 of the outer control casing member 362; and an operation of releasing fitting engagement between each of the male fitting portions 402', 406' of the distal-side flow rate adjusting member 396 and a respective one of the female fitting portions 404', 408' of the outer control casing member 362.

That is, in a state in which the male fitting portion 400 of the flow rate adjusting member 392 is fitted to the female fitting portion 398 of the inner control casing member 376, a state in which each of the male fitting portions 402, 406 of the proximal-side flow rate adjusting member 394 is fitted to a respective one of the female fitting portions 404, 408 of the outer control casing member 362, and a state in which each of the male fitting portions 402', 406' of the distal-side flow rate adjusting member 396 is fitted to a respective one of the female fitting portions 404', 408' of the outer control casing member 362, an installation or maintenance person cannot easily release the fitting engagement therebetween without using a tool or the like having a width less than that of the person's finger. This makes it possible to prevent an undesirable situation where the flow rate adjusting member 392 can be easily detached from the inner control casing member 376, and prevent an undesirable situation where the proximal-side flow rate adjusting member 394 and the distal-side flow rate adjusting member 396 can be easily detached from the outer control casing member 362.

Thus, during installation or maintenance of the flush water tank assembly 318 or the water discharge valve device 328, it becomes possible to prevent an installation or maintenance person from erroneously or accidentally changing an attaching position of the flow rate adjusting member 392 with respect to the inner control casing member 376, or erroneously changing an attaching position of each of the proximal-side flow rate adjusting member 394 and the distal-side flow rate adjusting member 396 with respect to the outer control casing member 362. That is, it becomes possible to prevent an installation or maintenance person from easily adjusting an amount of flush water suppliable from the water storage tank 22 to the toilet main unit 2, on site, and supply flush water to the toilet main unit 2 in a predetermined adequate amount.

In the water discharge valve device 328 and the flush water tank assembly 318 equipped therewith, according to the fourth embodiment, when each of the proximal-side flow rate adjusting member 394 and the distal-side flow rate adjusting member 396 is fitted to the outer control casing member 362, the frame-shaped protrusion 402*b* (402*b*') of the male fitting portion 402 (402') of the proximal-side flow rate adjusting member 394 (distal-side flow rate adjusting member 396) is fitted to the positioning recess 404*a* (404*a*') of the female fitting portion 404 (404') of the outer control casing member 362, and then the claw-shaped protrusion 406*a* (406*a*) of the male fitting portion 406 (406') of the proximal-side flow rate adjusting member 394 (distal-side flow rate adjusting member 396) can be readily fitted to the positioning recess 408*a* (408*a*') of the female fitting portion 408 (408') of the outer control casing member 362. Thus, it becomes possible to readily attach each of the proximal-side flow rate adjusting member 394 and the distal-side flow rate adjusting member 396 to the outer control casing member 362, thereby enhancing assemblability between each of the proximal-side flow rate adjusting member 394 and the distal-side flow rate adjusting member 396 and the outer control casing member 362.

Further, once each of the male fitting portions 402, 402', 406, 406' of the proximal-side flow rate adjusting member 394 and the distal-side flow rate adjusting member 396 is fitted to a corresponding one of the female fitting portions 404, 404', 408, 408' of the outer control casing member 362, an installation or maintenance person cannot easily release the fitting engagement between each of the male fitting portions 402, 402', 406, 406' of the proximal-side flow rate adjusting member 394 and the distal-side flow rate adjusting member 396 and a corresponding one of the female fitting portions 404, 404', 408, 408' of the outer control casing member 362, without using a tool or the like having a width less than that of the person's finger, so that it becomes possible to prevent an undesirable situation where each of the proximal-side flow rate adjusting member 394 and the distal-side flow rate adjusting member 396 is easily detached from the outer control casing member 362. Thus, during installation or maintenance of the flush water tank assembly 318 or the water discharge valve device 328, it becomes possible to prevent an installation or maintenance person from erroneously or accidentally changing an attaching position of each of the proximal-side flow rate adjusting member 394 and the distal-side flow rate adjusting member 396 with respect to the outer control casing member 362. That is, it becomes possible to prevent an installation or maintenance person from easily adjusting an amount of flush water suppliable from the water storage tank 22 to the toilet main unit 2, on site, and supply flush water to the toilet main unit 2 in a predetermined adequate amount.

In the water discharge valve device 328 and the flush water tank assembly 318 equipped therewith, according to the fourth embodiment, the female fitting portion 398 of the inner control casing member 376 is integrally provided in the wall portions 376*e* of the inner control casing member 376 on both sides of the opening 376*a*. Further, the female fitting portions 404, 408 of the outer control casing member 362 are integrally provided in the proximal sidewall 390*b* of the casing body 390, and the female fitting portions 404', 408' of the outer control casing member 362 are integrally provided in the distal sidewall 390*b*' of the casing body 390. Thus, it becomes possible to eliminate a need for providing means to prevent the undesirable situation where the fitting engagement between the flow rate adjusting member 392 and the inner control casing member 376, and the fitting engagement between each of the proximal-side flow rate adjusting member 394 and the distal-side flow rate adjusting member 396 and the outer control casing member 362, in addition to the positioning recesses 404*a*, 404*a*', 408*a*, 408*a*' of the female fitting portions 404, 404', 408, 408' of the outer control casing member 362. Therefore, during installation or maintenance of the flush water tank assembly 318 or the water discharge valve device 328, it becomes possible to prevent an installation or maintenance person from erroneously or accidentally changing an attaching position of each of flow rate adjusting members 392, 394, 396 with respect to a corresponding one of the inner control casing member 376 and the outer control casing member 362. This makes it possible to supply flush water to the toilet main unit 2 in a predetermined adequate amount.

In the water discharge valve device 328 and the flush water tank assembly 318 equipped therewith, according to the fourth embodiment, when the weight member 356*b* is attached to the weight member mounting section 356*d* of the switching valve 356 of the outer control casing member 362, the weight member 356*b* is inserted between the switching valve body 356*c* and the snap-fit element 410 from thereabove, so that a part of the weight member 356*b* is clamped between the switching valve body 356*c* and the snap-fit element 410. In this state, when the weight member 356*b* is moved rearwardly while allowing the weight member 356*b* to elastically contact the protrusion 410*d* of the snap-fit element 410 based on elastic deformation of the elastically deformable portion 410*c* of the snap-fit element 410, the elastic contact is released, and the weight member 356*b* is inserted between the switching valve body 356*c* and each of the support portions 356*f*, 356*g*, so that the weight member 356*b* can be reliably fixed to the weight member mounting section 356*d* by the support portions 356*f*, 356*g* and the rear end surface 410*e* of the snap-fit element 410.

Further, in a state in which the weight member 356*b* is attached to the weight member mounting section 356*d* of the switching valve 356 of the outer control casing member 362, according to a load of the weight member 356*b* in the up-down direction, the switching valve body 356*c* can be swingingly moved between a given upper position where it closes the opening 390*c* of the outer control casing member 362, and a given lower position where it opens the opening 390*c* of the outer control casing member 362. During the swinging movement, the up-down directional load is applied from the weight member 356*b* to the support portions 356*f*, 356*g* of the weight member mounting section 356*d*, whereas the up-down directional load of the weight member 356*b* is not applied to the snap-fit element 410 of the weight member mounting section 356*d* of the switching valve 356, which fixes the front end surface 356*i* of the weight member 356*b*, so that it becomes possible to prevent the snap-fit element 410 having a relatively low strength against an up-down directional load (e.g., the base end 410*a* of the snap-fit element 410) from being damaged by the load of the weight member 356*b*. Thus, it becomes possible to prevent an undesirable situation where, when the switching valve 356 of the outer control casing member 362 is being moved to open or close the opening 390*c* of the outer control casing member 362, the snap-fit element 410 of the weight member mounting section 356*d* of the switching valve 356 is broken, causing the weight member 356*b* to drop off from the weight member mounting section 356*d*. This makes it possible to prevent an inadequate movement of the switching valve 356, thereby enhancing reliability of the water discharge valve device 328.

Figure 30A:
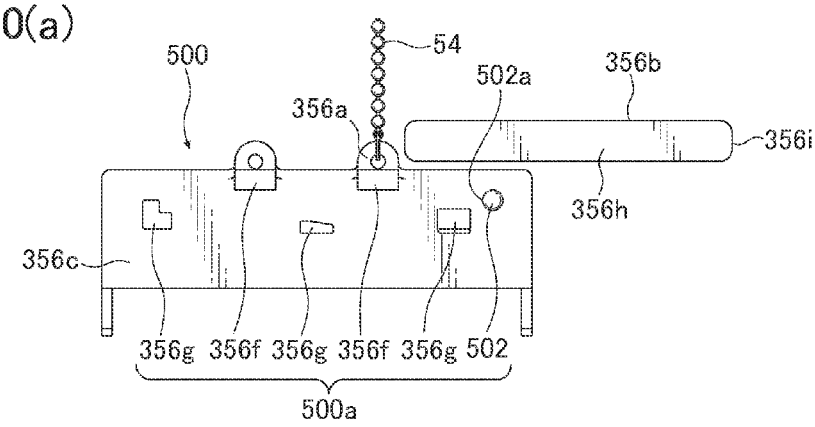
FIG. 30(*a*) is a side view illustrating a switching valve in a state before attaching a weight member thereto, in a water discharge valve device of a flush water tank assembly according to a fifth embodiment of the present invention.
Figure 30B:
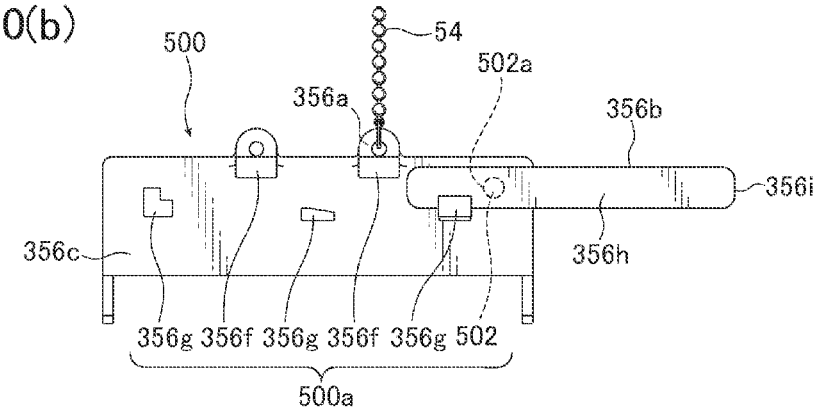
Figure 30C:
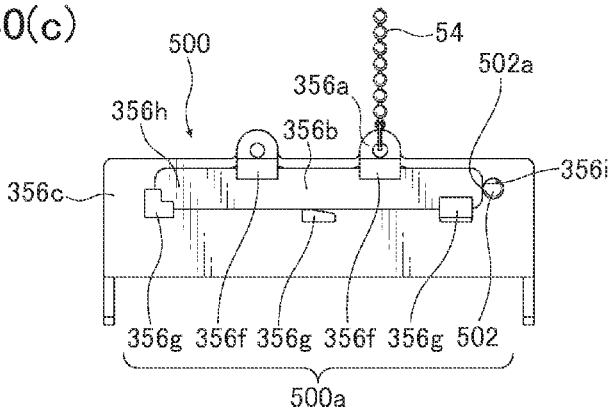

With reference to FIGS. 30(*a*) to 30(*c*) and 31, a water discharge valve device and a flush water tank assembly equipped therewith, according to a fifth embodiment of the present invention will be described.

FIG. 30(*a*), FIG. 30(*b*) and FIG. 30(*c*) are, respectively, a side view illustrating a switching valve in a state before attaching a weight member thereto, in a water discharge valve device of the flush water tank assembly according to the fifth embodiment, a side view illustrating the switching valve in a state during the course of the attachment of the weight member, in the water discharge valve device of the flush water tank assembly according to the fifth embodiment, and a side view illustrating the switching valve in a state after completion of the attachment of the weight member, in the water discharge valve device of the flush water tank assembly according to the fifth embodiment.

Figure 31:
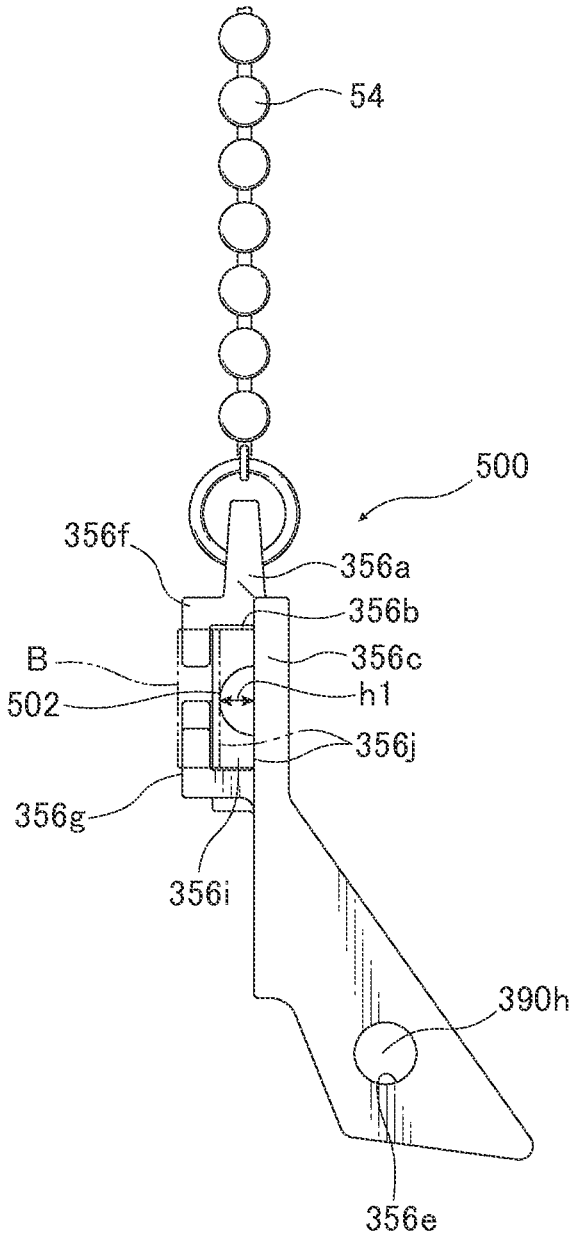
FIG. 31 is a front view illustrating the switching valve in the water discharge valve device of the flush water tank assembly according to the fifth embodiment.

FIG. 31 is a front view illustrating the switching valve in the water discharge valve device of the flush water tank assembly according to the fifth embodiment.

In FIGS. 30(*a*) to 30(*c*) and 31, the same element or component as that in the water discharge valve device according to the fourth embodiment is assigned with the same reference numeral or code, and its description will be omitted.

As illustrated in FIGS. 30(*a*) to 30(*c*) and 31, in the water discharge valve device according to the fifth embodiment, a configuration of a switching valve 500 is different from the switching valve 356 in the water discharge valve device 324 according to the fourth embodiment.

Specifically, the switching valve 500 comprises a protrusion 502 integrally formed on an outer surface 356 *h* of a switching valve body 356*c* to have a generally semi-spherical shape, and disposed frontward of an upper support portion 356*f* and a lower support portion 356*g* each supporting a weight member 356*b*.

When the weight member 356*b* is attached to a weight member mounting section 500*a*, the weight member 356*b* is brought into contact with an surface of the protrusion 502 from thereabove (see FIG. 30(*a*)), so that a part of a rear portion of the weight member 356*b* is supported by the lower support portion 356*g* (see FIG. 30(*b*)). In this state, the weight member 356*b* is set to be movable in a front-rear direction while contacting the surface of the protrusion 502.

As illustrated in FIGS. 30(*b*) and 31, when the weight member 356*b* is being moved in the front-rear direction while contacting the surface of the protrusion 502, it undergoes elastic bending deformation in a direction away from the outer surface 356*h* of the switching valve body 356*c*, due to a height dimension h1 of the protrusion 502 protruding outwardly from the outer surface 356*h* of the switching valve body 356*c*.

In FIG. 31, a posture of the weight member 356*b* undergoing the elastic bending deformation in a direction away from the outer surface 356*h* of the switching valve body 356*c*, when the weight member 356*b* is being moved in the front-rear direction while allowing an inner surface 356*j* of the weight member 356*b* to contact the surface of the protrusion 502 is indicated by the two-dot chain line B.

As illustrated in FIG. 30(*c*), when the entire weight member 356*b* is fully inserted between the upper support portion 356*f* and the lower support portion 356*g*, the elastic contact between the inner surface 356*j* of the weight member 356*b* and the protrusion 502 is released, and the operation of attaching the weight member 356*b* to the weight member mounting section 500*a* is completed.

In a state after completion of the operation of attaching the weight member 356*b* to the weight member mounting section 500*a*, the elastic bending deformation of the weight member 356*b* caused by the protrusion 502 is restored to cause a front end surface 356*i* of the weight member 356*b* and a peripheral edge 502*a* of the protrusion 502 to contact each other, thereby allowing the weight member 356*b* to be fixed by the protrusion 502 in the front-rear direction.

In the water discharge valve device according to the fifth embodiment, in the operation of attaching the weight member 356*b* in a pre-attachment state as illustrated in FIG. 30(*a*) to the weight member mounting section 500*a* of the switching valve 500 of an outer control casing member 362, a part of the weight member 356*b* is brought into contact with the protrusion 502 and a part of the lower support portion 356*g* from thereabove, as illustrated in FIG. 30(*b*), and then the weight member 356*b* is moved rearwardly while allowing the weight member 356*b* to elastically contact the surface of the protrusion 502. During the rearward movement, the weight member 356*b* passes against the protrusion 502 while undergoing elastic bending deformation in a direction away from the outer surface of the switching valve body 356*c*. Subsequently, when the entire weight member 356*b* is fully inserted between the upper support portion 356*f* and the lower support portion 356*g*, the elastic contact between the weight member 356*b* and the protrusion 402 is released, and the weight member 356*b* is inserted between the switching valve body 356*c* and each of the support portions 356*f*, 356*g*, so that it becomes possible to reliably fix the weight member 356*b* by the support portions 356*f*, 356*g* and the peripheral edge of the protrusion 502.

In the state in which the weight member 356*b* is attached to weight member mounting section 500*a* of the switching valve 500 of the outer control casing member 362, when the switching valve body 356*c* is swingingly moved between a given upper position where it closes the opening 390*c* of the outer control casing member 362, and a given lower position where it opens the opening 390*c* of the outer control casing member 362, according to an up-down directional load of the weight member 356*b*, the up-down directional load is applied from the weight member 356*b* to the support portions 356*f*, 356*g* of the weight member mounting section 500*a* of the switching valve 500, whereas the up-down directional load of the weight member 356*b* is not applied to the peripheral edge of the protrusion 502 of the weight member mounting section

500*a* of the switching valve 500, which fixes the front end surface 356*i* of the weight member 356*b*, so that it becomes possible to prevent the protrusion 502 from being damaged by the load of the weight member 356*b*. Thus, it becomes possible to prevent an undesirable situation where, when the switching valve 500 of the outer control casing member 362 is being moved to open or close an opening 390*c* of the outer control casing member 362, the protrusion 502 of the weight member mounting section 500*a* of the switching valve 500 is broken, causing the weight member 356*b* to drop off from the weight member mounting section 500*a*. This makes it possible to prevent an inadequate movement of the switching valve 500, thereby enhancing reliability of the water discharge valve device 328.

What is claimed is:

1. A water discharge valve device for a flush water tank, the flush water tank being configured to store therein flush water for flushing a toilet bowl, comprising:

a water discharge valve which includes a valve element for opening and closing a discharge port provided in a bottom wall of the flush water tank, and a control casing for controlling an up-down movement of the valve element;

a casing module which includes a peripheral wall extending upwardly from the bottom wall of the flush water tank while surrounding peripheries of the discharge port and the control casing of the water discharge valve, to define an upwardly open space therebetween, a flushing mode-switching opening formed to penetrate through the peripheral wall, and a switching valve attached to the peripheral wall and adapted to open and close the flushing mode-switching opening, the switching valve being operatable on the basis of the flushing mode, wherein the casing module is used irrespective of when a toilet is a siphon type flush toilet or a wash-down type toilet, wherein the casing module is configured so that when the switching valve moves in the direction for closing the flushing mode-switching opening, water discharge is performed in a partial flushing mode and wherein the casing module is configured so that when the switching valve moves in a direction for opening the flushing mode-switching opening, water discharge is performed in a full flushing mode in which the amount of flush water to be discharged from the discharge port is increased as compared to the partial flushing mode by an amount of flush water in a region of the flush water tank outside the casing module flowing into an inside of the casing module through the flushing mode-switching opening and then being discharged from the discharge port; and a communication port formed in a peripheral plane extending from the control casing of the water discharge valve to the discharge port, to provide fluid communication between the casing module and the discharge port, wherein the flushing mode-switching opening of the casing module is provided at a height position equal to or lower than that of an upper end of the communication port.

2. The water discharge valve device as defined in claim 1, wherein the valve element of the water discharge valve is adapted to be moved upwardly to its given uppermost height position when flush water in the flush water tank is supplied from the discharge port to the toilet bowl, and wherein the given uppermost height position of the valve element is set to be equal to or higher than a height position of an upper end of the flushing mode-switching opening of the casing module.

3. The water discharge valve device as defined in claim 1 wherein:

the control casing of the water discharge valve includes a water compartment adapted to store therein flush water and formed with a small hole for draining the stored flush water at a given small flow rate, and a float provided in the water compartment in such a manner that it is gradually moved downwardly along with a lowering in water level within the water compartment; and the valve element of the water discharge valve is adapted to be moved downwardly in interlocking relation to the downward movement of the float, to close the discharge port, and wherein the small hole of the water compartment of the control casing is provided at a height position equal to or higher than that of an upper end of the flushing mode-switching opening of the casing module.

4. The water discharge valve device as defined in claim 1, wherein the valve element of the water discharge valve has a lower end located above and in opposed relation to the discharge port and formed to have a curved surface which is gradually reduced in diameter, in such a manner as to be tapered in a downward direction.

5. The water discharge valve device as defined in claim 1, wherein the discharge port has an inner peripheral surface which is opposed to the lower end of the valve element of the water discharge valve and formed as a flow passage surface gradually reduced in diameter in a downward direction.

6. The water discharge valve device as defined in claim 1, which further comprises:

an operating unit including a rotary shaft, the operating unit being adapted to allow a user to rotationally operate the rotary shaft about its axis so as to manipulate an opening-closing movement of the water discharge valve to switch an amount of flush water suppliable from the discharge port to the toilet bowl, to either one of a full-flushing flush water amount for performing full flushing of the toilet bowl, and a partial-flushing flush water amount for performing partial flushing of the toilet bowl; and coupling means coupling the operating unit and the water discharge valve together, the coupling means including:

a full-flushing coupling member having one end attached to a first mounting position of the operating unit and the other end attached to a first mounting position of the water discharge valve, the full-flushing coupling member being adapted, when the rotary shaft of the operating unit is rotationally operated in a given rotation direction, to move the water discharge valve upwardly so as to perform the full flushing of the toilet bowl; and a partial-flushing coupling member having one end attached to a second mounting position of the operating unit and the other end attached to a second mounting position of the water discharge valve, the partial-flushing coupling member being adapted, when the rotary shaft of the operating unit is rotationally operated in a direction opposite to the given rotation direction, to move the water discharge valve upwardly so as to perform the partial flushing of the toilet bowl, wherein the water discharge valve has the first mounting position to which the full-flushing coupling member is attached and the second mounting position to which the partial-flushing coupling member is attached, the second mounting position of the water discharge valve being different from the first mounting position of the water discharge valve, wherein the first mounting position of the operating unit to which the full-flushing coupling member is attached is set on one side with respect to the axis of the rotary shaft of the operating unit, and the second mounting position of the operating unit to which the partial-flushing coupling member is attached is set on the other side with respect to the axis of the rotary shaft of the operating unit and wherein the axis of the rotary shaft of the operating unit passes across an axis of the water discharge valve; and a distance between the first mounting position of the operating unit and the second mounting position of the operating unit is approximately equal to a distance between the first mounting position of the water discharge valve to which the other end of the full-flushing coupling member is attached, and the second mounting position of the water discharge valve to which the other end of the partial-flushing coupling member is attached.

7. The water discharge valve device as defined in claim 1, which further comprises a discharge port unit attached to the flush water tank to form the discharge port, wherein the casing module is detachably attached to the discharge port unit from thereabove, wherein the casing module is configured to: in a state in which the casing module is attached to the discharge port unit, in response to operating the switching valve to open the opening, increase an amount of flush water flowing into an inside of the casing module, to allow an amount of flush water suppliable to the toilet bowl when the water discharge valve opens the discharge port, to be set to a given value for full flushing, and, in response to operating the switching valve to close the opening, reduce the amount of flush water flowing into the inside of the casing module, to allow the amount of flush water suppliable to the toilet bowl when the water discharge valve opens the discharge port, to be set to a given value for partial flushing; and, in a state in which the casing module is detached from the discharge port unit, allow the amount of flush water suppliable to the toilet bowl when the water discharge valve opens the discharge port, to be set to the given value for full flushing, and wherein the casing module includes:

a casing body capable of receiving therein flush water; and engagement means formed at an end of the casing body on the side of the discharge port and adapted to be engageable and disengageable with respect to the casing-module mounting portion by rotating the casing body about its axis.

8. The water discharge valve device as defined in claim 7, wherein:

the water discharge valve includes a valve element for opening and closing the discharge port of the discharge port unit, and a control casing for controlling an up-down movement of the valve element;

the control casing of the water discharge valve includes a water compartment adapted to store therein flush water and formed with a small hole for draining the stored flush water at a given small flow rate, and a float provided in the water compartment in such a manner that it is gradually moved downwardly along with a lowering in water level within the water compartment; and the valve element of the water discharge valve is adapted to be moved downwardly in interlocking relation to the downward movement of the float, to close the discharge port.

9. The water discharge valve device as defined in claim 8, wherein the discharge port unit includes a control-casing mounting portion which is disposed between the casing-module mounting portion and the control casing of the water discharge valve, and formed with the communication port for allowing flush water on an outside of the control casing to flow into the discharge port, and to which the control casing of the water discharge valve is detachably attached from thereabove.

10. The water discharge valve device as defined in claim 1, wherein:

the control casing of the water discharge valve is an inner control casing member for controlling the up-down movement of the valve element; and the casing module is an outer control casing member provided to surround peripheries of the discharge port, the valve element and the inner control casing member, and configured to control a flow rate of flush water flowing out of the discharge port of the flush water tank, according to opening and closing of the opening by the switching valve, wherein the switching valve of the outer control casing member includes:

a switching valve body swingably attached to a peripheral wall of the outer control casing member, and adapted to be swingingly moved outwardly with respect to the outer control casing member, from a given upper position where it closes the opening of the outer control casing member, to a given lower position where it opens the opening of the outer control casing member;

a plate-shaped weight member; and a weight member mounting section provided in the switching valve body and adapted to allow the weight member to be detachably attached thereto, the weight member mounting section having: a support portion for supporting an upper edge and a lower edge of the weight member; and a fixing portion provided on one side of the support portion to fix a lateral portion of the weight member, the fixing portion having elastic contact means adapted to, when the weight member is attached or detached with respect to the support portion, provide elastic contact between the weight member and the fixing portion so as to allow the weight member to pass against the fixing member.

11. The water discharge valve device as defined in claim 10, wherein the weight member of the switching valve of the outer control casing member is adapted, when the weight member is attached to the weight member mounting section, to be movable in a horizontal direction while elastically contacting the fixing portion by utilizing the elastic contact means, and, after the weight member is inserted between the switching member body and the support portion, and released from the elastic contact, to be fixed to the switching member body by the support portion and a side surface of the fixing portion.

12. The water discharge valve device as defined in claim 10, wherein the elastic contact means of the fixing portion is an elastic fastener which has: a base end protruding outwardly from an outer surface of the switching member body by a given length; a distal end extending upwardly from the base end by a given length while maintaining a spaced-apart relation to the outer surface of the switching member body by a given distance; and an elastically deformable portion extending from the base end to the distal end, the elastically deformable portion being adapted, when the weight member is attached to the weight member mounting section, to be elastically deformed outwardly with respect to the outer surface of the switching member body, in such a manner that the base end and the distal end serve as a fixed end and a free end, respectively, so as to allow the weight member to pass between the switching member body and the elastic fastener, and, after completion of the attachment of the weight member to the weight member mounting section, to be restored from the elastically deformed state so as to cause a side surface of the weight member and a side surface of the elastic fastener on the side of the weight member to contact each other, thereby allowing the weight member to be fixed in the horizontal direction.

13. A flush water tank assembly comprising the water discharge valve device as defined in claim 1.

* * * * *